US008269092B2

(12) United States Patent
Terauchi et al.

(10) Patent No.: US 8,269,092 B2
(45) Date of Patent: Sep. 18, 2012

(54) MUSICAL CONTENT REPRODUCING DEVICE AND MUSICAL CONTENT REPRODUCING METHOD

(75) Inventors: Toshiro Terauchi, Tokyo (JP); Yoichiro Sako, Tokyo (JP); Kosei Yamashita, Kanagawa (JP); Yasushi Miyajima, Kanagawa (JP); Motoyuki Takai, Tokyo (JP); Toru Sasaki, Tokyo (JP); Yuichi Sakai, Kanagawa (JP)

(73) Assignee: Sony Corporation, Tokyo (JP)

( * ) Notice: Subject to any disclaimer, the term of this patent is extended or adjusted under 35 U.S.C. 154(b) by 1288 days.

(21) Appl. No.: 11/910,563

(22) PCT Filed: Apr. 5, 2006

(86) PCT No.: PCT/JP2006/307191

§ 371 (c)(1), (2), (4) Date: Oct. 3, 2007

(87) PCT Pub. No.: WO2006/114998

PCT Pub. Date: Nov. 2, 2006

(65) Prior Publication Data

US 2009/0088877 A1 Apr. 2, 2009

(30) Foreign Application Priority Data

Apr. 25, 2005 (JP) ..... 2005-125920

(51) Int. Cl.
*G10H 1/36* (2006.01)
*G10H 7/00* (2006.01)
*G10H 1/18* (2006.01)

(52) U.S. Cl. ..... 84/610; 84/615

(58) Field of Classification Search ..... 84/609, 84/610, 634, 615

See application file for complete search history.

(56) References Cited

U.S. PATENT DOCUMENTS 5,304,112 A 4/1994 Mrklas et al.

(Continued)

FOREIGN PATENT DOCUMENTS

CN 1332406 A 1/2002

(Continued)

OTHER PUBLICATIONS

Chinese Office Action issued Oct. 29, 2010, in Patent Application No. 200680012447.4 (with English-language translation).

(Continued)

*Primary Examiner* — Jeffrey Donels

(74) *Attorney, Agent, or Firm* — Oblon, Spivak, McClelland, Maier & Neustadt, L.L.P.

(57) ABSTRACT

An apparatus is provided which is capable of easily reconstructing (arranging) a piece of music depending on, for example, a feeling of a user listening to the piece of music. First acquisition means acquires data of a specific music content to be played back, from a music content data storage unit in which data of a plurality of music contents are stored. Second acquisition means acquires attribute information associated with the music content in units of music constituent elements from an attribute information storage unit. Third acquisition means acquires arrangement information associated with the music content and associated with the music construction information. In accordance with an arrangement request command issued by the user, the data of the music content being output as audio playback output data is reconstructed on the basis of the music construction information acquired by the second acquisition means and the arrangement information acquired by the third acquisition means.

12 Claims, 35 Drawing Sheets

U.S. PATENT DOCUMENTS

| | | | | |
|---|---|---|---|---|
| 5,484,957 | A | 1/1996 | Aoki et al. | |
| 5,877,445 | A | 3/1999 | Hufford et al. | |
| 7,208,672 | B2 * | 4/2007 | Camiel | 84/625 |
| 7,319,185 | B1 * | 1/2008 | Wieder | 84/609 |
| 2002/0166440 | A1 * | 11/2002 | Herberger et al. | 84/625 |
| 2004/0159221 | A1 * | 8/2004 | Camiel | 84/660 |
| 2007/0261537 | A1 * | 11/2007 | Eronen et al. | 84/611 |
| 2008/0013757 | A1 * | 1/2008 | Carrier | 381/119 |
| 2009/0107320 | A1 * | 4/2009 | Willacy et al. | 84/609 |
| 2010/0075806 | A1 * | 3/2010 | Montgomery | 482/8 |
| 2010/0132536 | A1 * | 6/2010 | O'Dwyer | 84/609 |

FOREIGN PATENT DOCUMENTS

| | | |
|---|---|---|
| EP | 1 170 722 | 1/2002 |
| EP | 1 830 347 | 9/2007 |
| JP | 9-204176 | 8/1997 |
| JP | 2000 99011 | 4/2000 |
| JP | 2002 91438 | 3/2002 |
| JP | 2002-91438 | 3/2002 |
| JP | 2002 169550 | 6/2002 |
| JP | 2002-169550 | 6/2002 |
| JP | 2003 173350 | 6/2003 |
| JP | 2004-264334 | 9/2004 |
| JP | 2006 171133 | 6/2006 |
| WO | WO 01/86624 | 11/2001 |

OTHER PUBLICATIONS

Office Action issued Mar. 22, 2011, in Chinese Patent Application No. 200680012447.4 with English translation.

European Search Report in English language dated Apr. 10, 2012 in corresponding European application 06 73 1139, filed on Apr. 5, 2006.

* cited by examiner

FIG. 2

| | | |
|---|---|---|
| ARRANGEMENT OF CHORDS | ORIGINAL SERIES OF CHORDS | \| C \| F \| C \| G \| |
| | ARRANGED SERIES OF CHORDS | ARRANGEMENT 1: \| C \| F \| C \| G7 \|<br>ARRANGEMENT 2: \| C \| F \| C \| G9 \|<br>ARRANGEMENT 3: \| C \| F7 \| C \| G7 \|<br>ARRANGEMENT 4: \| C \| F7 \| C7 \| G7 \| |
| ARRANGEMENT OF DRUMS | ORIGINAL DRUM | ROCK AND ROLL / 8-BEAT FUNK<br>DR1 (4/4 TIME, 1 STEP = EIGHTH NOTE, ◎ACCENT / ○NON ACCENT / _PAUSE)<br>RIDE CYMBAL \|◎○◎○◎○◎○\|…<br>SNARE DRUM \|_ _◎_ _ _◎_\|…<br>BASS DRUM \|◎_ _ _◎_ _ _\|… |
| | ARRANGED DRUM | SOUL / 8 BEATS<br>DR2 (4/4 TIME, 1 STEP = EIGHTH NOTE, ◎ACCENT / ○NON ACCENT / _PAUSE)<br>RIDE CYMBAL \|◎○◎○◎○◎○\|◎○◎○◎○◎○\|…<br>SNARE DRUM \|◎_◎_◎_◎_\|◎_◎_◎_◎_\|…<br>BASS DRUM \|◎_ _○_○_○\|◎◎_○_○_○\|… |

| MUSIC ID | ARRANGEMENT INFORMATION | MUSIC CONSTRUCTION INFORMATION | |
|---|---|---|---|
| ID1 | CLASSIC STYLE | | |
| | JAZZ STYLE | | |
| | ROCK AND ROLL STYLE | | |
| | SOUL STYLE | | |
| | HIP-HOP STYLE | | |
| | ⋮ | | |
| ID2 | | | |

FIG. 18

| MUSIC MATERIAL NAME | CHORD VALUE | BMP VALUE | INSTRUMENT NAME | IMPRESSION VALUE (LIGHTNESS) |
|---|---|---|---|---|
| MATERIAL 3A | F | 120 | GUITAR | 1 |
| MATERIAL 3B | F | 120 | GUITAR | 2 |
| | | | | 3 |
| | | | | 4 |
| | | | | 5 |
| | | | | 6 |
| | | | | 7 |
| | | | | 8 |

| MUSIC MATERIAL NAME | CHORD VALUE | BMP VALUE | INSTRUMENT NAME | IMPRESSION VALUE (LIGHTNESS) |
|---|---|---|---|---|
| MATERIAL 2A | E | 100 | PIANO | 1 |
| MATERIAL 2B | E | 100 | PIANO | 2 |
| | | | | 3 |
| | | | | 4 |
| | | | | 5 |
| | | | | 6 |
| | | | | 7 |
| | | | | 8 |

| MUSIC MATERIAL NAME | CHORD VALUE | BMP VALUE | INSTRUMENT NAME | IMPRESSION VALUE (LIGHTNESS) |
|---|---|---|---|---|
| MATERIAL 1A | D | 140 | VOCAL | 1 |
| MATERIAL 1B | D | 140 | VOCAL | 2 |
| MATERIAL 1C | D | 140 | VOCAL | 3 |
| MATERIAL 1D | D | 140 | VOCAL | 4 |
| MATERIAL 1E | D | 140 | VOCAL | 5 |
| MATERIAL 1F | D | 140 | VOCAL | 6 |
| MATERIAL 1G | D | 140 | VOCAL | 7 |
| MATERIAL 1H | D | 140 | VOCAL | 8 |

MUSICAL CONTENT REPRODUCING DEVICE AND MUSICAL CONTENT REPRODUCING METHOD

TECHNICAL FIELD

The present invention relates to a music content playback apparatus and a music content playback method, allowing a user to reconstruct (arrange) music contents in a desired manner similar to a manner in which, for example, a disk jockey arranges music contents.

BACKGROUND ART

Achievement of increasing in storage capacity of storage media such as optical disks or hard dicks has made it possible to store a great number of music contents in a storage medium. A playback apparatus is available which is adapted to play music contents stored on such a high-capacity storage medium.

In conventional music content playback apparatuses, a user selects a music content from a large number of music contents and performs an operation to play the selected music content.

A system is also known which is adapted to determine candidates for music contents on the basis of a music content playback history of a user and present the candidates to the user (see, for example, Japanese Unexamined Patent Application Publication No. 2003-173350).

In the conventional techniques, as described above, a user selects a music content to be played, or an apparatus selects candidates for music contents to be played on the basis of a playback history and presents the selected candidates to the user. However, in the conventional music content playback apparatus, a music content selected in the above-described manner is simply played back in a manner intended by a music content producer, and there is no playback apparatus adapted to play a music content in a manner modified according to a preference of a user.

That is, a music content produced by a producer or an artist is allowed to be played back by a music content playback apparatus only in a manner originally intended by the producer, partially because of a limitation in capabilities of the music content playback apparatus.

If it is allowed to reconstruct a music content, for example, by changing the tempo or the key or mixing a piece of music with another piece of music, thereby arranging the music content into a desired style such as a classic style, a jazz style, a hip-hop style, etc., in a similar manner to that performed by a disk jockey, according to a preference of a listener (hereinafter also referred to as a user), the listener can enjoy listening to music much more.

In view of the above, it is an object of the present invention to provide a technique that allows a user to reconstruct (arrange) a music content into a desired form and enjoy listening to the music content played back in the arranged form.

DISCLOSURE OF INVENTION

To achieve the object described above, the present invention provides, as claimed in claim 1, a music content playback apparatus comprising first acquisition means for acquiring data of a specific music content to be played back from a music content data storage unit in which data of a plurality of music contents are stored;

second acquisition means in which attribute information associated with the music content is acquired from an attribute information storage unit, the attribute information including at least music construction information associated with each music constituent element of the music content;

third acquisition means for acquiring arrangement information associated with the music content and associated with the music construction information is acquired;

means for providing an audio playback output of the specific music content data acquired by the first acquisition means;

arrangement request command accepting means for accepting an arrangement request command issued by a listener; and reconstruction means for reconstructing the data of the music content to be output as audio playback output data, on the basis of the music construction information acquired by the second acquisition means and the arrangement information acquired by the third acquisition means in accordance with the arrangement request command accepted by the arrangement request command accepting means.

In the music content playback apparatus according to claim 1, arrangement information is acquired by the third acquisition means in accordance with the arrangement request command issued by a listener, and data of a music content is reconstructed in accordance with the arrangement information and also in accordance with music construction information acquired by the second acquisition means.

Thus, music data is allowed to be reconstructed in real time depending on a feeling and/or a preference of a user and/or depending on an environmental situation so that the user can enjoy listening to music played back in an optimum manner determined depending on the situation.

BRIEF DESCRIPTION OF THE DRAWINGS

FIG. 2 is a diagram illustrating a part of attribute information used in a recording/playback apparatus according to an embodiment.

FIG. 18 is a diagram for an explanation of a part of the functional block diagram shown in FIG. 14.

BEST MODE FOR CARRYING OUT THE INVENTION

First Embodiment

Figure 1:
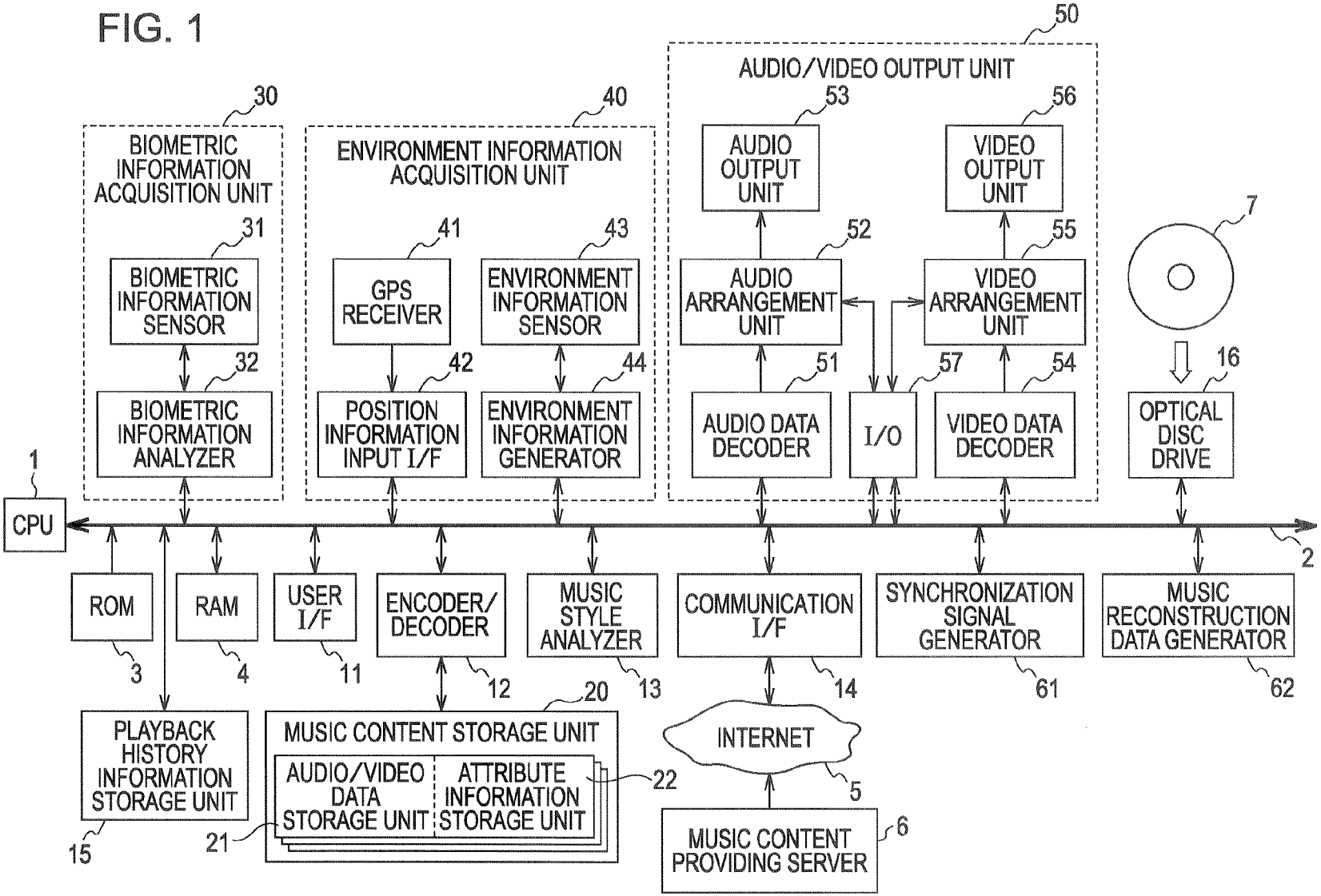
FIG. 1 is a block diagram illustrating a recording/playback apparatus implemented as a first embodiment of a music content playback apparatus according to the present invention.

A first embodiment of the present invention is described below with reference to figures. FIG. 1 is a block diagram illustrating an example of a configuration of a music content recording/playback apparatus, which is a combination of a music content playback apparatus according to the first embodiment and a recording apparatus adapted to record a music content and attribute information thereof according to the first embodiment.

In this first embodiment, the recording/playback apparatus includes a music content storage unit adapted to store not only audio data of music or music content data but also video data. Hereinafter, such data will be generically referred to as audio/video data. In this first embodiment, music content data is stored together with attribute information of each piece of music such that each music content is related to corresponding attribute information via identification information.

The attribute information includes music style/structure attribute information indicating the tempo, the key, the chord, the rhythm, etc. which determine the music style/structure of each piece of music (note that the music style/structure attribute information is included in music construction information which will be described later). The attribute information also includes performer information, lyric information, impression information, environment information, and reconstruction information (hereinafter, also referred to as arrangement information). When the music content includes video information, the attribute information may include information about an attribute of image.

The arrangement information is information according to which to arrange music data of a music content to be played back into a form such as a rock and roll style, a classic style, a jazz style, a hip-hop style, or a soul style.

As will be described later, when a music content is stored on a removable storage medium such as a DVD (Digital Versatile Disc) disk, if attribute information associated with the music content is stored on this storage medium, this attribute information may be used for the present purpose.

In this case, when the music content data is stored into a storage unit of the recording/playback apparatus from the storage medium such as the DVD disk, the attribute information is also stored in association with the music content data.

In a case where no attribute information is stored on a storage medium, when music content data is stored into the storage unit of the recording/playback apparatus from the storage medium, the recording/playback apparatus produces necessary attribute information and stores the produced attribute information in association with audio/video data of the music content.

In the recording/playback apparatus according to the first embodiment, information associated with a music content may be downloaded, for example, from a music content providing server on the Internet.

In this case, information associated with the music content supplied from the music content providing server is assumed to include attribute information. Thus, if a music content providing server receives a request for a music content from the recording/playback apparatus according to the first embodiment, the music content providing server sends audio/video data of the requested music content together with associated attribute information to the recording/playback apparatus.

If the recording/playback apparatus receives the audio/video data and the attribute information, the recording/playback apparatus stores them in the storage unit such that they are related to each other via identification information of the music content.

In the present example, the recording/playback apparatus includes a microcomputer, which includes, as shown in FIG. 1, a CPU (Central Processing Unit) 1, a program ROM (Read Only Memory) 3 and a work area RAM (Random Access Memory) 4. The program ROM 3 and the work area RAM 4 are connected to the CPU 1 via a system bus 2.

The system bus 2 is also connected to a user interface 11, an encoder/decoder 12, a music style/structure analyzer 13, a communication interface 14, a playback history information storage unit 15, and an optical disk drive 16.

The user interface 11 includes a button operation unit (not shown) used by a user to input a command/data, and a display such as an LCD (Liquid Crystal Display). For example, as described later, a user is allowed to input a command via this user interface 11 to specify a style (such as a classic style or a jazz style) into which to arrange a music content being played.

The encoder/decoder 12 is connected to a music content storage unit 20. In the present example, the music content storage unit 20 is realized by a high-capacity hard disk drive. Alternatively, the music content storage unit 20 may be realized by a write/read unit using a high-capacity rewritable optical disk.

When data is written in the hard disk drive of the music content storage unit 20, the encoder/decoder 12 encodes the data to be written into a format in which the data is to be written in the hard disk drive. On the other hand, when data is read from the hard disk drive, the encoder/decoder 12 performs a decoding process, opposite to the encoding process, on the read data. In the encoding/decoding process, the encoding process may include a data compression process, and correspondingly, the decoding process may include a data decompression process.

In the present example, the music content data includes not only music data but also video data associated with the music content and attribute information (described in detail later) associated with the music content.

The music content storage unit 20 includes an audio/video data storage unit 21 and an attribute information storage unit 22. The audio/video data storage unit 21 is adapted to store music data and video data of each music content, and the attribute information storage unit 22 is adapted to store attribute information associated with each music data and video data. Note that the music data and the video data stored in the audio/video data storage unit 21 and the attribute information stored in the attribute information storage unit 22 are related to each other via music content identification information (content ID) identifying each music content.

The music style/structure analyzer 13 operates such that when music data of a music content is stored in the audio/video data storage unit 21 of the music content storage unit 20, the music style/structure analyzer 13 analyzes the music data to detect boundaries of music constituent elements of the music data and extract music construction information for each music constituent element. Note that the music construction information is stored as part of the attribute information in the attribute information storage unit 22. The music style/structure analyzer 13 operates only when information associated with a music content to be stored includes no attribute information, and the extracted music construction information is stored as part of attribute information.

The music constituent element refers to a constituent element of music, such as a beat or a measure, to which a chord can be applied. The music construction information includes information indicating a tempo, a key, a chord, a sound volume, a rhythm, a score, a sequential change in chord, etc. which are defined for each music constituent element and which determine the style of music.

The communication interface 14 is used to connect to a music content providing server 6 or the like via an external network such as the Internet 5. In the present example, the music content providing server 6 is adapted to provide not only music data and video data but also attribute information.

The playback history information storage unit 15 stores history information indicating how frequently or how long each music content was played on the recording/playback apparatus and indicating the arrangement style in which each music content was played (that is, information indicating the arrangement style and the frequency of use of the arrangement style for each music content). More specifically, for each music content identified by identification information (content ID), the number of times (frequency) each music content was played, the arrangement style used in each playback, the playback time, the biological state, and the environmental situation (environment information will be described in further detail later) when the music content was played, etc. are stored in the playback history information storage unit 15.

The optical disk drive 16 reads music data or video data from an optical disk 7 such as a CD (Compact Disc) or a DVD (Digital Versatile Disc). When attribute information associated with a music content is also stored on the optical disk 7, the attribute information is also read.

In the present example of the recording/playback apparatus, the system bus 2 is also connected to a biological information acquisition unit 30, an environment information acquisition unit 40, and an audio/video output unit 50.

The biological information acquisition unit 30 includes a biological information sensor 31 and a biological information analyzer 32. The biological information sensor 31 detects information (biological state information) by which to determine whether a listener of a music content likes the present music content to some extent. The biological information sensor 31 detects biological information of a listener in terms of, for example, body motion, breathing, a pulse a blood pressure, a body surface temperature, perspiration, and/or electric skin resistance. The detected biological information is supplied to a biological information analyzer 32.

When a user is listening to a favorite music and is enjoying it very much, the body motion or breathing of the listener is often synchronized with the rhythm or the tempo of the music being played. When a melody is played at a slow tempo, the body motion and the breathing of the listener tend to become slow in response to the slow melody. In response to abrupt increasing in sound volume, the body motion tends to become large. Correspondingly, breathing may occur in such a manner that breathing is stopped for a while after an intake of breath and then sudden expiration occurs.

There is also a tendency that when a listener is spiritually uplifted by music, the pulse rate and perspiration of the listener increase. In contrast, when music being played is slow or calm, the pulse rate tends to decrease to a stable state.

If the biological information analyzer 32 receives, from the biological information sensor 31, information indicating an emotional state of the listener, the biological information analyzer 32 determines whether the listener likes the music being played, and sends data indicating a determination result over the system bus 2. In this analysis process, the biological information analyzer 32 refers to the music construction information of music being played to determine whether the body motion or the like of the listener is in synchronization with the music.

More specifically, in the present embodiment, the biological information analyzer 32 determines the level of preference by comparing the biological information indicating the body motion or the like with a plurality of thresholds, and outputs a determined preference level, such as "no preference is shown (not enjoying music)", "preference is shown although the preference level is low", or "very high preference is shown (enjoying music very much)".

The environment information acquisition unit 40 includes a GPS receiver 41, a position information input interface 42, an environment information sensor 43, and an environment information generator 44.

The GPS receiver 41 calculates the position of the GPS receiver 41 from radio waves received from a plurality of artificial satellites, and sends data indicating the calculated position to the position information input interface 42. In the present example, if the position information input interface 42 receives the data indicating the position from the GPS receiver 41, the position information input interface 42 converts the position into position information such as a name and sends the result over the system bus 2. When a music content is stored, the position information indicating the position where the operation of storing of the music content is performed is stored as a part of the environment information, which is a part of the attribute information, associated with the music content.

The environment information sensor 43 includes a temperature sensor and a humidity sensor. The environment information sensor 43 further includes a clock for detecting a date/time or a season. The environment information generator 44 receives information from the environment information sensor 43 and sends information indicating the temperature, the humidity, the season, and the data/time over the system bus 2. When the music content is stored, the above-described information is also stored as a part of the environment information, which is a part of the attribute information, associated with the music content.

The audio/video output unit 50 includes an audio data decoder 51, an audio arrangement unit 52, an audio output unit 53, a video data decoder 54, a video arrangement unit 55, a video output unit 56, and an I/O port 57.

When audio data supplied to the audio data decoder 51 is a lossless PCM audio signal, the audio data decoder 51 does not perform any process on the received audio data and simply transfers the received audio data to the audio output unit 53 via the audio arrangement unit 52. When the music data is in a compressed form according to, for example, the ATRAC (Adaptive Transform Acoustic Coding) scheme, the AAC (Advanced Audio Coding) scheme, or the like, the audio data decoder 51 decodes the received music data into a digital audio signal by decompressing it. When the audio data is MIDI (Music Instrument Digital Interface) data, the audio data decoder 51 produces a digital audio signal from the MIDI data.

The audio arrangement unit 52 performs arrangement such as tempo modification, pitch modification, sound effect application, mixing (remixing) with another music data, etc., in accordance with a control signal supplied to the audio arrangement unit 52 via the I/O port 57. This makes it possible to change the music style/structure or the arrangement style into a specified style such as the classic style, jazz style, etc.

In the present embodiment, sound effects applied to the music data by the audio arrangement unit 52 includes distortion, reverb, etc.

Remixing is a technique, as widely performed by disk jockeys, to mix a plurality of musical materials with music being played, in units of measures or beats, without damaging original musical quality. More specifically, in accordance with prepared music construction information indicating boundaries of measures (boundaries of music constituent elements), the tempo, the chord, etc., a plurality of musical materials are mixed with music being currently played according to a music theory into a musically natural form. The remixing can also make a contribution to changing of the music style/structure or the arrangement style into a desired style such as the classic style, the jazz style, etc.

In the remixing process, music data to be mixed with the music data being currently played is extracted from other music data and supplied to the audio data decoder 51 under the control of the CPU 1. Thus, in the present embodiment, the audio data decoder 51 is configured to perform in parallel decoding of main audio data being currently played and decoding of audio data to be mixed.

The output of the audio arrangement unit 52 is supplied to the audio output unit 53. The audio output unit 53 converts the received digital audio signal into an analog audio signal and supplies the resultant analog audio signal to a speaker via an amplifier (not shown) or to a headphone (not shown) via an output terminal thereby acoustically outputting music data.

In the present embodiment, the video data decoder 54 decodes (decompresses) compressed video data associated with the music content. The compressed video data associated with the music content may be JPEG (Joint Photographic Experts Group) still image data or MPEG (Moving Picture Experts Group)-2 or MPEG-4 moving image data. The video data decoder 54 has the capability of decompressing data in such a format.

The video data decoded by the video data decoder 54 is supplied to the video arrangement unit 55. The video arrangement unit 55 applies an image effect to the received video data. This process may be performed in accordance with a known technique, and thus a further detailed description thereof is omitted herein.

The video data output from the video arrangement unit 55 is supplied to the video output unit 56. The video output unit 56 outputs the received digital video data directly, or after converting it into an analog form if necessary, to a display via a video output terminal so that an image is displayed on the screen of the display in accordance with the video data.

Attribute Information

In the present embodiment, the attribute information of each music content includes various kinds of information associated with each piece of music.

(1) Music Construction Information

The music construction information includes information indicating boundaries between music constituent elements, information indicating the tempo, the key, the chord, the volume, and the rhythm of music, music score information, information indicating a series of chords, information indicating a rising timing of a music waveform to be repeatedly mixed, etc. The information indicating the tempo may be expressed, for example, in BPM (Beat Per Minutes).

The style of music is expressed by the music construction information. The music content recording/playback apparatus analyzes the music construction information to determine the style of music. That is, when some pieces of music are similar in music construction information, it is determined that they are similar in music style. When a listener shows some interest in music being currently played, the music construction information makes it possible to extract other pieces of similar music and select some of them as candidates for being played following the current music.

On the other hand, when a listener shows no interest in music being played, a playback history is examined to detect music favored by the listener, and the music construction information associated with the detected music is analyzed. On the basis of the analysis result, one or more pieces of music having similar music construction information are selected as candidates for being played next following the current music.

Furthermore, use of information indicating boundaries between music constituent elements, the tempo of the music, the series of chords, etc., included in the music construction information, makes it possible to remix a plurality of pieces of music into a musically natural form.

Note that the attribute information should exactly correspond to the audio/video data of the music content. For example, time code information which is included in the music construction information of the attribute information and which indicates boundaries of music constituent elements such as measures should exactly correspond to time code information indicating boundaries of measures of actual audio/video data.

The exact correspondence makes it possible to exactly detect, from the music construction information, boundaries of music constituent elements, such as measures or beats, of music being currently played, and thus it becomes possible to add information of musical materials in units of music constituent elements to the music being currently played in synchronization with boundaries of music constituent elements of the music being currently played, to achieve musically natural remixing.

(2) Effect Information

Effect information indicates a sound effect applied to music, and includes effect parameters associated with distortion, reverb, etc. To change effect parameters with time, the effect information includes time-varying parameters.

A plurality of pieces of effect information may be prepared in the music content recording/playback apparatus according to the present embodiment. However, when there is recommended effect information for a particular piece of music, the effect information is incorporated in the attribute information associated with the particular piece of music. The recommended effect information is given, for example, by a producer of the music content. Note that a plurality of pieces of effect information may be described in the attribute information.

It is desirable that effect information be described in units of music constituent elements in attribute information. The description of effect information in units of music constituent elements makes it possible to change the effect in units of music constituent elements in real time as music is played back.

(3) Arrangement Information

As described above, the arrangement information is information according to which to arrange original music into a particular style such as the rock and roll style, the classic style, the jazz style, etc. To change arrangement parameters with time, the arrangement information includes time-varying parameters.

The arrangement information is provided not in such a manner that a plurality of types of arrangement information are prepared in the music content recording/playback apparatus but in such a manner that recommended arrangement information for each piece of music is included in attribute information associated with each piece of music stored on the music content storage medium. Alternatively, recommended arrangement information may be supplied as a part of attribute information associated with each piece of music downloaded from the music content providing server 6. In the present embodiment, the arrangement information is not limited to recommended arrangement information provided in the above-described manner, but arrangement information may be produced by a user and registered as a part of attribute information of a particular piece of music.

Arrangement information produced by a user for a particular pieces of music may be uploaded to the server 6, and arrangement information produced by a produce of a music content may be stored in the server 6 so that an arbitrary user is allowed to acquire arrangement information at no or some charge from the server 6.

Note that a plurality of types of arrangement information may be included in attribute information. Furthermore, each type of arrangement information may include a plurality of sub-types of arrangement information. For example, arrangement information for arrangement into a classic style may include a plurality of sub-types of arrangement information for arrangement into, for example, a Bach style, a Beethoven style, a Mozart style, etc.

It is desirable that arrangement information be described in units of music constituent elements in attribute information. The description of arrangement information in units of music constituent elements makes it possible to change the arrangement in units of music constituent elements in real time as music is played back.

FIG. 2 illustrates an example of arrangement information. In this example, original rock and roll music is arranged (reconstructed) into a soul style by changing a chord and a drum part.

In this example, as shown in FIG. 2, there are four modes for arrangement of the sequence of chords so that a user is allowed to select one of these four modes, although there is only one mode of arrangement of the drum part.

Note that the arrangement information shown in FIG. 2 is one of examples, and it is not guaranteed herein that this arrangement information is capable of arranging any piece of music from the rock and roll style into the soul style in a manner acceptable by any user, because an arrangement result liked by some users may not be accepted by other users. That is, the arrangement information shown in FIG. 2 is an example of arrangement information recommended by a provider of a music content, and the arrangement information can be produced in a wide variety manners even for a similar arrangement style.

Figures 3, 4:
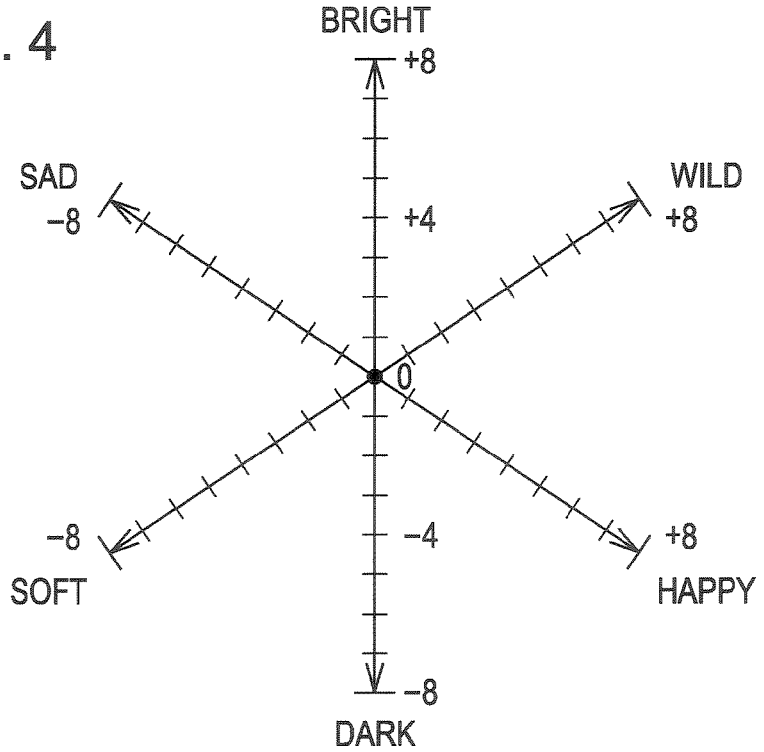
FIG. 3 is a diagram illustrating a part of attribute information used in a recording/playback apparatus according to an embodiment.
FIG. 4 is a diagram illustrating a part of attribute information used in a recording/playback apparatus according to an embodiment.

As described above, the arrangement information for one piece of music is not limited to one type, but it is allowed to prepare a plurality of types of arrangement information for the same piece of music. FIG. 3 illustrates an example of arrangement information described as a part of attribute information for each of a plurality of pieces of music.

As shown in FIG. 3, the attribute information includes, in addition to arrangement information, music construction information, effect information, and other kinds of information described later, in association with music identification information (music ID). The arrangement information is described for each of a plurality of music styles such as the classic style, the jazz style, the rock and roll style, the soul style, the hip-hop style, etc. Although not shown in the figure, each type of arrangement information may include a plurality of sub-types of arrangement information, such as a classic-1 type, a classic-2 type, a classic-3 type, etc.

(4) Instrument Information

Instrument information is information associated with instruments such as a drum, a guitar, etc. used for a piece of music. For example, instrument information indicating a play pattern of a percussion instrument such as a drum may be described for one measure in attribute information, and this instrument information may be used repeatedly to repeatedly play the percussion instrument. Play pattern information of a particular instrument may be used in remixing.

Instead of describing play pattern information of a percussion instrument for one measure as a part of attribute information, instrument information of a plurality of patterns may be provided in advance in the recording/playback apparatus. Such instrument information may be used in remixing.

(5) Performer Information

Performer information is information associated with a performer, and may include information indicating a name of a performer (or a group of performers) of an instrument (or a singer), sex, an age, a group organization, etc.

(6) Impression Information

Impression information indicates a sensuous recognition of a listener for a piece of music. For example, an impression such as a cheerful/dark impression, a calm/wild impression, a happy/sad impression, etc. sensuously recognized by a listener for a particular piece of music is quantitatively expressed by impression information. For example, impression information is acquired as follows. As shown in FIG. 4, impression axes such as a cheerful/dark impression axis, a calm/wild impression axis, a happy/sad impression axis, etc. are defined in advance, and a listener inputs a value indicating his/her impression on a particular piece of music for each impression axis.

For example, in the case of the cheerful/dark impression axis, as shown in FIG. 4, the degree of subjective and sensuous recognition is numerically expressed in 16 levels. In the example shown in FIG. 4, a darkest level is assigned a value of "−8", and a more cheerful level is expressed by a greater value. Other axes such as the calm/wild impression axis, and the happy/sad impression axis are defined in a similar manner. Impression axes may be defined for other impression items.

After values on the respective impression axes are input, a schematically expression of impressions for a particular piece of music can be obtained by connecting respective values on the axes by lines as shown in FIG. 4 (in the example shown in FIG. 4, the shape of a triangle changes depending on the music style/structure). In other words, the expression of the music style/structure using the impression axes makes it possible to easily search for music having similar music style/structure.

In a case where the music style/structure of a music content stored on a storage medium is expressed using the impression axes and described as a part of attribute information associated with the music content, or in a case where the music style/structure expressed using the impression axes is included in attribute information provided from a music content providing server, a particular piece of music of interest is evaluated by many listeners such as several ten listeners, and the averages of impression values on the respective axes are described in the impression information.

A user of the recording/playback apparatus may define impression information for a particular piece of music. When impression values described in impression information included in attribute information stored on a storage medium or included in attribute information acquired from a music content providing server are different from those evaluated by a listener, the impression values described in the impression information included in attribute information may be rewritten by the listener and the resultant attribute information including the rewritten impression values may be stored in the music content storage unit of the recording/playback apparatus.

(7) Environment Information

The environment information may include information indicating a suitable listening place such as a mountain, a beach, etc., recommended by a DVD producer or an operator of a music content providing server. As described later, when a piece of music is recorded on the recording/playback apparatus, information indicating the location, the date/time, the season, the temperature, the humidity, etc. where the recording is performed may be acquired as environment information by the environment information acquisition unit 40. In this case, the environment information may include location information indicating a suitable listening place defined by a listener.

(8) Playback History Information

The playback history information indicates how frequently or how long each piece of music was listened to by a listener. In the present embodiment, as described above, the playback history information is stored in the playback history information storage unit 15 of the recording/playback apparatus. When data of a music content is recorded in the music content storage unit 20, the playback history information is stored as a part of the attribute information in the attribute information storage unit 22 of the music content storage unit 20.

Note that attribute information provided by a DVD producer or supplied from a server does not include playback history information.

Recording Process Performed by Recording/Playback Apparatus According to First Embodiment A recording process performed by the recording/playback apparatus according to the first embodiment is described below. The recording process may be performed in various modes.

In one mode, data of a music content stored on a DVD disk is read and recorded in the music content storage unit 20. In another mode, data of a music content is received from the music content providing server 6 via the Internet 5 and the received data is recorded. In still another mode, although not shown in figures, data of a music content is received from another playback apparatus or the like via an external input terminal, and the received data is recorded in the music content storage unit 20.

In the recording process in any mode, when data of a music content includes attribute information, the recording/playback apparatus according to the present embodiment reads and stores the attribute information, in addition to the audio/video data of the music content, in the music content storage unit 20. In the recording/playback apparatus according to the present embodiment, when the recording process is performed, a user is allowed to add or modify attribute information as required.

In a case where data of a music content includes only audio/video data and does not include attribute information, the recording/playback apparatus according to the present embodiment may produce (set) attribute information and store the produced attribute information in the attribute information storage unit 22 of the music content storage unit 20.

More specifically, the music style/structure analyzer 13 acquires music construction information by analyzing the audio data read from a DVD disk or acquired via downloading, and stores the acquired music construction information as a part of the attribute information. A user may input a 16-level value as impression information indicating an impression of a piece of music, as described above. The input impression information is stored as a part of the attribute information. The environment information acquired via the environment information acquisition unit 40 is also stored as a part of the attribute information. Furthermore, the playback history information is stored as a part of the attribute information as required.

In the present embodiment, it is assumed that there is an attribute information providing server on the Internet 5. If the server receives a download request including identification information specifying a music content corresponding to attribute information, the server sends the requested attribute information corresponding to the music content identified by identification information.

Figure 5:
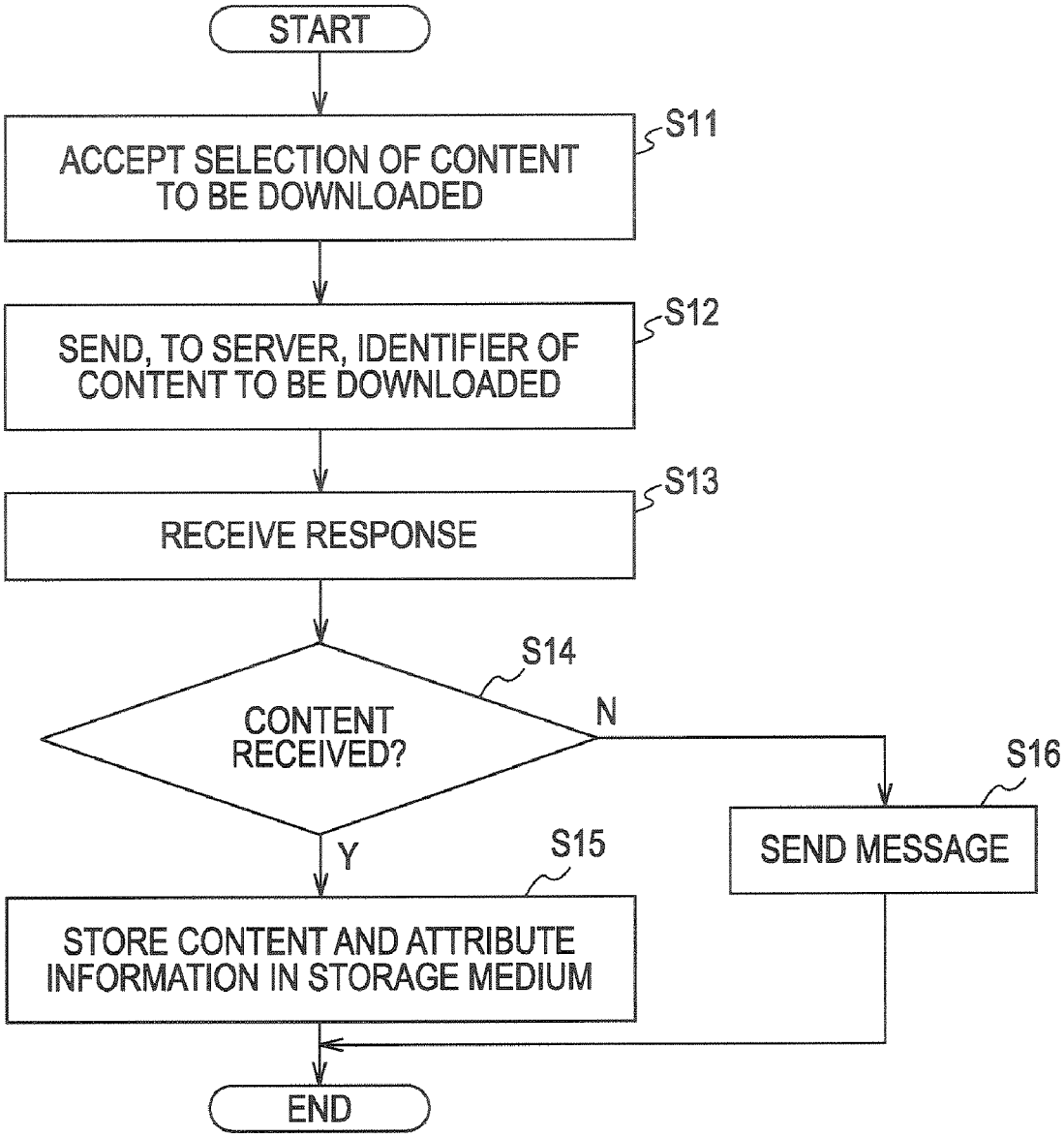
FIG. 5 is a flow chart illustrating an example of a process performed by the recording/playback apparatus shown in FIG. 1.
Figure 6:
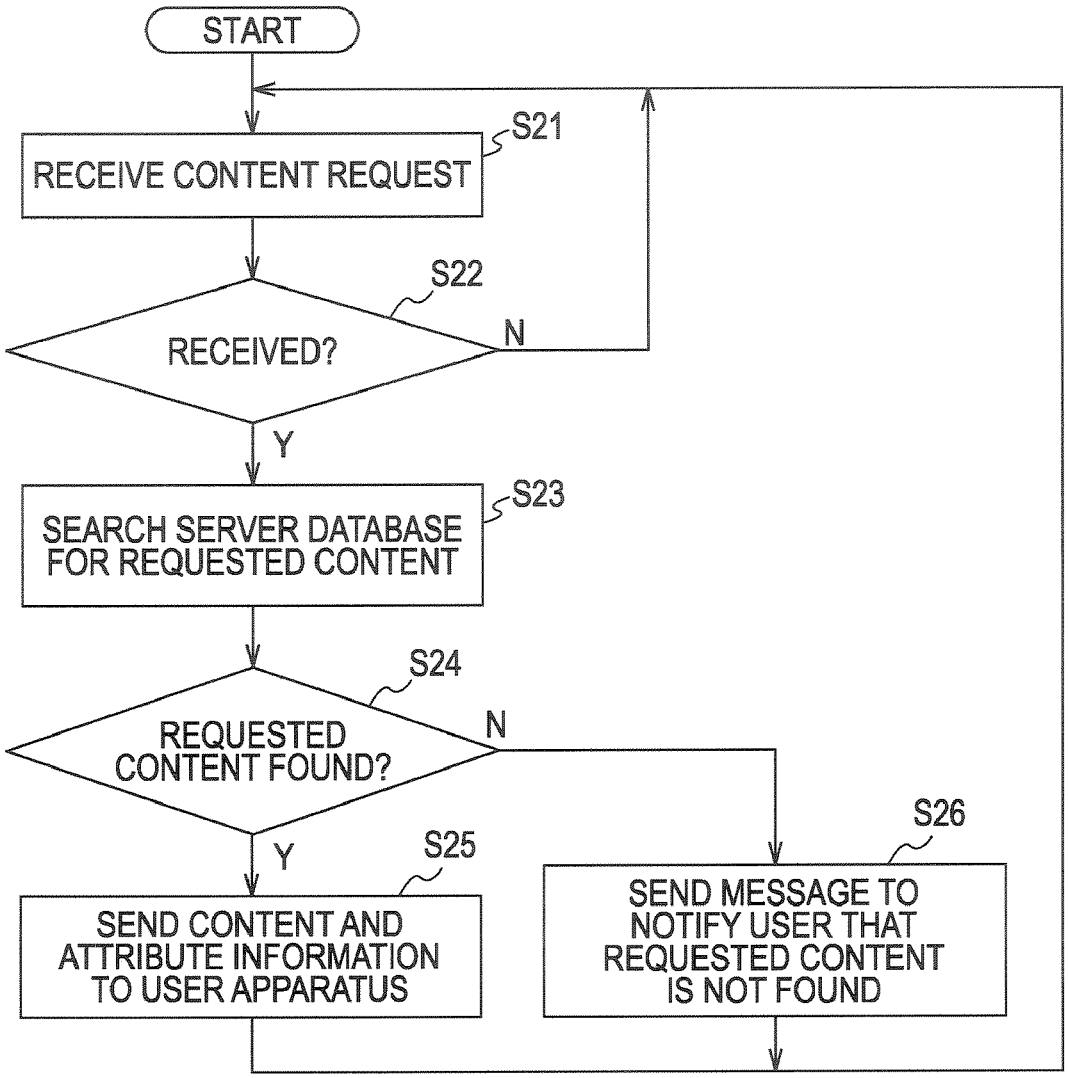
FIG. 6 is a flow chart illustrating an operation of the recording/playback apparatus shown in FIG. 1.

FIGS. 5 and 6 are flow charts illustrating operations of the recording/playback apparatus and the music content providing server 6, in a process to acquire a music content and associated attribute information from the music content providing server 6.

Although in the following discussion, it is assumed by way of example that data of a music content and associated attribute information are supplied from the music content providing server 6 to the recording/playback apparatus, attribute information may be transmitted between a plurality of recording/playback apparatuses in a similar manner.

FIG. 5 illustrates a process performed by the recording/playback apparatus to acquire data of a music content and associated attribute information, and FIG. 6 illustrates a process performed by the music content providing server 6 to provide the data of the music content and the associated attribute information.

If an operation is performed on the recording/playback apparatus to start a program to issue a request for music content data and associated attribute information, the CPU 1 of the recording/playback apparatus starts the process shown in FIG. 5. First, in this process, a selection of a music content to be downloaded is accepted (step S11).

In accordance with the accepted selection, a music content provision request including an identifier of the music content to be downloaded is produced and sent to the music content providing server 6 via the communication interface 14 and the Internet 5 (step S12).

A control unit (CPU) of the music content providing server 6 is always running to perform a process shown in FIG. 6 so that an arrival of a music content provision request from a recording/playback apparatus received via the Internet 5 and a communication interface disposed in the music content providing server 6 is continuously monitored (step S21), and a determination is made as to whether a request has been received (step S22). If it is determined in step S22 that no music content provision request has been received, the processing flow returns to step S21 to repeat the process from step S21 until a music content provision request has been received.

If the control unit of the music content providing server 6 determines in step S22 that a music content provision request has been received from a recording/playback apparatus, then the control unit of the server 6 searches the music contents stored in the server 6 in accordance with a music content identifier included in the received request to detect data of the requested music content and associated attribute information (step S23).

The control unit of the music content providing server 6 determines whether data of the requested music content has been found (step S24). If the data has been found, the control unit of the music content providing server 6 sends the data, via the communication interface and the Internet 5, to the recording/playback apparatus which has requested music content (step S25). The processing flow then returns to step S21 to repeat the process from step S21.

On the other hand, it the case where it is determined in step S24 that there is no data of the requested music content, the control unit of the music content providing server 6 produces a response message indicating that there is no data of the requested music content, and the control unit of the music content providing server 6 sends the response message, via the communication interface and the Internet 5, to the recording/playback apparatus which is the requester of the music content (step S26). The processing flow then returns to step S21 to repeat the process from step S21.

If the recording/playback apparatus which issued the request receives the response (message) from the music content providing server 6 via the communication interface 14 (step S13), the recording/playback apparatus analyzes the received response to determine whether data of the requested music content has been received (step S14). If it is determined in step S14 that the data of the requested music content has been received, the received data of the music content and attribute information provided together with the music content are stored in the music content storage unit (step S15). Thus, the process shown in FIG. 5 is completed.

On the other hand, in the case where it is determined in step S14 that data of the requested music content is not received (that is, the message indicating that there is no data of the requested music content has been received), the control unit of the recording/playback apparatus notifies a user of the recording/playback apparatus that there is no data of the requested music content, by using a display such as an LCD (Liquid Crystal Display) or a light emitting device such as an LED (Light Emitting Diode), or an alarm such as a buzzer, which is disposed on the recording/playback apparatus although not shown in FIG. 1 (step S16), and the control unit of the recording/playback apparatus ends the process shown in FIG. 5.

In the present embodiment, as described above, the recording/playback apparatus is configured such that when the recording/playback apparatus receives data of a specified music content, the recording/playback apparatus also receives attribute information provided together with the data of the music content, and such that the received data of the music content and the attribute information associated with the data of the music content data are stored in the music content storage unit 20 so that they can be used for playback.

In the case where no attribute information is provided in association with the data of the music content, attribute information is produced from the music construction information produced via the analysis performed by the music style/structure analyzer 13 or from the environment information acquired by the environment information acquisition unit, and the produced attribute information is stored in association with the audio/video data of the music content in the music content storage unit 20.

On the other hand, in a case where no attribute information of a music content is stored in the music content storage unit of the recording/playback apparatus although music data of that music content is stored, the recording/playback apparatus may send an attribute information provision request including an identifier of the music content to the server 6 to acquire only the attribute information.

Figure 7:
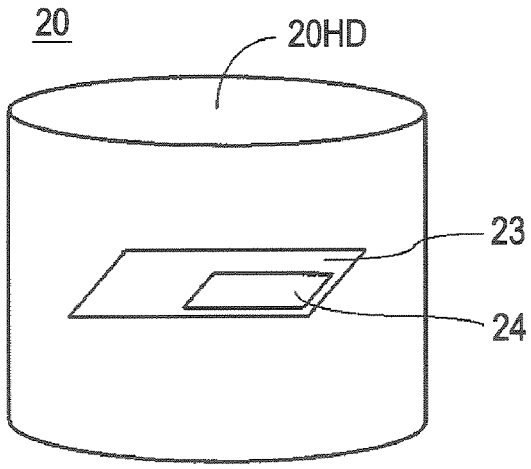
FIG. 7 is a diagram illustrating an example of a music content storage unit shown in FIG. 1.

FIG. 7 illustrates a basic structure of a hard disk drive which is an example of the music content storage unit 20 of the recording/playback apparatus according to the present embodiment. The hard disk drive 20HD serving as the music content storage unit 20 includes a storage area 23 for storing audio/video data Dt such as audio data and/or video data of music contents, and a storage area 24 for storing attribute information At. The storage area 23 functions as the audio/video data storage unit 21 and the storage area 24 functions as the attribute information storage unit 22.

Figure 8:
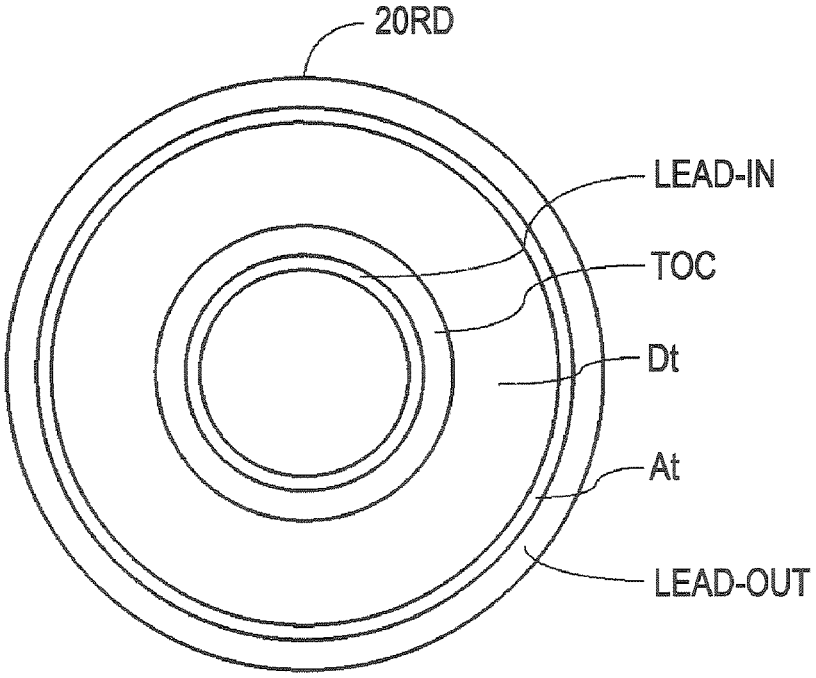
FIG. 8 is a diagram illustrating an example of a music content storage unit shown in FIG. 1.

Although in the present embodiment, the music content storage unit 20 is realized by the hard disk drive, the music content storage unit 20 may be realized by using a removable storage medium such as a disk medium typified by a DVD disk. FIG. 8 illustrates an example of a disk medium (such as a magneto-optical disk) 20RD usable as the music content storage unit 20.

As shown in FIG. 8, content data (audio/video audio data) Dt such as audio content data and/or video content data are stored in a data storage area of the optical disk 20RD. Furthermore, as shown in FIG. 8, the optical disk 20RD also includes a storage area for storing content attribute information At, in addition to other areas such as a lead-in area, a TOC (Table Of Contents) area, and a lead-out area, which are storage areas commonly provided on optical disks. When the content data Dt includes data of a plurality of pieces of music, attribute information is stored for each piece of music. In this case, the content data Dt and the attribute information At are related to each other via music content identification information (music content ID) as described above.

The optical disk 20RD including music content data stored thereon may be produced and provided in a market by a music content producer. Alternatively, the optical disk 20RD may be produced by a general user by downloading a music content via the Internet and storing it using a personal computer or the like.

As shown in FIGS. 7 and 8, the attribute information At stored in the storage medium may be arbitrarily modified by a user using the recording/playback apparatus. The modification of the attribute information may include rewriting, adding, deleting, and/or replacement of the existing attribute information with new attribute information. For example, to add information indicating boundaries of music constituent elements to the attribute information, the recording/playback apparatus may automatically analyze music content data of interest and automatically produce information indicating boundaries of music constituent elements, or may adding information indicating boundaries in accordance with a command input by a user via the user interface 11.

In accordance with a modification command input by a user via the user interface 11, the attribute information stored in the music content storage unit 20 may be modified. Similarly, in accordance with a command input by a user via the user interface 11, the attribute information stored in the music content storage unit 20 may be deleted or replaced with newly produced or acquired attribute information.

New attribute information for the above purpose may be acquired via the Internet 5 and the communication interface 14, or may be provided from an external apparatus such as another recording/playback apparatus via a digital interface such as a USB (Universal Serial Bus) interface. Alternatively, new attribute information may acquired via a wireless LAN, a wireless interface, and a transmitting/receiving antenna, and may be used for addition or replacement.

In any case, music content data and attribute information are related to each other via identifiers of music contents so as to definitely indicate which piece of attribute information corresponds to which music content data.

By providing music contents together with their attribute information, it becomes possible to use music content data in an effective manner based on the attribute information.

To store music content data together with corresponding attribute information on the optical disk 7 readable by the optical disk drive 16, the music content data and the attribute information may be stored in a similar manner to the optical disk 20RD shown in FIG. 8.

Figure 9:
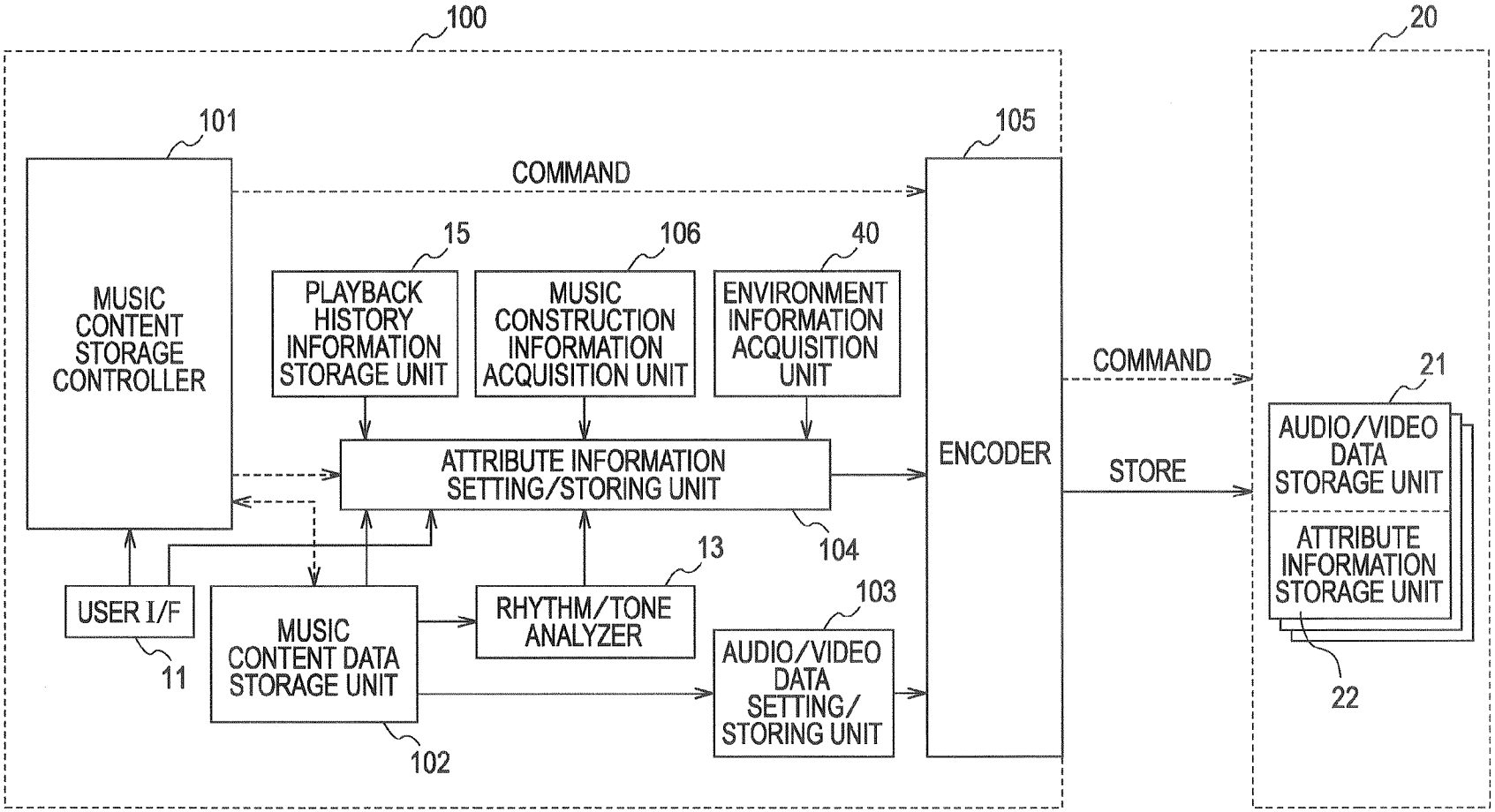
FIG. 9 is a functional block diagram illustrating a storage processing unit in the recording/playback apparatus shown in FIG. 1.
Figure 10:
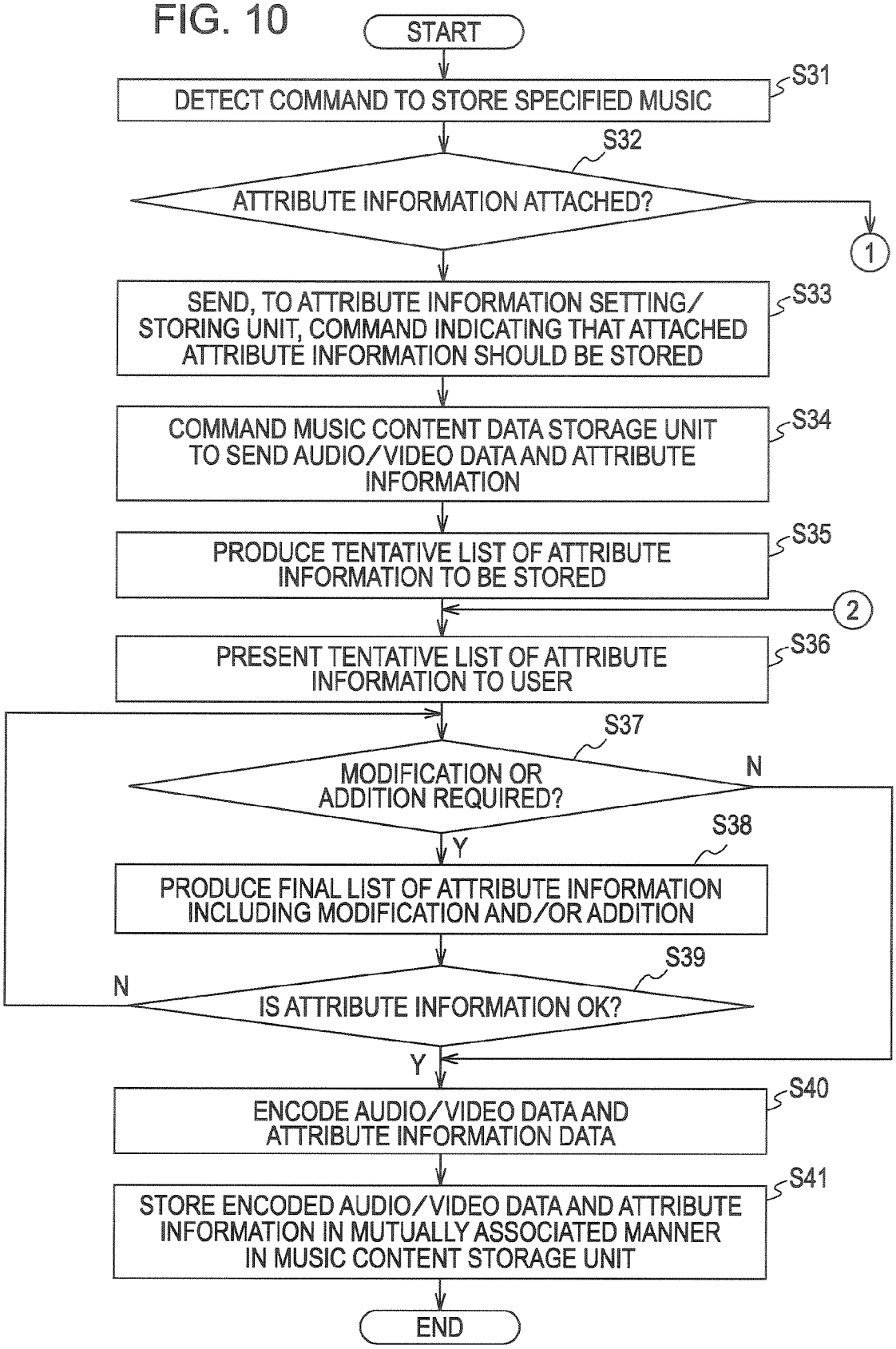
FIG. 10 is a part of a flow chart illustrating a storage process performed by the recording/playback apparatus shown in FIG. 1.
Figure 11:
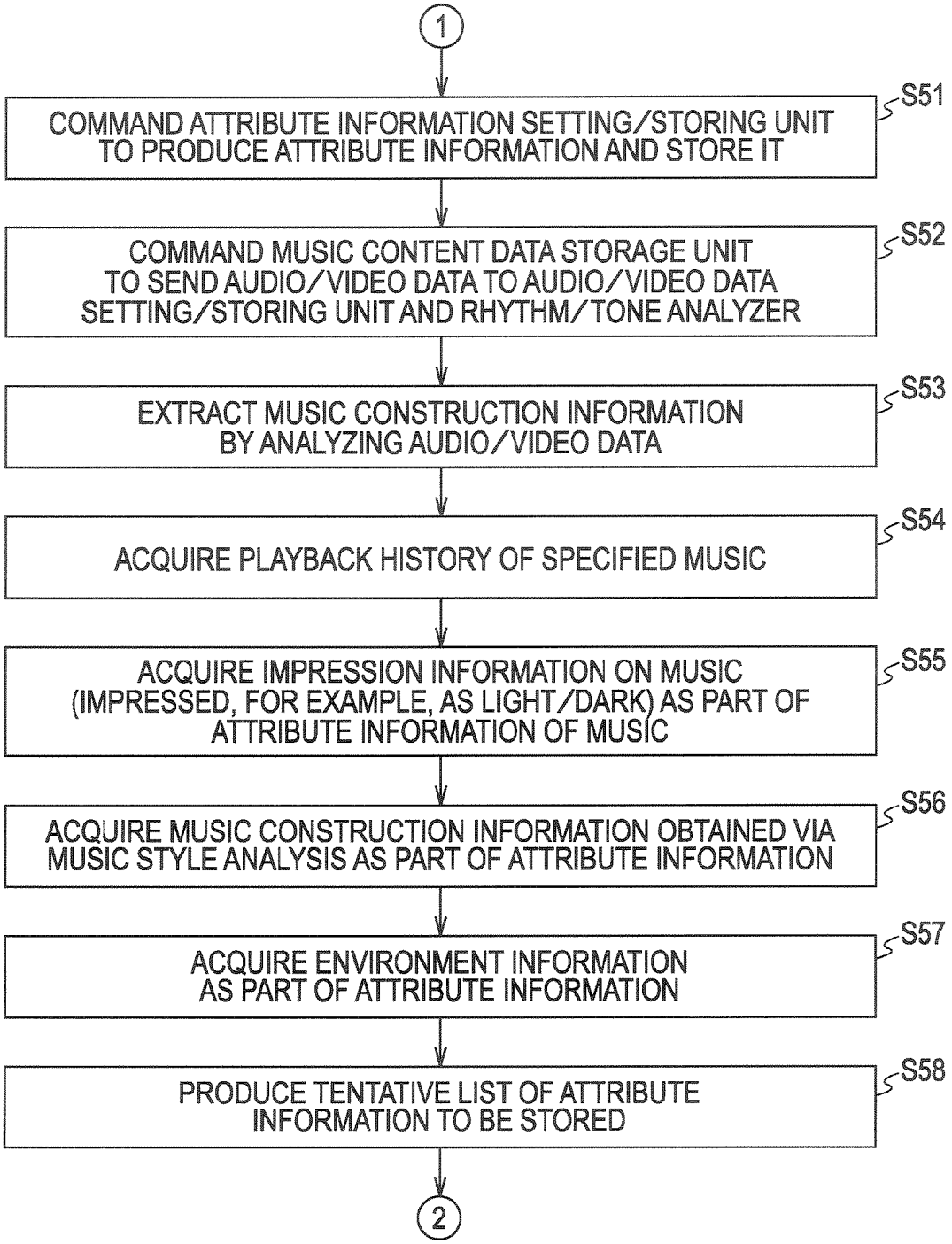
FIG. 11 is a part of the flow chart illustrating the storage process performed by the recording/playback apparatus shown in FIG. 1.

An example of a storage process performed by the recording/playback apparatus according to the first embodiment shown in FIG. 1 is described below with reference to figures. FIG. 9 is a functional block diagram illustrating parts associated with the storage process in the recording/playback apparatus according to the present embodiment. FIGS. 10 and 11 are flow charts illustrating an example of the storage process.

As shown in FIG. 9, the recording/playback apparatus includes two main functional parts associated with the storage process. One is the music content storage unit 20 in which a plurality of music contents are stored, and the other is a record processing unit 100 adapted to perform an operation of storing music contents. The music content storage unit 20 has already been described above, and thus a further description thereof is omitted herein. The record processing unit 100 is configured to store music content data and associated attribute information. The structure of the record processing unit 100 is described below.

In the present example, the record processing unit 100 stores input music content data (audio/video data) and attribute information thereof in association with each other in the music content storage unit 20. In this storage process, when attribute information associated with a music content is given via inputting, the input attribute information may be stored directly in the attribute information storage unit 22 of the music content storage unit 20, or may be stored therein after a partial modification or addition is performed.

When a music content has no attribute information originally attached thereto, the record processing unit 100 in the recording/playback apparatus may produce attribute information and store it in the attribute information storage unit 22 of the music content storage unit 20.

In the present embodiment, attribute information assigned to music content data is basically defined by a user, although a part of the attribute information may be automatically produced by the recording/playback apparatus from original audio/video data. For example, tempo information included in music construction information of the attribute information, the environment information including information indicating the location of the recording/playback apparatus, etc. may be automatically determined and added. However, in the present embodiment, the recording/playback apparatus simply acquires music construction information and environment information, and a user is expected to finally determine optimum attribute information for a music content of interest.

In the case where music content information does not have attribute information originally attached thereto, it is difficult for a user to produce arrangement information as the music content information is being stored. Thus, in this case no arrangement information is stored when the music content information is stored, but, in the present embodiment, arrangement information is stored after completion of storing the music content. More specifically, when, after the music content has been stored, a user produces arrangement information while referring to a sequential change in chords, information in terms of drums, and/or other kinds of music construction information associated with the original music stored in the attribute information storage unit 22 of the music content storage unit 20, or when the user acquires arrangement information associated with the music content via the Internet, the arrangement information is stored in association with a corresponding music ID in the attribute information storage unit 22.

As shown in FIG. 9, the record processing unit 100 includes the user interface 11, the music style/structure analyzer 13, the playback history information storage unit 15, and the environment information acquisition unit 40, which have been described above. The record processing unit 100 also has functional processing units including a music content recording controller 101, a music content data storage unit 102 an audio/video data setting/recording unit 103 an attribute information setting/recording unit 104, an encoder 105 and a music construction information acquisition unit 106.

The music content recording controller 101 is configured to control the operation of storing a music content in accordance with a command issued by a user via the user interface 11. The music content recording controller 101 is implemented by the CPU 1 by executing a storage program stored in the ROM 3 using the RAM 4 as a work area.

The music content data storage unit 102 is a part adapted to store audio/video data of a music content to be recorded. When there is attribute information associated with the music content, the attribute information is also stored in the music content data storage unit 102.

When a music content to be recorded is supplied from the optical disk 7 readable by the optical disk drive 16, the music content data storage unit 102 is implemented by the optical disk 7 and the optical disk drive 16.

In the case where a music content to be recorded is supplied from the music content providing server 6 via the Internet 5, the music content data storage unit 102 is implemented by a buffer memory or the like adapted to temporarily store music content data acquired via the communication interface 14.

The encoder 105 is an encoder part of the encoder/decoder 12.

The audio/video data setting/recording unit 103 is a part adapted to store audio/video data to be sent to the encoder 105, and is implemented by a part of the storage area of the RAM 4.

The attribute information setting/recording unit 104 is a part adapted to store attribute information data to be sent to the encoder 105, and is also implemented by a part of the storage area of the RAM 4.

The music construction information acquisition unit 106 is a functional part adapted to acquire attribute information corresponding to a music content to be recorded, when the music content data does not have attribute information attached thereto. The music construction information acquisition unit 106 is implemented, for example, by a functional part adapted to acquire attribute information associated with a music content with a music content ID by accessing the attribute information providing server via the Internet, or implemented by a functional part adapted to attribute information associated with the music content from another recording/playback apparatus.

Next, referring to flow charts shown in FIGS. 10 and 11, the storage process is described below. Note that a sequence of steps shown in FIGS. 10 and 11 is performed by the CPU 1 by executing a program stored in the ROM 3 using the RAM 4 as a work area.

Before recording is started, a user prepares music data to be recorded by storing it in the music content data storage unit 102. When attribute information is attached to the music content data, the attribute information associated with the music content is also stored in the music content data storage unit 102. The music content data storage unit 102 informs the music content recording controller 101 whether attribute information is attached to the music content to be recorded so that the music content recording controller 101 knows in advance whether the music content to be recorded has attribute information attached thereto.

Thereafter, if a user inputs a recording command via an operation unit of the user interface 11, then the music content recording controller 101 detects the command to record a specified piece of music (step S31 in FIG. 10). If the music content recording controller 101 detects this recording command, the music content recording controller 101 determines whether the specified piece of music has attribute information attached thereto (step S32). If it is determined that the specified piece of music has attribute information attached thereto, then the music content recording controller 101 sends a command to the attribute information setting/recording unit 104 to record the attribute information associated with the music content (step S33).

The music content recording controller 101 then sends a command to the music content data storage unit 102 to supply audio/video data of the specified music content stored therein to the audio/video data setting/recording unit 103, and to supply the associated attribute information to the attribute information setting/recording unit 104 (step S34). If the music content data storage unit 102 receives this command, the music content data storage unit 102 sends the audio/video data of the music content specified to be recorded together with a music content ID thereof to the audio/video data setting/recording unit 103, and the music content data storage unit 102 sends the corresponding attribute information together with the music content ID to the attribute information setting/recording unit 104.

If the attribute information setting/recording unit 104 receives the attribute information (together with the music content ID) from the music content data storage unit 102, the attribute information setting/recording unit 104 produces a tentative list of attribute information to be recorded (step S35), and presents the produced tentative list of attribute information to the user, for example, by displaying it on a display of the user interface 11 (step S36).

If the user receives the presentation of the tentative list of attribute information to be recorded, the user determines whether it is necessary to make a modification or addition to the attribute information. If the determination is affirmative, the user performs a necessary operation on the operation unit of the user interface 11. On the other hand, if it is determined that neither modification nor addition is necessary, the user notifies the music content recording controller 101 that the attribute information needs neither modification nor addition, for example, by pressing an APPLY key or the like on the user interface 11.

The music content recording controller 101 determines whether the user has issued the command to make a modification or addition to the attribute information (step S37). If it is determined that the command has been received, the music content recording controller 101 notifies the attribute information setting/recording unit 104 that the modification/addition command has been received. In response, the attribute information setting/recording unit 104 makes a modification or addition to the attribute information in accordance with the modification/addition command received via the user interface 11 (step S38). When the modification/addition of the attribute information is made, addition of arrangement information may be made.

If the user presses the APPLY key to accept the attribute information without any modification/addition or to accept the modification/addition of the attribute information, the music content recording controller 101 detects the determination by the user on the attribute information (step S39), and commands the encoder 105 to receive the audio/video data from the audio/video data setting/recording unit 103 and the attribute information from the attribute information setting/recording unit 104 and to encode the received data. In response to receiving the command, the encoder 105 receives the audio/video data and the attribute information and encodes them into formats in which they are to be recorded in the music content storage unit 20 (step S40).

The encoder 105 stores the encoded audio/video data into the audio/video data storage unit 21 and the encoded attribute information into the attribute information storage unit 22 (step S41). Thus, the storing process is completed.

On the other hand, in the case where it is determined in step S32 that the music content does not have attribute information originally attached thereto, the music content recording controller 101 sends a command to the attribute information setting/recording unit 104 to produce attribute information for the music content and record it (step S51 in FIG. 11).

The music content recording controller 101 also commands the music content data storage unit 102 to send the audio/video data of the music content to be recorded to the audio/video data setting/recording unit 103 and the music style/structure analyzer 13 (step S52). In response to receiving this command, the music content data storage unit 102 sends the audio/video data of the music content to be recorded together with the music content ID thereof to the audio/video data setting/recording unit 103, and sends the audio data of the music content to the music style/structure analyzer 13.

If the music style/structure analyzer 13 receives the audio data from the music content data storage unit 102, the music style/structure analyzer 13 analyzes the received audio data to detect the music construction information including information indicating the tempo, the key, and the chord in units of music constituent elements (step S53).

If the attribute information setting/recording unit 104 receives from the music content recording controller 101 the command indicating that attribute information should be produced, the attribute information setting/recording unit 104 determines whether a playback history of the specified music is stored in the playback history information storage unit 15. If the determination is affirmative, the attribute information setting/recording unit 104 acquires the playback history to be used as a part of the attribute information (step S54). If there is no playback history information, playback history information having a value "null" is stored in the attribute information.

If the attribute information setting/recording unit 104 receives impression information indicating levels (for example, in 16-level values) of impressions such as a cheerful/dark impression, a wild/gentle impression, a happy/sad impression, etc. input by the user via the user interface 11 for the music to be recorded, the attribute information setting/recording unit 104 adds the received impression information to the attribute information (step S55).

The attribute information setting/recording unit 104 acquires from music style/structure analyzer 13 the music construction information detected by the music style/structure analyzer 13 and adds the acquired music construction information to the attribute information (step S56). Furthermore, the attribute information setting/recording unit 104 acquires the environment information from the environment information acquisition unit 40 and adds the acquired environment information to the attribute information (step S57).

The attribute information setting/recording unit 104 then produces the tentative list of attribute information to be recorded in accordance with the information acquired via steps S54 to S57 (step S58), and presents the produced tentative list of attribute information to the user, for example, by displaying it on a display of the user interface 11 (step S36).

If the user receives the presentation of the tentative list of attribute information to be recorded, the user determines whether it is necessary to make a modification or addition to the attribute information. If the determination is affirmative, the user performs a necessary operation on the operation unit of the user interface 11. On the other hand, if it is determined that neither modification nor addition is necessary, the user notifies the music content recording controller 101 that the attribute information needs neither modification nor addition, for example, by pressing an APPLY key or the like on the user interface 11.

The music content recording controller 101 determines whether the user has issued the command to make a modification or addition to the attribute information (step S37). If it is determined that the command has been received, the music content recording controller 101 notifies the attribute information setting/recording unit 104 that the modification/addition command has been received. In response, the attribute information setting/recording unit 104 makes a modification or addition to the attribute information in accordance with the modification/addition command received via the user interface 11 (step S38).

If the user presses the APPLY key to accept the attribute information without any modification/addition or to accept the modification/addition of the attribute information, the music content recording controller 101 detects the determination by the user on the attribute information (step S39), and commands the encoder 105 to receive the audio/video data from the audio/video data setting/recording unit 103 and the attribute information from the attribute information setting/recording unit 104 and to encode the received data. In response to receiving the command, the encoder 105 receives the audio/video data and the attribute information and encode them into formats in which they are to be recorded in the music content storage unit 20 (step S40).

The encoder 105 stores the encoded audio/video data into the audio/video data storage unit 21 and the encoded attribute information into the attribute information storage unit 22 (step S41). Thus, the storage process is completed.

In the embodiment described above, when a music content does not have attached music construction information as part of attribute information, the music style/structure analyzer 13 detects the music construction information. However, if the music style/structure of the music is known from score information or from information given by a producer, then it is not necessary to perform the music style/structure analysis, but a user may input music construction information including information indicating the tempo, the key, the chord, etc. as part of the attribute information in accordance with the score information.

In a case where it is possible to acquire music construction information via a network such as the Internet 5, the attribute information setting/recording unit 104 may acquire the music construction information via the music construction information acquisition unit 106 and add the acquired the music construction information to the attribute information.

In the recording/playback apparatus according to the present embodiment, as playback of music is performed repeatedly, the playback history information for the user is accumulated in the playback history information storage unit 15. In general, music favored by the user is played back frequently, but music with a low preference level is not played frequently. Thus, the playback frequency or the total playback time for each piece of music is updated and stored in the attribute field of the music content of each piece of music.

The playback history information stored as part of the attribute information in the attribute information storage unit 22 of the music content storage unit 20 is updated not only when a music content is recorded but also when the playback history stored in the playback history information storage unit 15 is updated in response to playback of music.

In general, music with a high preference level is played back frequently, but music with a low preference level is not played frequently. Thus, it is possible to detect music favored by the listener on the basis of the playback history, and it is possible to determine that the listener likes a music style/structure of music with a high preference level. In view of the above, whenever information indicating the playback frequency or the total of playback time of any piece of music is updated, the playback history information of the music stored in the attribute information storage unit is correspondingly updated so that it is possible to determine which music or which music style is favored by a listener, on the basis of the playback history information and the music construction information included in the attribute information, and, when music is played, the music can be reconstructed depending on the preference of the listener in terms of the music style.

Playback Process Performed by Recording/Playback Apparatus According to First Embodiment A playback process performed by the recording/playback apparatus according to the first embodiment is described below. The playback process according to the present embodiment has the following features.

A first feature is that when the playback operation is started, a plurality of pieces of music evaluated as being liked by a user with high preference levels are sequentially selected and presented to the user. After a first piece of music is selected, if the user inputs a continuous playback start command via the operation unit of the user interface 11, then the recording/playback apparatus according to the present embodiment determines whether the user shows a preference to the first selected music, on the basis of the biological information acquired from the user (the listener). If the user shows some preference, the recording/playback apparatus selects a piece of music having a music style/structure similar to that of the first selected piece of music, as a candidate for being played next following the current music.

More specifically, the biological information of the user who is listening to the music is acquired, and the preference level of the listener, which may vary with time, is determined on the basis of the motion of the body such as the head or legs of the user or on the basis of the pulse rate.

If it is determined that the listener does not currently show a preference to the music being played, another piece of music expected to be liked by the listener is selected on the basis of the playback history information stored in the playback history information storage unit 15, and music having a music style/structure similar to that of the selected music is employed as a candidate for being played next following the current music. Alternatively, the environment information associated with the listener may be acquired, and music which matches the acquired environment information may be searched for on the basis of the attribute information. Pieces of music found in the searching and pieces of music having a music style/structure similar to those of music found in the searching are employed as candidates for being played next following the current music.

When a second piece of music or one of the following pieces of music is played, the preference for the music being played is continuously monitored on the basis of the biological information acquired from the listener, and the process described above is repeated to update candidates for being played next. Thus, in the present embodiment, the candidates for music to be played back are updated in real time and presented to the user.

In conventional music playback apparatuses, when as many as several hundred pieces of music data stored in an internal storage unit are played in an automatic playback mode, the playback is simply performed in units of albums or in the same order as the recording order or otherwise in a random order determined by random numbers, it is not known to control the playback order in accordance with the preference of users (listeners) for music.

It is known to produce a playlist (a list of candidates for music to be played) by a user and perform playback in an order according to the playlist. However, in this technique, the user has to produce the playlist, which is troublesome for the user. Another problem with this technique is that it is necessary to modify the playlist as the number of pieces of music stored in the internal storage unit increases. Note that even in this technique, the preference level of the user for respective pieces of music is not necessarily taken into account in the playback order.

In contrast, in the present embodiment, in accordance with the playback history information of a user, biological information detected in real time from the user, and/or geographical information indicating the location of the playback apparatus, the playback apparatus predicts preference levels for pieces of music taking into account the attribute information of music being currently played, and presents music predicted as being wanted to be listened to by the user depending on the situation.

That is, music contents are played back in such a manner that candidates for music likely to best match the current preference of the listener are dynamically selected depending on the varying condition/situation in accordance with the attribute information associated with respective pieces of music, the biological information of the listener, the playback history information, the environment information, etc., and selected pieces of music are played back.

For example, pieces of music similar in terms of sequence of chords and/or tempo to those which were listened to many times are searched for on the basis of attribute information associated with respective pieces of music stored in the attribute information storage unit 22, and detected pieces of music are played back. For example, in a case where acquired biological information indicates that a listener is relaxed by music being currently played, pieces of music which are similar in music structure to the piece of music being currently played may be searched for on the basis of the attribute information, and detected pieces of music may be played. That is, in the present embodiment, pieces of music likely to be best match the current preference of a listener are dynamically selected on the basis of the attribute information of music and selected pieces of music are presented.

In the present embodiment, as described above, the stored attribute information includes impression information indicating an impression or feeling (for example, a dark/cheerful feeling) of a listener for each piece of music, playback history information indicating how many times each piece of music was played back, information indicating a performer and/or a music instrument, environment information such as geographical information indicating the place where each piece of music was recorded or indicating a best position for listening each piece of music, etc. By effectively using these kinds of information in playback, it becomes possible to more effectively select music contents which match the preference of a user, from a large number of music contents.

A second feature of the playback process performed by the recording/playback apparatus according to the present embodiment is in its arrange mode. In the arrange mode, it is allowed to modify or reconstruct (that is, arrange) a piece of music being currently played back such that the tempo and/or the key are changed, remixing is performed, and/or a sound effect is applied, in units of music constituent elements in accordance with the attribute information, in particular, in accordance with the music construction information and/or the arrangement information.

In the present embodiment, the arrange mode may be executed in an automatic mode or a manual mode in accordance with a selection made by a user. Setting associated with the arrange mode may be performed by a user via the user interface 11, for example, by selecting a "setting" from a menu, further selecting setting of the arrange mode, and finally selecting the automatic mode or the manual mode.

In the present embodiment, when the automatic mode is selected in the arrange mode, the music content recording/playback apparatus detects biological information of a listener via the biological information acquisition unit 30 and dynamically and automatically reconstructs the music being played back depending on the feeling of the listener. For example, remixing is performed on the music data in a similar manner to that performed by a disk jockey, a plurality of pieces of music are played simultaneously, and/or the music style/structure is changed by changing, for example, the tempo and/or the key.

In the present embodiment, to achieve the dynamic reconstruction, the attribute information including the music construction information such as that described above is defined for each piece of music, and playback is performed while dynamically reconstructing or mixing music in a manner that best matches the environment/state in which the listener is. Note that the purpose of the reconstruction is to change music played back into a form which is more enjoyable for the listener. Thus, the arrangement mode according to the present embodiment provides a new manner in which users can enjoy listening to music.

Note that the reconstruction using the attribute information in the above-described manner makes it possible to arrange music without damaging the original musical quality. In general, music consists of a plurality of elements such as measures or beats, a chord is defined for each element. According to a music theory, it is possible to change the style of music without damaging the original musical quality, by mixing another musical material with original music in units of measures. This technique is widely used by disk jockeys and generally called remixing.

In the present embodiment, in view of the above, the music construction information necessary for reconstruction is defined in advance and stored as part of the attribute information in association with audio/video data of each piece of music content. As described above, the music construction information necessary for reconstruction includes information indicating the tempo, the key, and chord, the volume, the rhythm, etc. of each music constituent element.

Note that the attribute information does not necessarily need to be always attached to audio/video data of the corresponding music content, but the attribute information may be read as required from a storage area in accordance with the identification information of the music content, and may be acquired via a network from a server or the like.

Note that in the present embodiment, automatic reconstruction using the music construction information is performed not in an unreasonable manner but in a proper manner. For example, the listening state of a user is dynamically detected from the biological information fed to the playback apparatus from the user, and the environment information indicating the state of the place where the recording/playback apparatus is also dynamically detected whereby music is reconstructed according to the attribute information into a form that best matches the current situation and presented to the listener.

In the first embodiment as described below, only when a listener shows a certain preference for a current piece of music, reconstruction is performed to present the music in a form expected to more please the listener. However, even when a listener shows no interest in a current piece of music, automatic reconstruction may be performed to present the music in a form expected to be liked by the listener.

When a piece of music being played is automatically reconstructed, music to be mixed with the currently played music may be selected and/or an effect to be applied may be determined in accordance with information such as biological information of the listener fed back to the playback apparatus, the playback history information, and/or the environment information. When the attribute information includes effect information indicating a recommended effect, the recommended effect may be applied to the music being played.

In the present embodiment, when the manual mode is selected in the arrange mode, if an arrangement request command is issued by a user via the user interface 11, the music content recording/playback apparatus arranges a pieces of music by performing reconstruction such as changing of the tempo or the key (the pitch), remixing, and/or application of a sound effect in units of music constituent elements in accordance with the arrangement information and the music construction information included in the attribute information associated with the piece of music.

Figure 12:
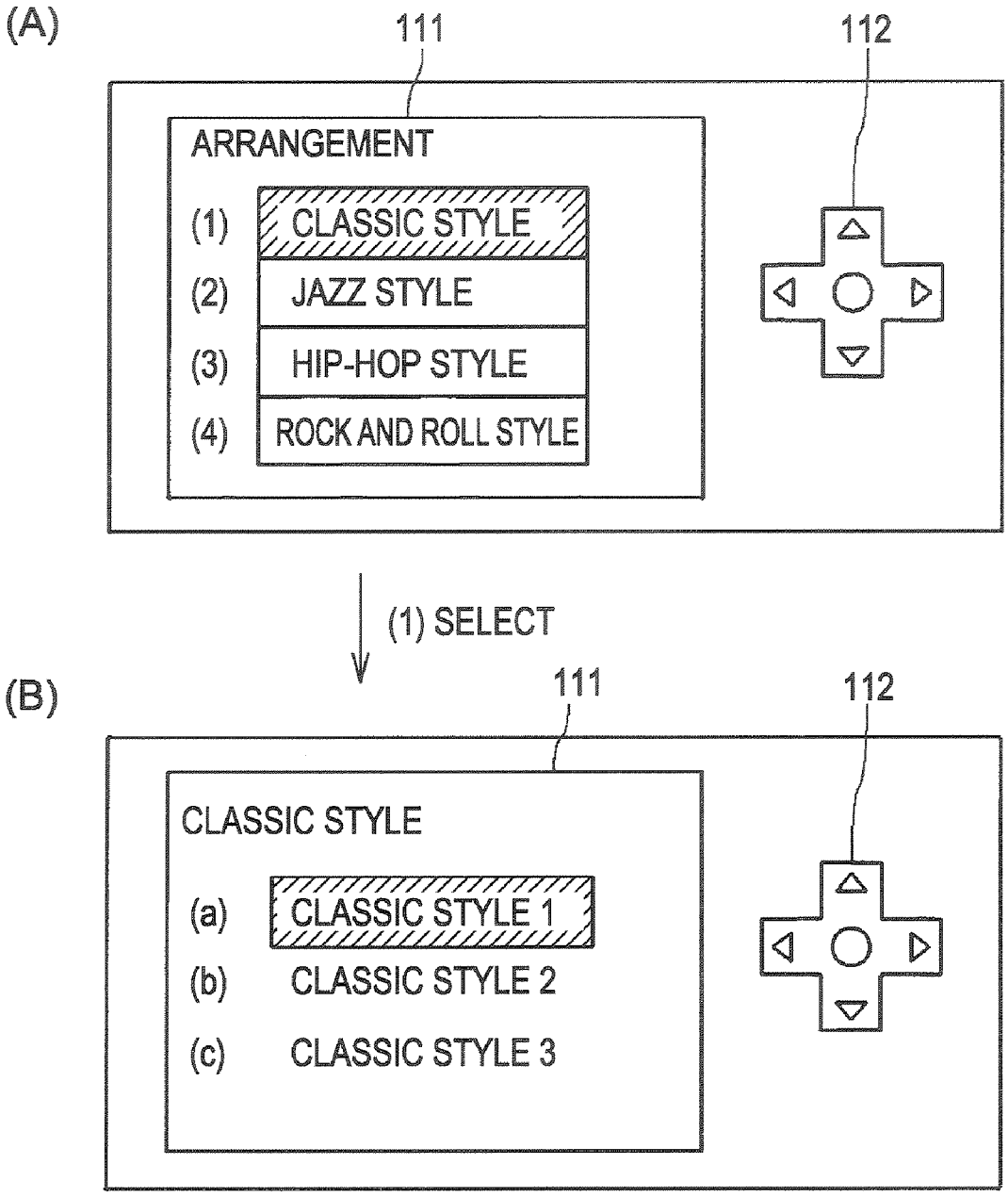
FIG. 12 is a diagram illustrating an operation of inputting an arrangement request command to the recording/playback apparatus shown in FIG. 1.

FIG. 12 illustrates an example of the user interface 11 including an LCD display screen for use in the manual mode in the arrangement mode. More specifically, FIGS. 12(A) and 12(B) illustrate an operation panel which is a part of the user interface 11 of the music content recording/playback apparatus according to the present embodiment.

When the manual mode is selected, if an arrangement mode is selected from a menu displayed on the LCD screen, the music content recording/playback apparatus according to the present embodiment extracts arrangement information (see FIGS. 2 and 3) from the attribute information associated with a piece of music being currently played, and displays a list of arrangement information extracted from the attribute information on the LCD display screen 111 as shown in FIG. 12(A).

A user selects one of arrangement information from the list of arrangement information displayed on the LCD display screen 111 by designating one of arrangement information in the list by operating a cross button 112. In this specific example shown in FIG. 12, the user operates an up-arrow part or a down-arrow part in the cross button 112 to select an item in the list. In this example, a selected item is highlighted with shading. In a state in which an item in the list is designated, if an apply button in the center of the cross button 112 is pressed, the designated item is finally selected.

As shown in FIG. 12(A), in a state in which (1) CLASSIC TYPE is designated, when the apply button is pressed, if the selected arrangement mode includes sub-arrangement modes, a list of sub-arrangement modes is displayed on the LCD display screen 111 as shown in FIG. 12(B).

The user selects a desired sub-arrangement mode from the list by using the cross button 112. If a designated arrangement mode is finally selected, corresponding arrangement information is read from the attribute information storage unit 22, and the music data is arranged in accordance with the arrangement information by performing the music reconstruction process in the above-described manner.

Figure 13:
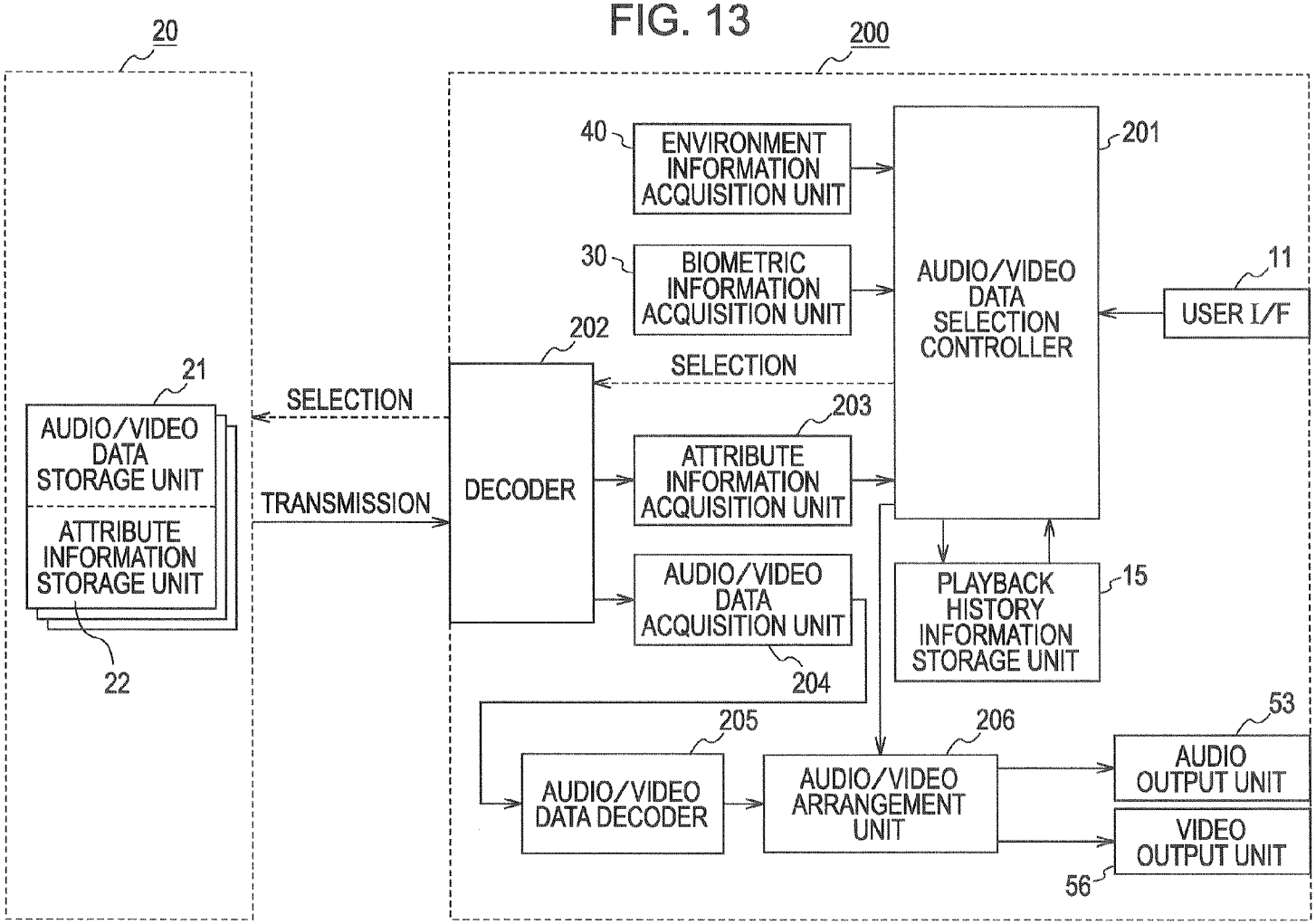
FIG. 13 is a functional block diagram illustrating a playback processing unit in the recording/playback apparatus shown in FIG. 1.

An example of the playback operation is described in further detail below with reference to figures. FIG. 13 is a functional block diagram illustrating parts associated with the playback process in the recording/playback apparatus according to the first embodiment. FIGS. 14 to 21 are diagrams for explanation of the music reconstruction process. FIGS. 22 to 25 are flow charts illustrating an example of the playback process.

As shown in FIG. 13, as with the record processing unit described above, the playback processing unit of the recording/playback apparatus according to the first embodiment includes two main parts. One is the music content storage unit 20 in which a plurality of music contents are stored, and the other is a playback unit 200 adapted to play back music contents. The music content storage unit 20 is similar to that described above, and thus the playback unit 200 is described blow.

As shown in FIG. 13, the playback unit 200 includes a user interface 11, a playback history information storage unit 15, a biological information acquisition unit 30, an environment information acquisition unit 40, an audio output unit 53, and a video output unit 56. The playback unit 200 also includes functional processing units implemented by performing a process by the CPU 1 according to a program stored in the ROM 3. They are an audio/video data selection controller 201, a decoding unit 202, an attribute information acquisition unit 203, an audio/video data acquisition unit 204, an audio/video data decoder 205, and an audio/video arrangement processing unit 206.

The audio/video data selection controller 201 performs various processes including selecting a music content to be played in accordance with a command issued by a user via the user interface 11, controlling the process of playing the selected music content (including the music reconstruction process in the automatic arrangement mode or the music reconstruction process in the manual arrangement mode in accordance with a command issued by a user), selecting a music content to be played in accordance with the playback history information supplied from the playback history information storage unit 15, the biological information acquired via the biological information acquisition unit 30, the environment information acquired via the environment information acquisition unit 40, etc., and controlling the process of the selected music content (including the music reconstruction process). The audio/video data selection controller 201 is implemented by the CPU 1 by executing a storage program stored in the ROM 3 using the RAM 4 as a work area.

The decoding unit 202 acquires audio/video data and attribute information from the music content storage unit 20 in accordance with a music content selection command supplied from the audio/video data selection controller 201, and decodes the received compressed data into a decompressed form. Note that the decoding unit 202 is a decoder part of the encoder/decoder 12.

More specifically, the decoding unit 202 decodes the attribute information read from the music content storage unit 20 into a decompressed form and supplies the resultant attribute information to the attribute information acquisition unit 203. The decoding unit 202 also decodes the audio/video data read from the music content storage unit 20 into a decompressed form and supplies the resultant audio/video data to the audio/video data acquisition unit 204.

The attribute information acquisition unit 203 receives from the decoding unit 202 the attribute information read from the music content storage unit 20 and decoded by the decoding unit 202, and transfers it to the audio/video data selection controller 201. The attribute information acquisition unit 203 is implemented by a buffer realized using a part of the storage area of the RAM 4.

The audio/video data acquisition unit 204 receives from the decoding unit 202 the audio/video data read from the music content storage unit 20 and decoded by the decoding unit 202, and transfers it to the audio/video data decoder 205. The audio/video data acquisition unit 204 is implemented by a buffer realized using a part of the storage area of the RAM 4.

The audio/video data decoder 205 includes an audio data decoder 51 and a video data decoder 54, and is configured to decode audio data and video data and supplies the resultant audio data and video data to the audio/video arrangement processing unit 206 and the audio/video arrangement processing unit 206, respectively.

The audio/video arrangement processing unit 206 includes an audio arrangement unit 52 and a video arrangement unit 55, and is configured to perform the following processes, i.e., remixing audio data of another piece of music with the decoded audio data in accordance with a control signal supplied from the audio/video data selection controller 201, reconstructing a piece of music by applying an effect to the audio data of the music or by changing the tempo, the key, and/or the sequence of chords, applying an effect to the decoded video data, etc.

After the process such as the remixing or the application of the effect is performed by the audio/video arrangement processing unit 206, the resultant audio data is supplied to the audio output unit 53, while the resultant video data is supplied to the video output unit 56.

The biological information of a listener acquired by the biological information acquisition unit 30 is supplied to the audio/video data selection controller 201 and is used in selection and reconstruction of music contents. The environment information including information indicating the location of the recording/playback apparatus is acquired by the environment information acquisition unit 40 is supplied to the audio/video data selection controller 201, for use in selection of music contents and reconstruction of music.

If the playback history information storage unit 15 receives a read request from the audio/video data selection controller 201, the playback history information storage unit 15 supplies the playback history information stored therein to the audio/video data selection controller 201. The playback history information is used by the audio/video data selection controller 201 in selection of music contents and reconstruction of music.

Figure 14:
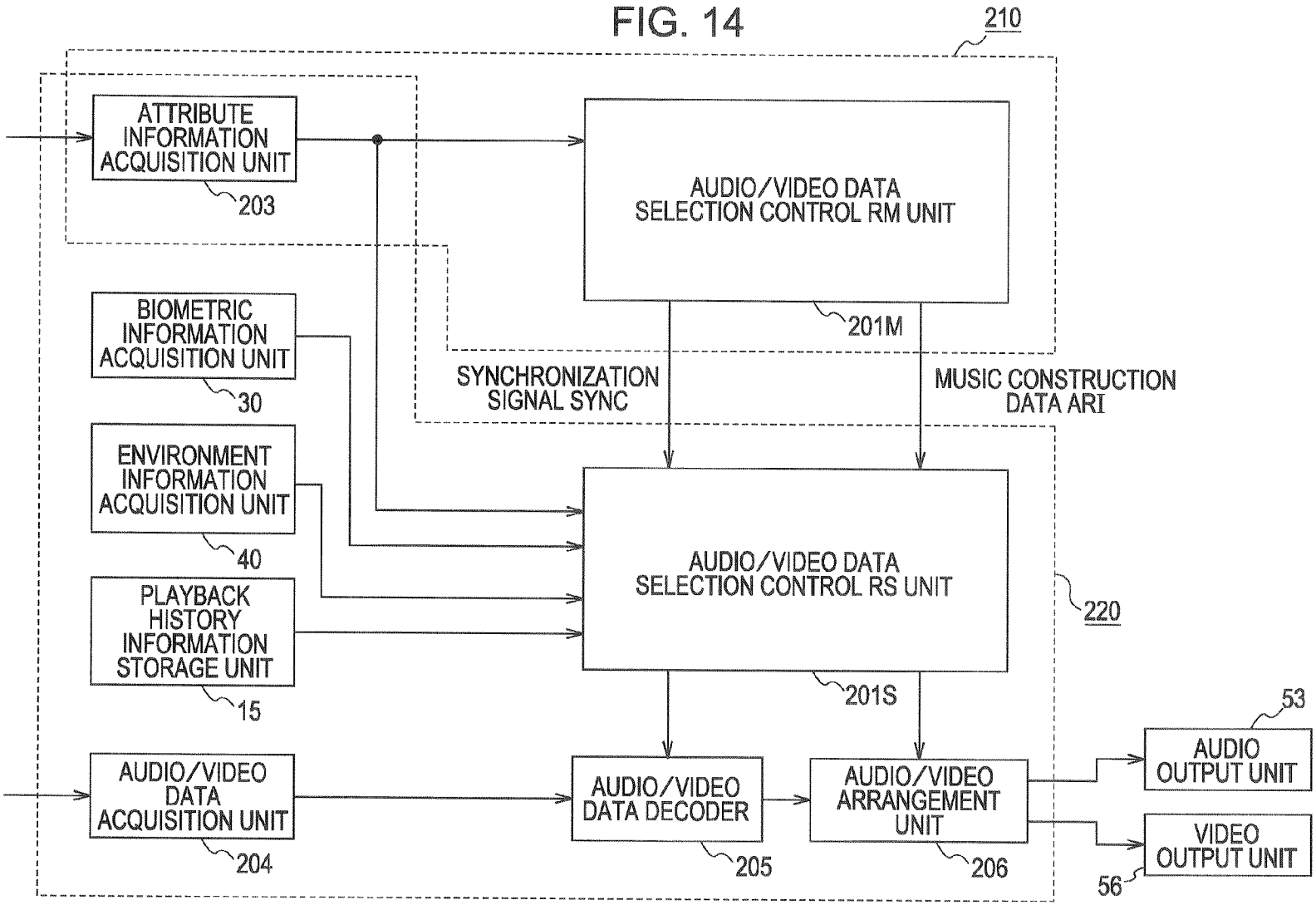
FIG. 14 is a functional block diagram illustrating main parts of the recording/playback apparatus shown in FIG. 1.

FIG. 14 illustrates functional blocks of the playback unit 200 shown in FIG. 13, expressed from the view point of the process of reconstructing music. Note that the structure shown in FIG. 14 is essentially the same as that shown in FIG. 13, although they are seen from different point of views.

As shown in FIG. 14, the playback unit 200 includes a master rhythm unit 210 and a slave rhythm unit 220. The master rhythm unit 210 is adapted to generate a synchronization signal and music reconstruction information according to which to reconstruct music data, and output them. The slave rhythm unit 220 is adapted to reconstruct music data in accordance with a synchronization signal SYNC and music reconstruction information ARI supplied from the master rhythm unit 210. The master rhythm unit 210 outputs the synchronization signal SYNC in synchronization with the playback of the music data. The music reconstruction information ARI is output in synchronization with the synchronization signal SYNC and the music reconstruction information ARI has values dynamically varying in synchronization with the playback of the music data.

The master rhythm unit 210 has a function corresponding to a conductor in a concert, while slave rhythm unit 220 has a function corresponding to a player.

The audio/video data selection controller 201 has two main parts. One is an audio/video data selection control unit RM (RM is an abbreviation for Rhythm Master) 201M belonging to the master rhythm unit 210. The other is an audio/video data selection control unit RS (RS is an abbreviation for Rhythm Slave) 201S belonging to the slave rhythm unit 220. Note that the attribute information acquisition unit 203 belong to both the master rhythm unit 210 and the slave rhythm unit 220.

That is, the master rhythm unit 210 includes the audio/video data selection control RM unit (hereinafter, referred to simply as the RM unit) 201M and the attribute information acquisition unit 203.

In addition to the audio/video data selection control RS unit (hereinafter, referred to simply as the RS unit) 201S and the attribute information acquisition unit 203, the slave rhythm unit 220 also includes the biological information acquisition unit 30, the environment information acquisition unit 40, the playback history information storage unit 15, the audio/video data acquisition unit 204, the audio/video data decoder 205, and the audio/video arrangement processing unit 206.

In this first embodiment, the RM unit 201M of the master rhythm unit 210 produces a synchronization signal SYNC and music construction data ARI, which are used in reconstruction of music, in accordance with the attribute information of a music content being currently played and acquired by the attribute information acquisition unit 203. The produced synchronization signal SYNC and the music reconstruction data ARI are supplied to the RS unit 201S of the slave rhythm unit 220.

Figure 15:
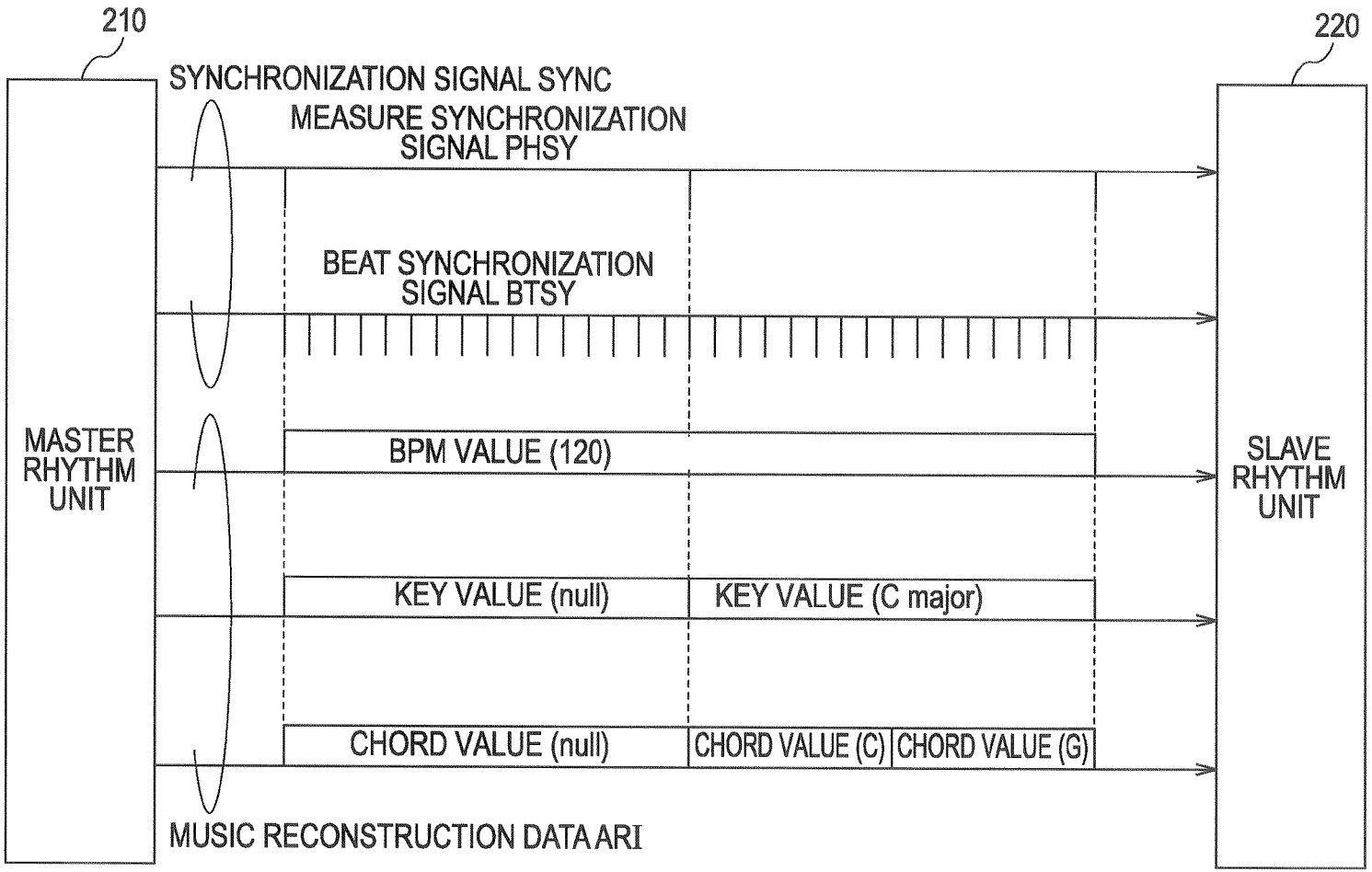
FIG. 15 is a diagram associated with the functional block diagram shown in FIG. 14.

In the present embodiment, the synchronization signal SYNC including a measure synchronization signal PHSY corresponding to measures of music and a beat synchronization signal BTSY with a period corresponding to a beat period of music is produced and output, as shown in FIG. 15. More specifically, in this first embodiment, the RM unit 201M generates signals in synchronization with measures and beats of the music being played.

The measure synchronization signal PHSY is a signal indicating the start of each measure of the music. For example, the measure synchronization signal PHSY is in the form of edge pulses falling down at the start of each measure of the music. The beat synchronization signal BTSY is a signal indicating the start of each beat of the music. For example, the beat synchronization signal BTSY is in the form of edge pulses falling down at the start of each beat. Note that the number of beats per measure varies depending on the rhythm of the music.

In synchronization with the signals described above, the master rhythm unit 210 sends music reconstruction data ARI to the slave rhythm unit 220. The music reconstruction data ARI is mufti-level data and is transmitted via a plurality of bit signal lines such as a data bus.

In this first embodiment, as shown in FIG. 15, the music reconstruction data ARI produced by the RM unit 201M includes a BPM value, a key value, and a chord value as music construction information. These three values are supplied to the RS unit 201S of the slave rhythm unit 220. The data of these three values may be transmitted via a plurality of bit signal lines or may be transmitted in the form of serial data via a single signal line.

In the slave rhythm unit 220, the BPM value is used as a master tempo value indicating the tempo at which music should be played. Note that the BPM value corresponds to the oscillation frequency of the synchronization signal SYNC.

The key value is a value according to which the key of a music content to be played is determined. When no particular key is specified, the key value may have a "null" value. When the key value included in the music reconstruction data ARI is "null", the slave rhythm unit 220 plays the specified music in an arbitrarily selected key.

The chord value is a value that determines a sequential change of chords in the music content to be played. The slave rhythm unit 220 may play the specified music in a specified chord value, or in an alternative chord as along as the tonality of the music according to the music theory is maintained. The chord value may be set to "null". When the chord value included in the music reconstruction data ARI is "null", the slave rhythm unit 220 plays the specified music in an arbitrarily selected chord.

In this first embodiment, the BPM value, the key value, and the chord value extracted from the attribute information of music being played are directly supplied from the RM unit 201M to the music reconstruction information ARI.

Figure 16:
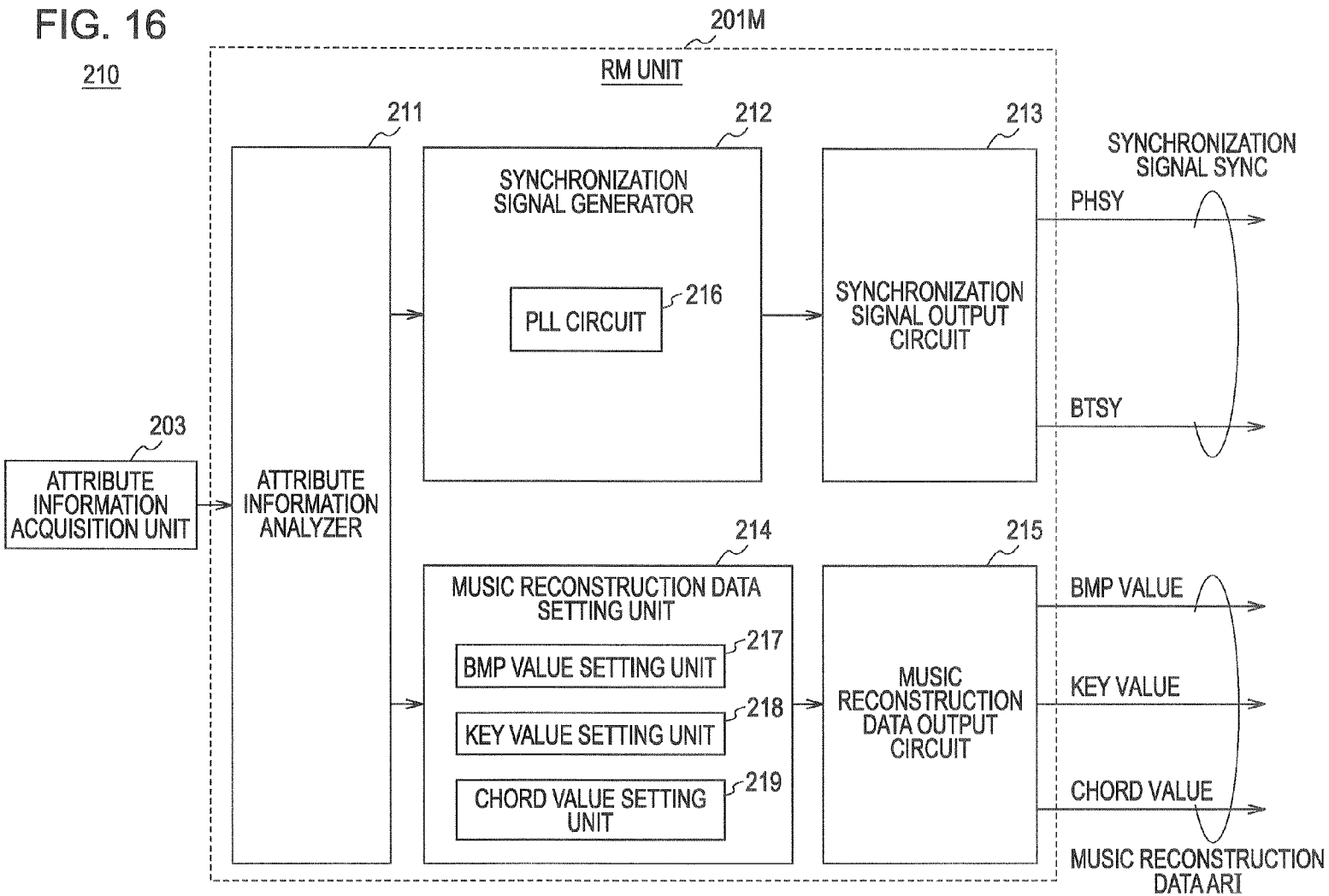
FIG. 16 is a functional block diagram illustrating details of a part of the functional block diagram shown in FIG. 14.

FIG. 16 is a block diagram illustrating details of the master rhythm unit 210 according to the first embodiment. In this figure, in particular, details of functions of the RM unit 201M are shown. As shown in FIG. 16, functional blocks of the RM unit 201M include an attribute information analysis unit 211 a synchronization signal generator 212, a synchronization signal output circuit 213, a music reconstruction data setting unit 214, and a music reconstruction data output circuit 215.

In the RM unit 201M, the attribute information analysis unit 211 receives from the attribute information acquisition unit 203 attribute information associated with music which is being played and which is to be reconstructed, and analyzes it to extract music construction information from the attribute information associated with the music being played. Of a plurality of pieces of information included in the extracted music construction information, the BPM value functioning as the tempo information indicating boundaries of measures or beats is supplied to the synchronization signal generator 212.

The synchronization signal generator 212 includes a PLL (Phase Locked Loop) circuit 216 which oscillates at a frequency corresponding to the BPM value supplied from the attribute information analysis unit 211. Using this PLL circuit 216, the synchronization signal SYNC including the measure synchronization signal PHSY synchronous with measures of the music content being played and the beat synchronization signal BTSY synchronous with beats is generated and supplied to the RS unit 201S via the synchronization signal output circuit 213 as shown in FIG. 15.

If the attribute information analysis unit 211 in the RM unit 201M receives the attribute information associated with the music being played, the attribute information analysis unit 211 extracts the BPM value, the key value, and the chord value included in the music construction information of the attribute information, and supplies the extracted value to the music reconstruction data setting unit 214.

In the music reconstruction data setting unit 214, the received BPM value is set in the BPM value setting unit 217, the key value is set in the key value setting unit 218, and the chord value is set in the chord value setting unit 219. The BPM value, the key value, and the chord value respectively set in the BPM value setting unit 217, the key value setting unit 218, and the chord value setting unit 219 are transferred from the music reconstruction data setting unit 214 to the music reconstruction data output circuit 215 and further transferred from the music reconstruction data output circuit 215, as the music reconstruction data ARI, to the RS unit 201S as shown in FIG. 15.

The RM unit 201M generates in real time the synchronization signal SYNC and the music reconstruction data ARI in synchronization with the playback of the music data of the music content in accordance with the attribute information supplied from the attribute information acquisition unit 203, and supplies the generated synchronization signal SYNC and the music reconstruction data ARI to the RS unit in the slave rhythm unit 220.

Figure 17:
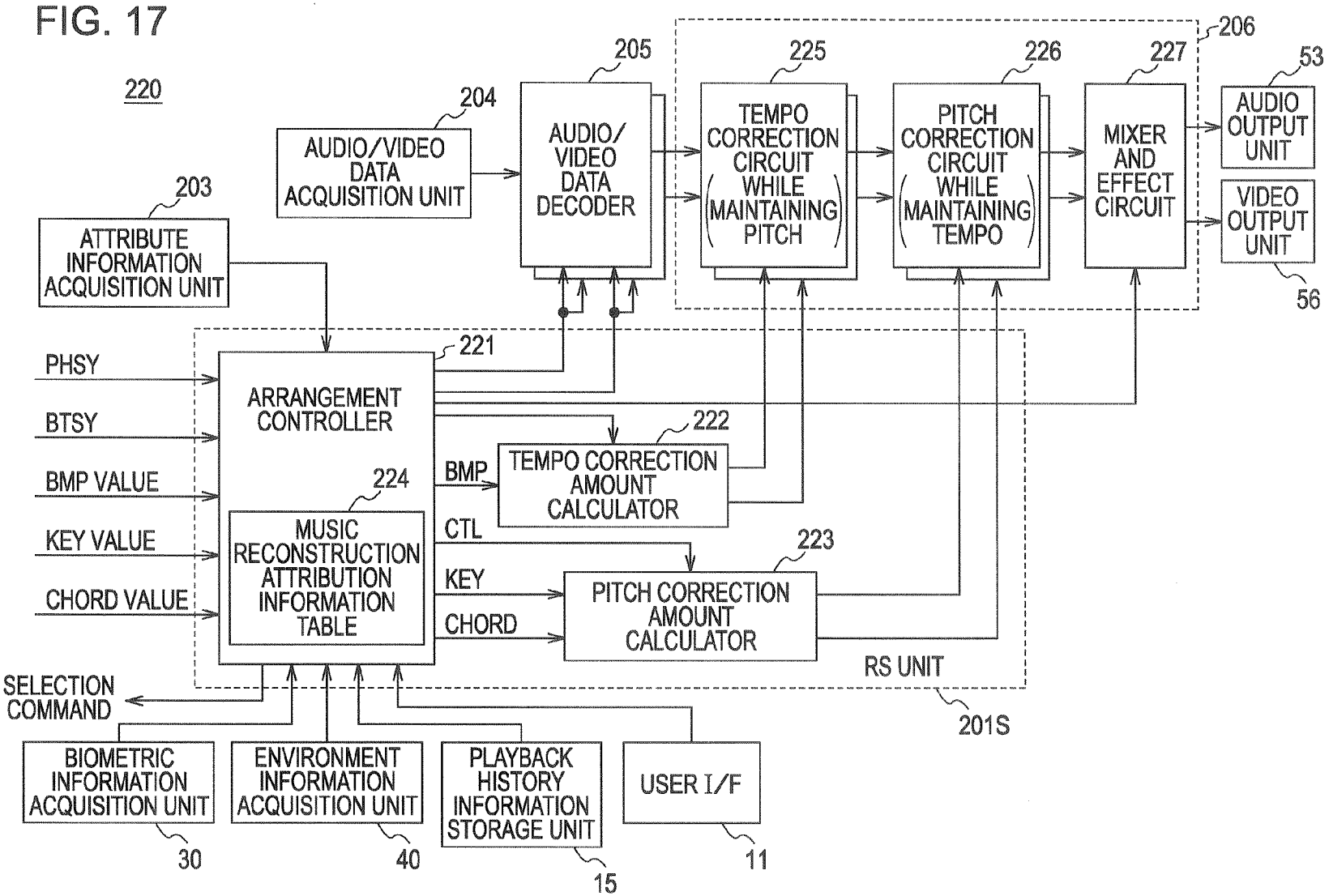
FIG. 17 is a functional block diagram illustrating details of a part of the functional block diagram shown in FIG. 14.

FIG. 17 illustrates details of the slave rhythm unit 220 according to the first embodiment. As shown in FIG. 17, functional blocks of the RS unit 201S of the slave rhythm unit 220 include an arrangement control unit 221, a tempo correction amount calculation unit 222, and a pitch correction amount calculation unit 223. The audio/video arrangement processing unit 206 in the slave rhythm unit 220 includes a tempo correction circuit 225, a pitch correction circuit 226, a mixer, and an effect circuit 227.

The arrangement control unit 221 acquires in advance the attribute information of all music contents from the attribute information storage unit 22 of the music content storage unit 20 via the attribute information acquisition unit 203, and the arrangement control unit 221 produces a music reconstruction attribute information table 224 from the acquired attribute information and stores it. In the music reconstruction attribute information table 224, music reconstruction attribute information is described which is used to automatically arrange music in accordance with the biological information, the environment information, and the playback history information. Furthermore, music reconstruction attribute information which is produced from arrangement information included in the attribute information and which is used in music reconstruction in accordance with an arrangement request command issued by a user is also described in the music reconstruction attribute information table 224. The latter music reconstruction attribute information is information according to which to arrange music into a music style (such as the classic style, the pop style, the rock and role style, the soul style, the ballad style, etc.) specified by a user, as described above.

FIG. 18 illustrates an example of part of the music reconstruction attribute information table 224. In the example shown in FIG. 18, by way of example, the music reconstruction attribute information table 224 is in the form of an attribute information table for use in remixing performed as the reconstruction process according to the present embodiment. As shown in FIG. 18, the music reconstruction attribute information table 224 includes fields in which chord values, BPM values, instrument names, and impression values are described for respective musical materials. Although in the present example, the impression value is defined only in terms of a cheerful impression, the impression value may be defined for other kinds of impressions.

When remixing is performed as the arrangement of music, the arrangement control unit 221 searches the music reconstruction attribute information table 224 to detect musical materials having BPM values and chord values equal or close to those described in the music reconstruction data ARI received from the RM unit 201M, for respective musical instruments to be remixed.

The arrangement control unit 221 determines whether a listener likes a cheerful feeling, on the basis of the biological information supplied from the biological information acquisition unit 30, the environment information supplied from the environment information acquisition unit 40, and the playback history information supplied from the playback history information storage unit 15, and the arrangement control unit 221 selects music materials to be remixed in accordance with the impression values described in the music reconstruction attribute information table.

In a case where the arrangement control unit 221 receives an arrangement request command issued by a user via the user interface 11, if remixing is needed as the arrangement process, the arrangement control unit 221 determines musical materials to be remixed, in accordance with the arrangement information.

The arrangement control unit 221 then sends a selection command to the decoding unit 202 to read audio data of the determined music materials from the music content storage unit 20.

In accordance with the received command, the decoding unit 202 reads the audio data of the specified musical materials from the music content storage unit 20, and transfers the audio data of the music materials for use in the remixing, together with an audio/video data, which has already been read, to the audio/video data acquisition unit 204.

Thus, in addition to the audio/video data to be played, the audio/video data acquisition unit 204 supplies audio data of one or more music materials for use in the remixing to the audio/video data decoder 205.

Accordingly, the audio/video data decoder 205 and the audio/video arrangement processing unit 206 process a plurality of pieces of audio/video data in parallel. More specifically, as shown in FIG. 17, as many audio/video data decoders 205 and as many tempo correction circuits 225 and pitch correction circuits 226 in the audio/video arrangement processing unit 206 are provided as needed to process the plurality of pieces of audio/video data in parallel (in the example shown in FIG. 17, two sets of these units are provided).

Figure 19:
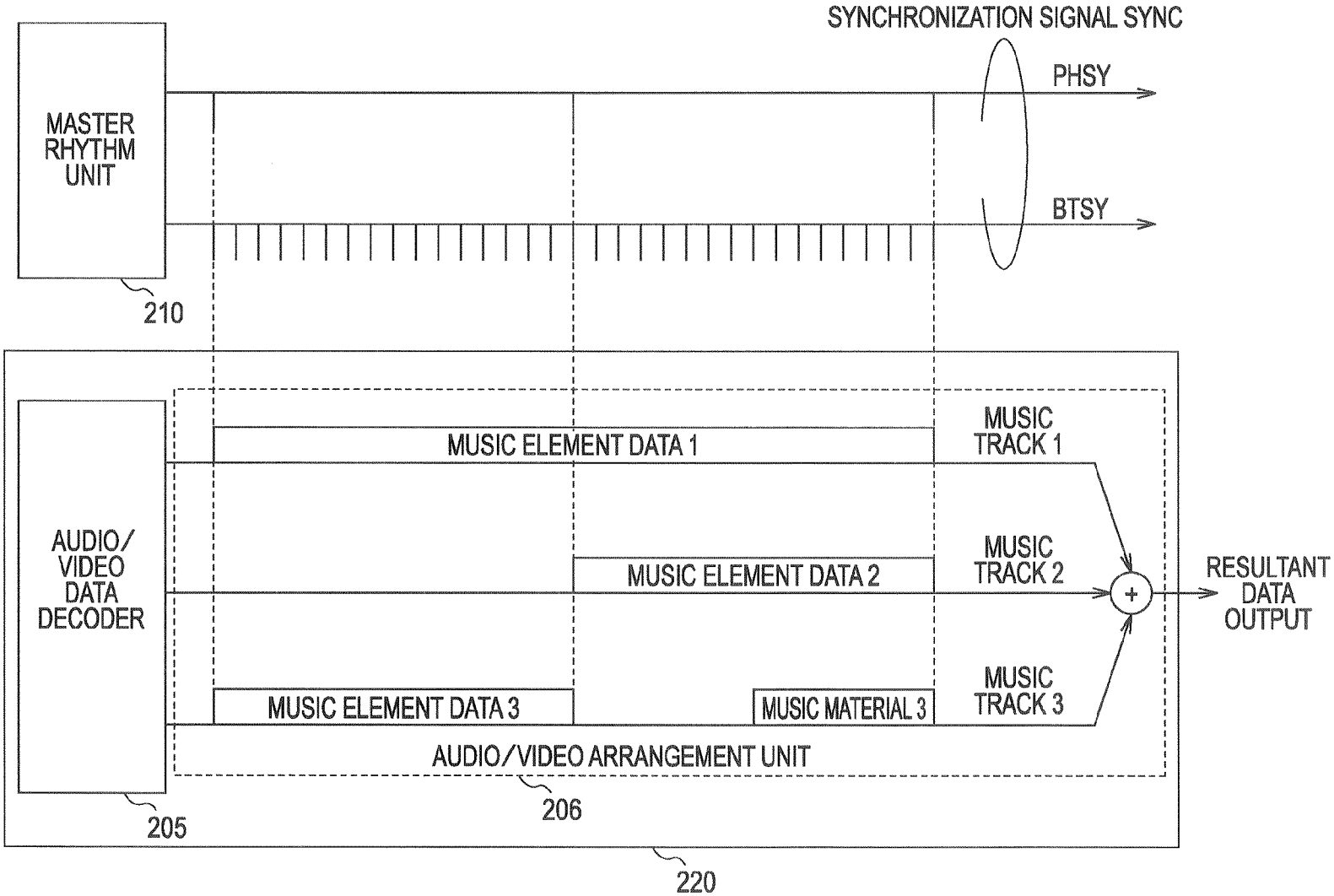
FIG. 19 is a timing chart associated with the functional block diagram shown in FIG. 14.

FIG. 19 illustrates music signals which are transmitted in the audio/video data decoder 205 and the audio/video arrangement processing unit 206 in the slave rhythm unit 220 in synchronization with the synchronization signal SYNC supplied from the master rhythm unit 210. Hereinafter, each stream of playback signal of music data (audio data) is referred to as a music track. In the slave rhythm unit 220, as described above, a plurality of music tracks are processed in parallel in terms of the tempo correction, the pitch correction, as required, and finally mixed together by the mixer and the effect circuit 227.

In the example shown in FIG. 19, three music tracks output from the audio/video data decoder 205 are played in synchronization with the synchronization signal SYNC output from the master rhythm unit 210 and mixed together at the final stage. In this example, a track 1 is a track of music data of an original music content to be played back, and a track 2 and a tack 3 are tracks of music materials to be remixed.

Note that it is not necessarily required that musical materials to be remixed be provided over all measures, but they may be provided intermittently only for particular measures or beats, as is the case with the track 2 and the track 3 shown in FIG. 19.

In a case where only a sound effect is applied to music data of a music content to be played without performing remixing, there is provided only a stream of the music data of the music content to be played, and the mixer and the effect circuit 227 perform the sound effect processing to apply, for example, a reverb or distortion, to the music data of the music content to be played.

The tempo correction amount calculation unit 222 calculates the tempo correction amount to be applied to the musical materials to be mixed with the music being currently played, from the difference between the BPM value acquired from the attribute information acquisition unit 203 and the BPM value (the target BPM value) included in the music reconstruction data ARI supplied from the master rhythm unit 210. This correction is needed because the BPM values of given musical materials, which have proper key values and chord values and which are desirable to be mixed with the music data being played, are not necessarily always equal to the target BPM value, and thus it is required to correct the BPM value to the target BPM value.

The tempo correction amount calculation unit 222 supplies the calculated tempo correction amount to a processing circuit, responsible for processing a corresponding musical material, in the tempo correction circuit 225.

The tempo correction circuit 225 is a circuit adapted to correct only the playback tempo of the given audio data while maintaining the original pitch. Various correction algorithms for the above purpose are known. For example, it is known to make the correction using a correlation function. The correction algorithm is not essential to the present embodiment, and thus a further explanation thereof is omitted herein.

The pitch correction amount calculation unit 223 calculates the pitch correction amount for each musical material to be mixed with the music data being currently played, from the difference between the key/chord value acquired from the attribute information acquisition unit 203 and the key/chord value (the target key/chord value) included in the music reconstruction data ARI supplied from the master rhythm unit 210. This correction is needed because the key values or the chord values of musical materials desired to be mixed with the piece of music being currently played are not necessarily equal to the target key value or the target chord value, and thus it is required to correct the key values or the chord values to the target value.

The pitch correction amount calculation unit 223 supplies the calculated pitch correction amount to a processing circuit, responsible for processing a corresponding musical material, in the pitch correction circuit 226.

The pitch correction circuit 226 is a circuit adapted to correct only the pitch of the given audio data while maintaining the tempo. Various correction algorithms for the above purpose are known. The correction algorithm is not essential to the present embodiment, and thus a further explanation thereof is omitted herein.

The mixer/effect circuit 227 operates in accordance with a mixing control signal and an effect control signal supplied from the arrangement control unit 221 to apply an effect to audio/video data supplied from the pitch correction circuit 226 and mix a plurality of pieces of audio/video data supplied from the pitch correction circuit 226. Note that the effect is applied in various ways depending on the effect control signal supplied from the arrangement control unit 221.

Figure 20:
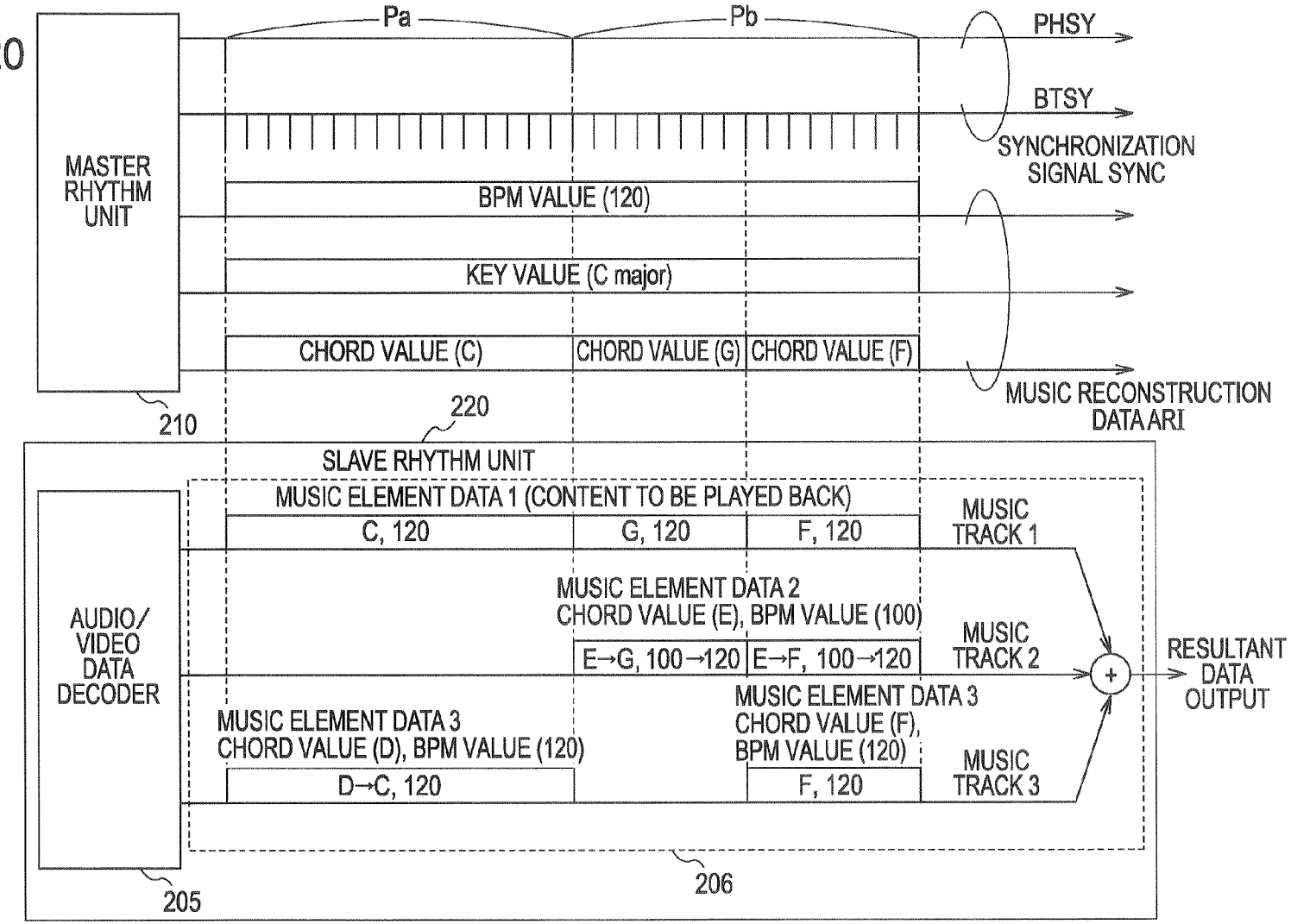
FIG. 20 is a timing chart associated with the functional block diagram shown in FIG. 14.
Figure 21:
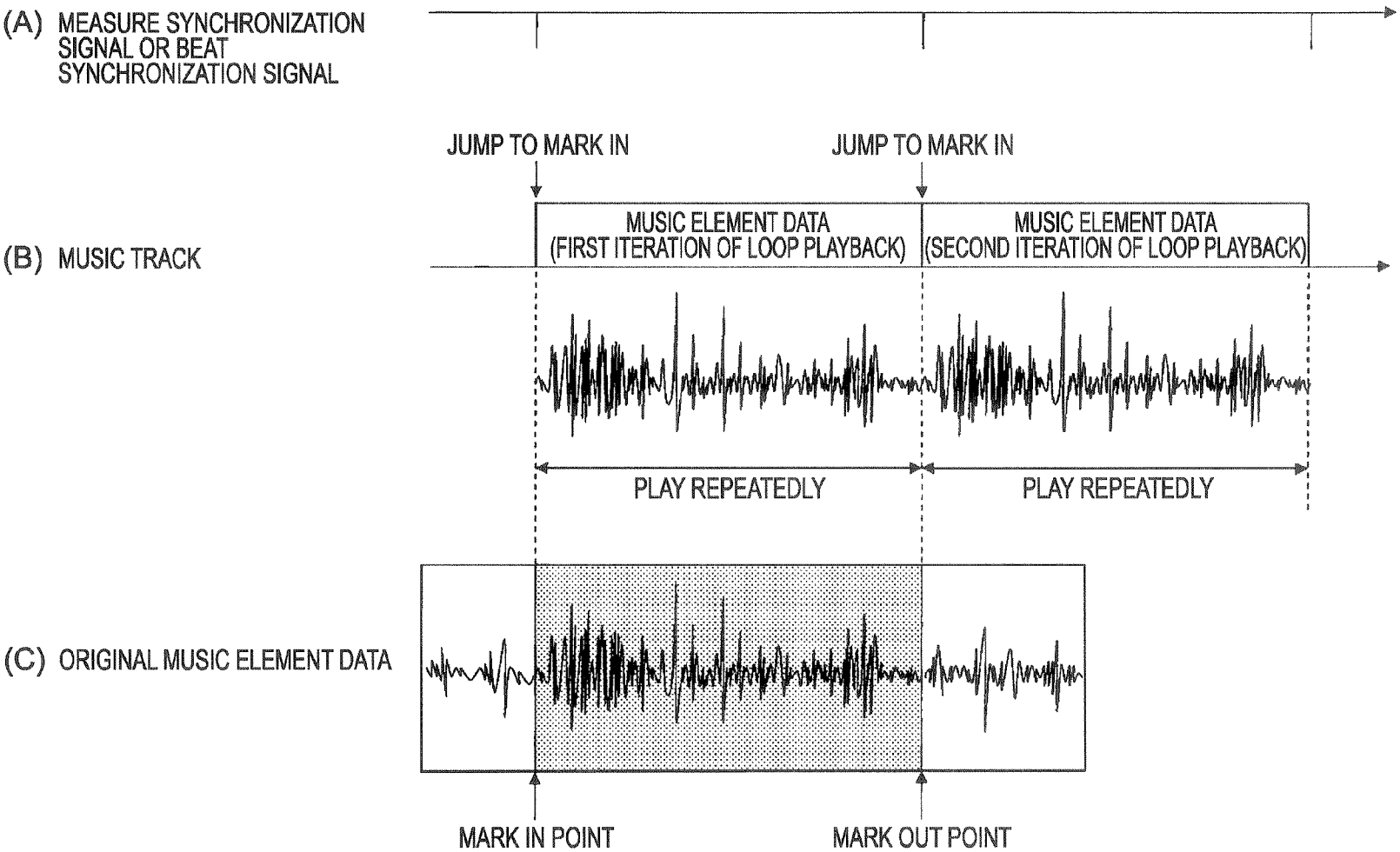
FIG. 21 is a diagram for an explanation of the functional block diagram shown in FIG. 14.

FIG. 20 illustrates music signals which are transmitted, in synchronization with a synchronization signal SYNC output from the master rhythm unit 210, in the audio/video data decoder 205 and the audio/video arrangement processing unit 206 in the slave rhythm unit 220 during a music data reconstruction process performed by the audio/video arrangement processing unit 206 in the slave rhythm unit 220 in accordance with music reconstruction data ARI output from the master rhythm unit 210.

In the example shown in FIG. 20, the music reconstruction data ARI is extracted from the attribute information associated with the music content to be played, and the music content to be played is given in the form of a playback signal stream in a music track 1. In the example shown in FIG. 20, the music reconstruction data ARI indicating the target BPM value "120", the target key value "C major", and the sequence of target chord values "C"→"G"→"F" is input to the slave rhythm unit 220 from the master rhythm unit 210.

The slave rhythm unit 220 processes the playback signal stream of the music content in the music track 1 in accordance with the selection command supplied from the arrangement control unit 221 such that two musical material data in music tracks 2 and 3 acquired from the music content storage unit 20 and output from the audio/video data decoder 205 are corrected so as to be equal to the target values specified by the music reconstruction data ARI, and then data in music tracks 1, 2, and 3 are mixed together.

More specifically, in the audio/video arrangement processing unit 206, the audio data in music tracks 2 and 3 are corrected so as to be consistent with the target BPM value and the target chord value specified by the music reconstruction data ARI, and mixed with the music data in music track 1.

In the example shown in FIG. 20, in a measure period Pa, the musical material data 3 in the music track 3 is mixed with the audio data in the music track 1. Note that in the measure period Pa, the BPM value of the music material data 3 acquired via the attribute information acquisition unit 203 is "120" which is equal to the target BPM value specified by the music reconstruction data ARI, and thus the audio/video arrangement processing unit 206 does not correct the tempo of the musical material data 3 in this measure period Pa.

On the other hand, in the measure period Pa, the chord value of the musical material data 3 acquired via the attribute information acquisition unit 203 is "D" which is different from the chord value "C" specified as the target value in the music reconstruction data ARI, and thus the musical material data 3 is corrected in terms of the pitch by the pitch correction circuit 226 of the audio/video arrangement processing unit 206 such that the chord values is changed from "D" to the target chord value "C".

In the first half of the next measure period Pb, the musical material data 2 in the music track 2 is mixed with the audio data in the music track 1. In the second half of the measure period Pb, the musical material data 2 in the music track 2 and the musical material data 3 in the music track 3 are mixed with the music data in the music track 1.

In the above process, in the first half of the measure period Pb, the BPM value of the musical material data 2 acquired by the attribute information acquisition unit 203 is "100" and the chord value is "E" which are different from the target BPM value "120" and the target chord value "G" specified in the music reconstruction data ARI. Therefore, in the first half of the measure period Pb, the audio/video arrangement processing unit 206 corrects the BPM value of the musical material data 2 from "100" to the target value "120" thereby correcting the tempo, and the audio/video arrangement processing unit 206 corrects the pitch so that the chord is corrected from "E" to the target chord value "G". In the second half of the measure period Pb, the corrected musical material data 2 is added to the music data in the music track 1.

In the second half of the measure period Pb, the musical material data 2 is "100" in the BPM value and "E" in the chord value which are different from the target BPM value "120" and the target chord value "F" specified in the music reconstruction data ARI, while the musical material data 3 is "120" in the BPM value and "F" in the chord value which are the same as the target BPM value "120" and the target chord value "F" specified in the music reconstruction data ARI.

Thus, in the second half of the measure period Pb, the musical material data 2 in the music track 2 is corrected in terms of the tempo and the pitch by the audio/video arrangement processing unit 206 and the corrected data is added to the music data in the music track 1, while the musical material data 3 in the music track 3 is directly added, without being subjected to correction, to the music data in the music track 1.

In this first embodiment, as described above, when a music content to be played is given, in accordance with a synchronization signal SYNC produced so as to be synchronous with this music content and music reconstruction data ARI produced according to the music construction information of the music content, musical materials are mixed with the original music content thereby obtaining musically natural mixed data.

The provision of the synchronization signal SYNC allows boundaries of measures or beats to be easily detected. This makes it possible to easily apply an effect to music data.

The arrangement process described above can be performed in real time and dynamically. For example, it is easy to change the arrangement style while quickly responding to time-varying biological information.

In the present embodiment, a loop playback mode is provided as one of remixing modes. In the loop playback mode, a small size of music material data with a length of one to few measures or one to few beats is repeatedly played back. The loop playback mode makes it possible to play music for an infinite period by suing a small-size music material data. The loop playback mode is useful, for example, when a rhythm pattern of a drum or the like is repeatedly played.

For example, for original music material data such as that shown in FIG. 21(C) is given, a mark IN indicating a start point of a loop and a mark OUT indicating an end point of the loop are defined in the music material data. A plurality of original music materials may be stored in a "DJ loop information storage unit" in the attribute information storage unit 22 of the music content storage unit 20. Instead of the attribute information storage unit 22, the "DJ loop information storage unit" may be implemented in another storage area, and original music materials may be stored therein.

If one of the plurality of original music materials is selected via the user interface 11, and a loop playback command is issued, the specified original music material information is read from the attribute information storage unit 22 and supplied to the audio/video data decoder 205 of the slave rhythm unit 220. In accordance with the supplied music material information, the loop playback process is performed by the audio/video data decoder 205 and the audio/video arrangement processing unit 206 while correcting the tempo and the pitch as required.

In the above process, more specifically, as shown in FIG. 21(B), the audio/video data decoder 205 and the audio/video arrangement processing unit 206 starts playing the original music material from the mark IN in a specified music track in synchronization with the measure synchronization signal PHSY or the beat synchronization signal BTSY (FIG. 21(A)) of the synchronization signal SYNC. If the mark OUT is reached, the playback position is returned from the mark OUT to the mark IN, and the loop playback is continued. Note that the jump from the mark OUT to the mark IN occurs exactly when the mark OUT is reached.

Note that not only the music track in which the loop playback is performed but ails music tracks are in synchronization with the synchronization signal SYNC, and thus the DJ loop playback is performed in a musically natural manner.

Figure 22:
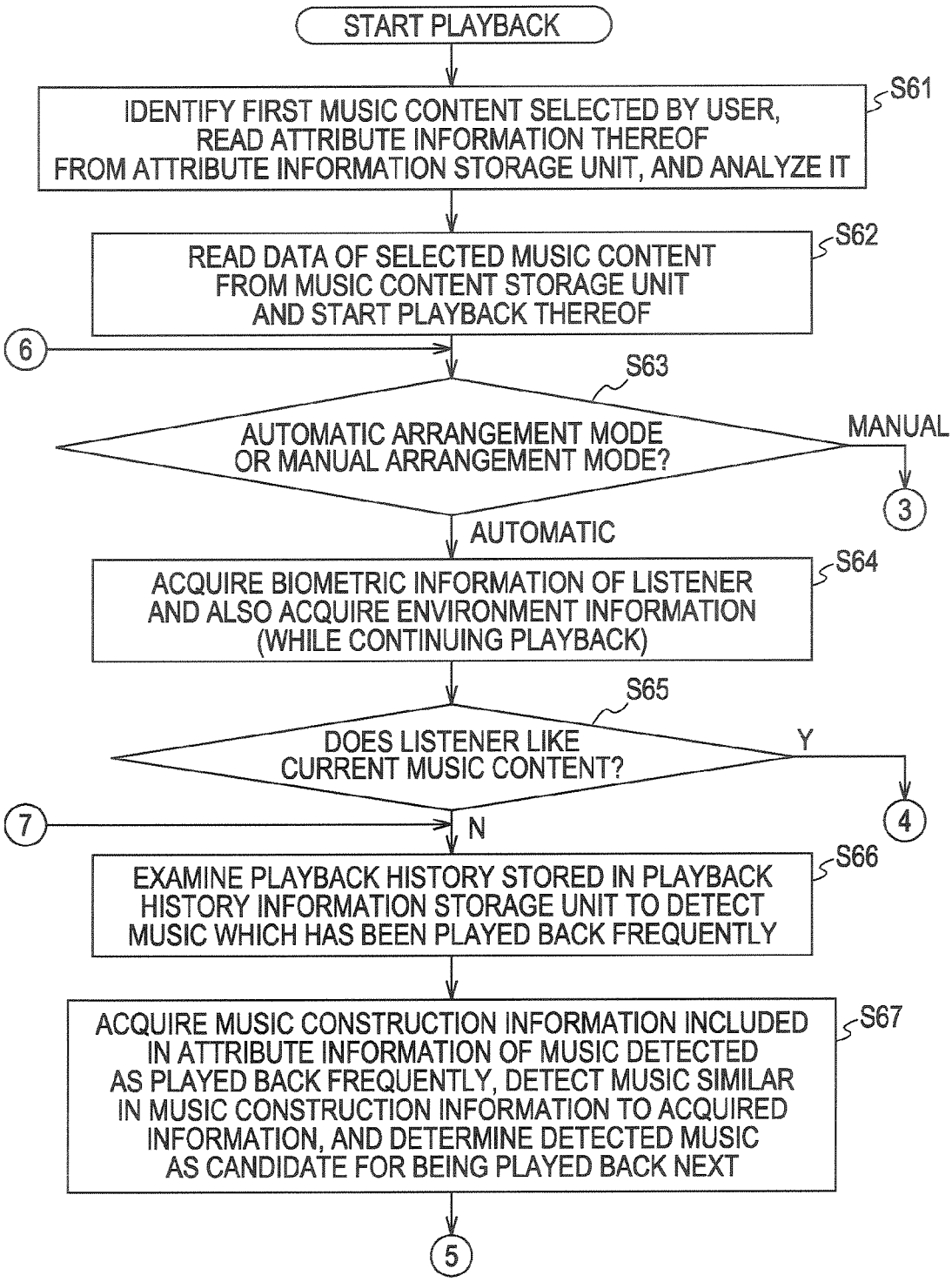
FIG. 22 is a part of a flow chart illustrating a playback process performed by the recording/playback apparatus shown in FIG. 1.
Figure 23:
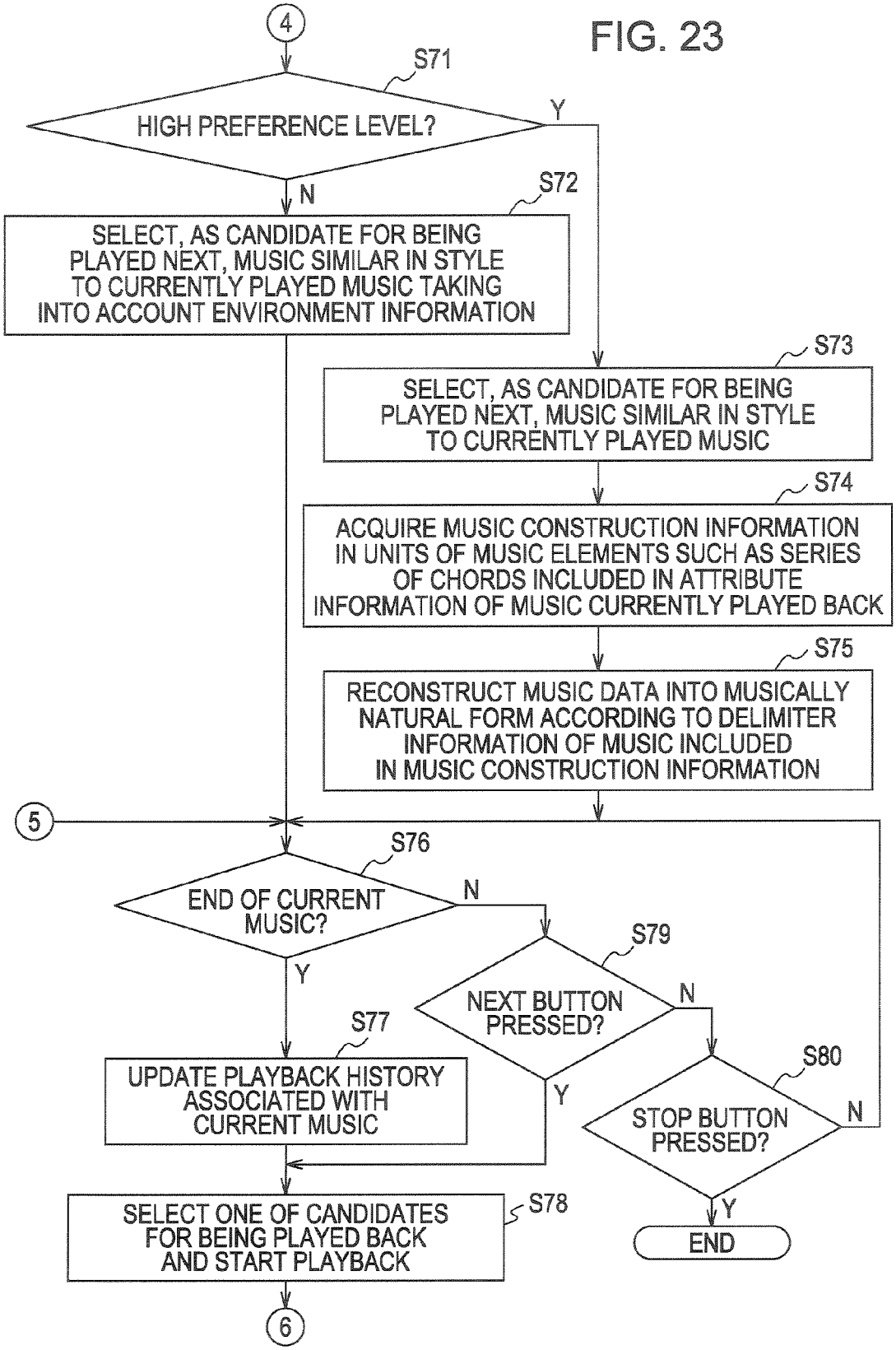
FIG. 23 is a part of the flow chart illustrating the playback process performed by the recording/playback apparatus shown in FIG. 1.
Figure 24:
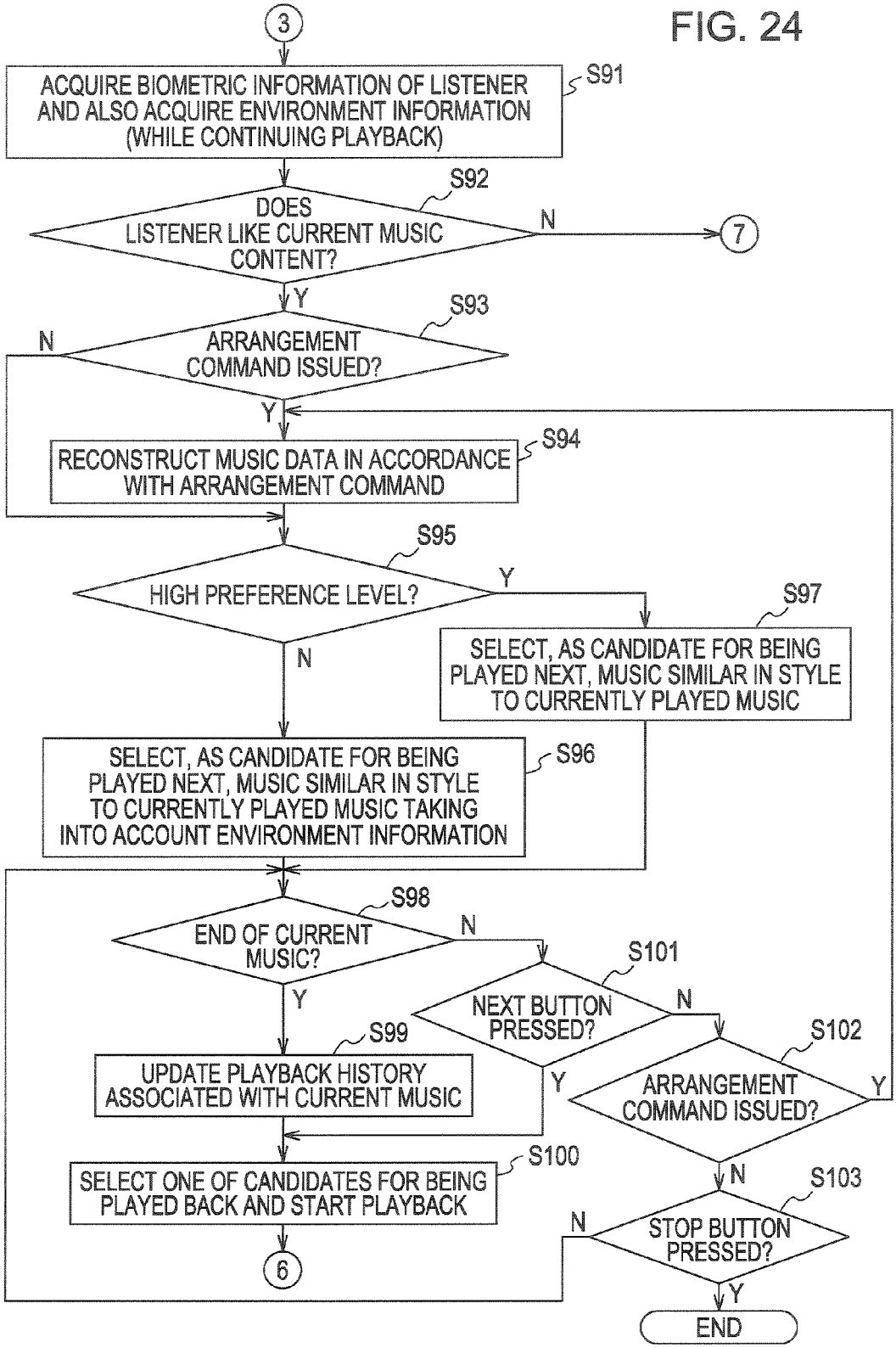
FIG. 24 is a part of the flow chart illustrating the playback process performed by the recording/playback apparatus shown in FIG. 1.

Next, referring to flow charts shown in FIGS. 22 to 24, the playback process is further described below. Note that steps shown in FIGS. 22, 23, and 24 are performed by the CPU 1 by executing a program stored in the ROM 3 using the RAM 4 as a work area.

First, a user selects a desired music content (a desired piece of music) from a music content select menu displayed on the display screen of the user interface 11, and issues a command to the audio/video data selection controller 201 to start playing the first piece of music. Note that second and following pieces of music are automatically selected and played.

If the audio/video data selection controller 201 receives the command to play the first piece of music via the user interface 11, the audio/video data selection controller 201 identifies the music content to be played, and commands the decoding unit 202 to read attribute information associated with the music content specified to be played and also attribute information of all or a particular number of music contents from the attribute information storage unit 22 of the music content storage unit 20. In accordance with the command, the decoding unit 202 sends the attribute information to the audio/video data selection controller 201 via the attribute information acquisition unit 203. The audio/video data selection controller 201 analyzes the received attribute information (step S61).

That is, the audio/video data selection controller 201 analyzes the acquired attribute information of the music content specified to be played and attribute information of other music contents, in preparation for selection of candidates for music contents to be played next and for reconstruction of the music content being currently played.

The audio/video data selection controller 201 then command the decoding unit 202 to read audio/video data of the music content specified to be played. In response, the decoding unit 202 reads the audio/video data of the specified music content from the music content storage unit 20 and transfers it to the audio/video data acquisition unit 204. The audio/video data supplied to the audio/video data acquisition unit 204 is transferred to the audio/video data decoder 205 and is decoded. The resultant decoded data is supplied to the audio output unit 53 via the audio/video arrangement processing unit 206 and acoustically output. The decoded data is also supplied to the video output unit 56 and an image is output according to the data. Thus, the playback is started (step S62).

If the playback of the music content is started, in the present embodiment, the audio/video data selection controller 201 determines the arrangement mode is set in the automatic mode or the manual mode (step S63). If it is determined that the arrangement mode is set in the automatic mode, the audio/video data selection controller 201 acquires biological information of a listener from the biological information acquisition unit 30 and acquires environment information from the environment information acquisition unit 40 (step S64). The acquisition of the biological information and the environment information is continued as long as the playback is performed.

The audio/video data selection controller 201 determines whether the listener shows a preference for the music being played, on the basis of the biological information of the listener acquired via the biological information acquisition unit 30 (step S65).

The audio/video data selection controller 201 determines whether the listener is enjoying listening to the current music on the basis of the biological information indicating the body motion or the like sensed by the biological information sensor 31 of the recording/playback apparatus and analyzed by the biological information analyzer 32. Note that in general, when the listener is actively enjoying music, he/she involuntarily moves his/her body.

For example, the determination as to whether the listener is actively enjoying music can be made by calculating the cross-correlation function between the music construction information (in terms of boundaries of music constituent elements or the tempo) of the music being played and the output signal provided from the body motion sensor (implemented, for example, by an acceleration sensor). In this process, it is more desirable that the determination be made taking into account impression information included in the attribute information, because there is a tendency that a large and quick body motion occurs in response to wild music, but a slow and small boy motion occurs for soft music.

The greater the correlation coefficient, the more actively the listener is enjoying the music, that is, the more excited the listener is with the music. If the listener is actively enjoying listening to the current music, it is desirable to select and present some pieces of music expected to be exciting for the listener following the current music.

Conversely, if the motion of the listener is small and slow and electrical brain waves indicate that the listener is in a calm state, it is desirable to select and play, following the current music, some pieces of music expected to be not exciting at a low sound volume level so that the user can enjoy music in the calm state.

In addition to the impression information in terms of "exciting", impression information indicating the levels of other impression items, such as the "light/dark impression", the "soft/wild impression", "sad/cheerful impression", etc. included in the attribute information associated with the music content being currently played may be used together with the biological information of the listener to determine the preference level of the user for the current music. For example, even when the excitement level is low for soft music, if the electrical brain wave or the pulse rate indicates that the user is in a calm state, the preference level of the user for the current music can be high.

If it is determined in step S65 that the listener shows no interest in the music being currently played, the audio/video data selection controller 201 checks the playback history information stored in the playback history information storage unit 15 or included in pre-acquired attribute information associated with music contents to detect some pieces of music which were played frequently (step S66).

The audio/video data selection controller 201 then extracts the music construction information from the attribute information associated with music evaluated as being high in the playback frequency, and determines the music style/structure favored by the user. In the determination process, when a plurality of pieces of music are found which are high in playback frequency and which are equal in the music style/structure, it is determined that the music construction information of this music style/structure is favored by the user. On the other hand, when a plurality of pieces of music are found which are high in playback frequency but all of which are not equal in the music style/structure, it is determined that the music style/structure of a group including a great number of pieces of music which are high in playback frequency and equal in the music style/structure is favored by the user.

The audio/video data selection controller 201 selects some pieces of music which are similar in music construction information to the music construction information of the music style/structure determined as being favored by the user, that is, selects some pieces of music of a music style/structure similar to the music style/structure determined as being favored by the user, and determines the selected pieces of music as candidates for being played next following the current music (step S67). That is, in this case, because the listener has no interest in the music being currently played, some pieces of music highly likely to be wanted by the listener are selected on the basis of the playback history of the listener and are presented to the listener.

The audio/video data selection controller 201 monitors whether the end of the music of being currently played has been reached (step S76 in FIG. 23). If it is determined that the end of the music has been reached, the playback history stored in the playback history information storage unit 15 as to this music (music content) whose playback is completed is updated, and the playback history information included in the attribute information associated with this music content is also updated (step S77).

The audio/video data selection controller 201 selects a music content to be played next from the candidates determined in step S67, and issues a command to read audio/video data of the selected music content and start playback thereof (step S78). The processing flow then returns to step S63 to repeat the process from step S63.

In a case where it is determined in step S76 that the end of the current music has not been reached, the audio/video data selection controller 201 determines whether a next button disposed on the operation unit of the user interface 11 has been pressed by the listener (step S79). Note that the next button is pressed when the listener wants to stop the playback of the current music and to play next piece of music.

If it is determined in step S79 that the next button has been pressed, then in next step S78, the audio/video data selection controller 201 selects a music content to be played next from the candidates determined in step S67, and issues a command to read audio/video data of the selected music content and start playback thereof. The processing flow then returns to step S63 to repeat the process from step S63.

In a case where it is determined in step S79 that the next button has not been pressed, the audio/video data selection controller 201 determines whether a stop button disposed on the operation unit of the user interface 11 has been pressed by the user (step S80). If it is determined that the stop button has not been pressed, the processing flow returns to step S76 to monitor the arrival of the end of the current piece of music. However, if it is determined that the stop button has been pressed, the playback processing routine is ended.

In a case where it is determined in step S65 that the listener shows some preference for the music being currently played, the audio/video data selection controller 201 evaluates the preference level, for example, on the basis of the "excitement level" value or the like (step S71 in FIG. 23).

If it is determined that the preference of the listener for the current music is not very high, then, in the present embodiment, the audio/video data selection controller 201 determines candidates for music to be played next following the current music by evaluating the similarity in the music style/structure to that of the current music taking into account the environment information acquired from the environment information acquisition unit 40 (step S72). More specifically, first, some pieces of music are selected which have music construction information in the attribute information similar to the music construction information included in the attribute information associated with the music being currently played. Thereafter, the location such as a mountain or a beach where the listener is now listening to music is determined on the basis of the environment information acquired from the environment information acquisition unit 40, and, from these selected pieces of music, pieces are selected which have environment information included in attribute information indicating that the current listening place is coincident with the recommended listening place. The selected pieces are determined as candidates for being played next following the current music.

In step S72 described above, candidates for being played next may be made determined only on the basis of the environment information without taking into account the similarity in music style/structure to the current music. In addition to pieces of music having environment information satisfying the required environment condition described above, some pieces of music which are similar in music construction information to the current music may be added to the candidates for music to be played next following the current music.

In a case where it is determined in step S71 that the preference level for the current music is high, the audio/video data selection controller 201 selects some pieces of music which are similar in music style/structure to the music being currently played, and determines the selected pieces as candidates for music to be played next following the current music (step S73). More specifically, some pieces of music are selected whose music construction information included in the attribute information is similar to the music construction information included in the attribute information associated with the music being currently played, and selected pieces are determined as candidates for music to be played next following the current music.

The audio/video data selection controller 201 then extracts, from the attribute information associated with the music being currently played, information indicating boundaries of music constituent elements and music construction information indicating the music structure in terms of the tempo, the key, the sequence of chords, etc. for each music constituent element (step S74). In accordance with the extracted information indicating the boundaries of music constituent elements and the music construction information of each music constituent element, the audio data of the music is reconstructed into a musically natural form (step S75). In this step S75, video data may also be subjected to reconstruction such as application of image effect.

The reconstruction of the audio data is not limited to remixing and application of an effect, but the reconstruction may include increasing/decreasing of the tempo, increasing/decreasing of the key, changing the sequence of chords, etc.

For example, remixing may be performed such that one or more pieces of music similar in music construction information to the music being currently played are selected from pieces other than the current music, and the selected one or more pieces are mixed with the current music taking into account the boundaries of music constituent elements into a musically natural form. In the remixing process, music data of music to be remixed in units of music constituent elements may be determined taking into account the impression information included in the attribute information.

Tick data of drum rhythms and/or rhythm pattern data of a percussion part may be stored in advance in the recording/playback apparatus, and may be mixed with music data being currently played while controlling the mixing timing with respect to boundaries of music constituent elements.

When the audio/video data selection controller 201 selects a piece of music to be mixed with the current music, the audio/video data selection controller 201 may select music which matches the current environmental condition by performing a search according to the environment information included in the attribute information.

When the attribute information associated with music being currently played includes a recommended effect parameter, an effect process may be performed in accordance with the recommended effect parameter while controlling the timing of applying the effect with respect to boundaries of music constituent elements such that a musically natural effect is achieved.

In a case where it is determined in step S63 that the manual mode is selected in the arrangement mode, the audio/video data selection controller 201 acquires biological information of a listener from the biological information acquisition unit 30 and acquires environment information from the environment information acquisition unit 40 (step S91). The acquisition of the biological information and the environment information is continued as long as the playback is performed.

The audio/video data selection controller 201 determines whether the listener shows some preference for the music being currently played, on the basis of the biological information of the listener acquired via the biological information acquisition unit 30 (step S92). If it is determined that the listener shows no interest in the music being currently played, the processing flow jumps to step S66 in FIG. 22 to perform the process in step S66 and following steps.

In a case where it is determined in step S92 that the listener shows some preference for the music being currently played, the audio/video data selection controller 201 determines whether an arrangement request command has been issued by a user via the user interface 11 (step S93). If it is determined in step S93 that the arrangement request command has been issued, the audio/video data selection controller 201 arranges the music data into a form intended by the user by reconstructing the music data in accordance with the arrangement information supplied from the attribute information storage unit 22 and other necessary information (step S94).

The reconstruction of the music data causes a change in the music style/structure of the music being played. Therefore, the audio/video data selection controller 201 checks the biological information of the listener supplied from the biological information acquisition unit 30 to determine whether the listener likes the music being played according to the reconstructed music data (step S95).

In a case where it is determined in step S93 that no arrangement request command is detected, the audio/video data selection controller 201 skips step S94 and advances the processing flow to step S95 to determine whether the listener shows some preference for the music being played.

If it is determined in step S95 that the preference of the listener for the current music is not very high, then, in the present embodiment, the audio/video data selection controller 201 determines candidates for music to be played next following the current music by evaluating the similarity in the music style/structure to that of the current music taking into account the environment information acquired from the environment information acquisition unit 40 (step S96).

More specifically, first, some pieces of music are selected which have music construction information in the attribute information similar to the music construction information included in the attribute information associated with the music being currently played. Thereafter, the location such as a mountain or a beach where the listener is now listening to music is determined on the basis of the environment information acquired from the environment information acquisition unit 40, and, from these selected pieces of music, pieces are selected which have environment information included in attribute information indicating that the current listening place is coincident with the recommended listening place.

The selected pieces are determined as candidates for being played next following the current music.

In step S96 described above, candidates for being played next may be made determined only on the basis of the environment information without taking into account the similarity in music style/structure to the current music. In addition to pieces of music having environment information satisfying the required environment condition described above, some pieces of music which are similar in music construction information to the current music may be added to the candidates for music to be played next following the current music.

In a case where it is determined in step S95 that the preference level of the user for the current music is high, the audio/video data selection controller 201 selects some pieces of music which are similar in music style/structure to the music being currently played, and determines the selected pieces as candidates for music to be played next following the current music (step S97). More specifically, some pieces of music are selected whose music construction information included in the attribute information is similar to the music construction information included in the attribute information associated with the music being currently played, and selected pieces are determined as candidates for music to be played next following the current music.

After step S96 or S97, the processing flow proceeds to step S98. In step S98, the audio/video data selection controller 201 monitors whether the end of the music of being currently played has been reached. If it is determined that the end of the music has been reached, the playback history stored in the playback history information storage unit 15 as to this music (music content) whose playback is completed is updated, and the playback history information included in the attribute information associated with this music content is also updated (step S99).

The audio/video data selection controller 201 then selects a music content to be played next from the candidates determined in step S96 or S97, and issues a command to read audio/video data of the selected music content and start playback thereof (step S100). The processing flow then returns to step S63 in FIG. 22 to repeat the process from step S63.

In a case where it is determined in step S98 that the end of the current music has not been reached, the audio/video data selection controller 201 determines whether a next button disposed on the operation unit of the user interface 11 has been pressed by the listener (step S101). Note that the next button is pressed when the listener wants to stop the playback of the current music and to play next piece of music.

If it is determined in step S101 that the next button has been pressed, then in step S100, the audio/video data selection controller 201 selects a music content to be played next from the candidates determined in step S96 or S97, and issues a command to read audio/video data of the selected music content and start playback thereof. The processing flow then returns to step S63 to repeat the process from step S63.

In a case where it is determined in step S101 that the next button has not been pressed, the audio/video data selection controller 201 determines whether an arrangement request command has been issued by the user via the user interface 11. If it is determined that the arrangement request command has been issued, the processing flow returns to step S94 to repeat the process from step S94.

In a case where it is determined in step S102 that no arrangement request command is detected, the audio/video data selection controller 201 determines whether a stop button disposed on the operation unit of the user interface 11 has been pressed by the user (step S103). If it is determined that the stop button has not been pressed, the processing flow returns to step S98 to monitor the arrival of the end of the current piece of music. However, if it is determined that the stop button has been pressed, the playback processing routine is ended.

In the example described above, when a listener shows no interest in music being currently played, playback history information is acquired in step S66, and candidates for music to be played next following the current music are determined in step S67 on the basis of the acquired playback history information. In step S66 described above, the current location of the listener, which may be a mountain, a beach, etc., may be detected by analyzing the environment information acquired via the environment information acquisition unit 40, and in next step S67, some pieces of music having environment information included in attribute information matching the environment information detected in step S66 may be selected as candidates for music to be played next following the current music. In addition to pieces of music having environment information satisfying the required environment condition described above, some pieces of music which are similar in music construction information to the current music may be added to the candidates for music to be played next following the current music.

In step S67 described above, the audio/video data selection controller 201 may use both playback history information and environment information in determination of the candidates for music to be played next.

Figure 25:
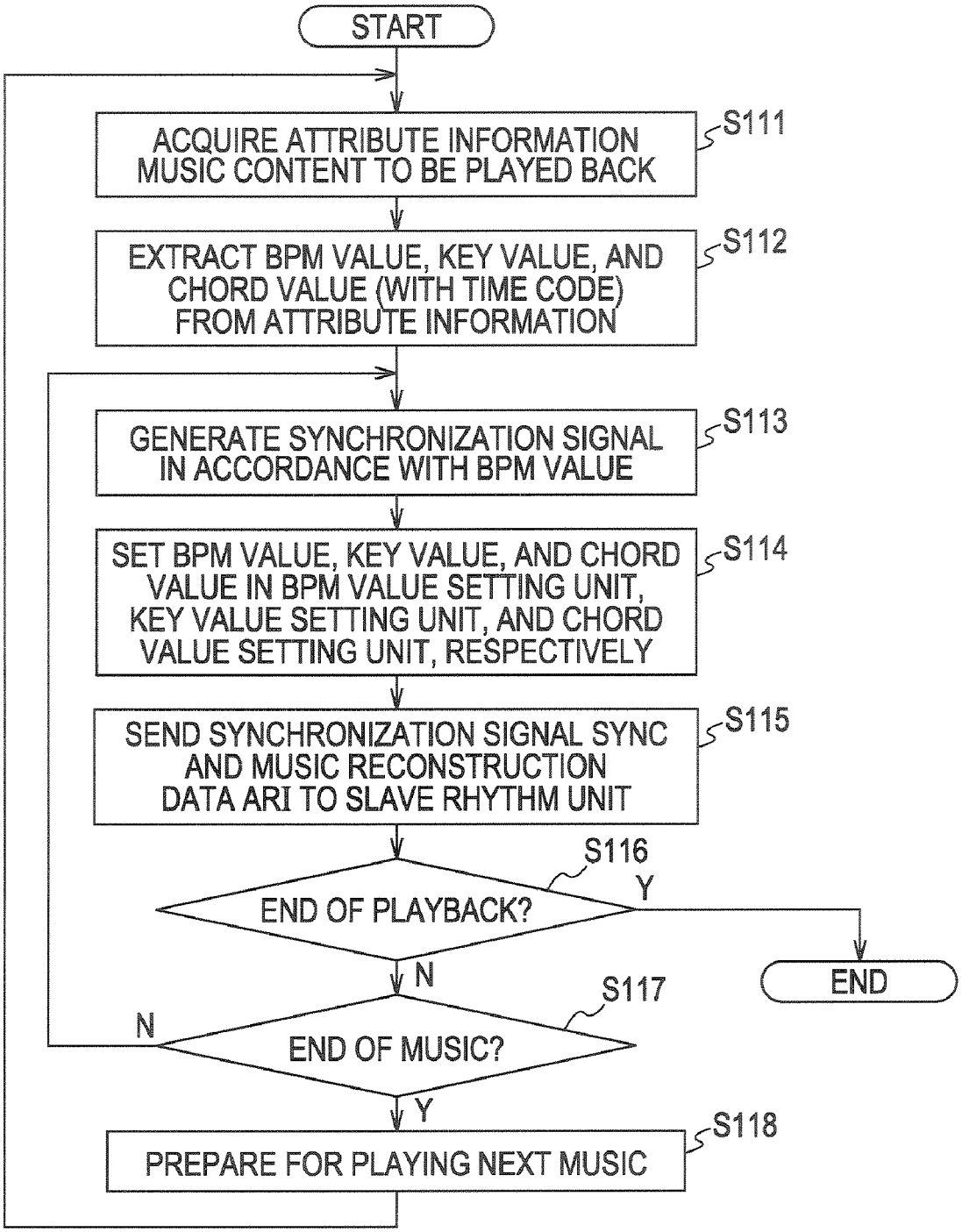
FIG. 25 is a flow chart illustrating a process performed by a master rhythm unit included in the structure shown in FIG. 14.

FIG. 25 is a flow chart illustrating an example of a process performed by the master rhythm unit 210 to produce a synchronization signal and music reconstruction data.

First, the audio/video data selection control RM unit 201M acquires attribute information associated with music being played from the attribute information storage unit 22 of the music content storage unit 20 via the attribute information acquisition unit 203 (step S111), and extracts the BPM value, the key value, and the chord value from the acquired attribute information (step S112).

On the basis of the extracted BPM value, a synchronization signal SYNC including a measure synchronization signal PHSY and a beat synchronization signal BTSY is produced (step S113). The extracted BPM value, the key value, and the chord value are respectively set in the BPM value setting unit, the key value setting unit, and the chord value setting unit (step S114).

The synchronization signal SYNC produced in step S113 and the music reconstruction data ARI including the BPM value, the key value, and the chord value set in step S114 are sent to the slave rhythm unit 220 (step S115).

A determination is then made as to whether to the playback operation has been stopped (step S116). If the determination is affirmative, the processing routine in FIG. 25 is ended. However, if the determination is negative, a further determination is made as to whether the end of the current piece of music has been reached (step S117). If it is determined that the end of the current piece of music has not been reached, the processing flow returns to step S113 to continue transmission of the synchronization signal SYNC and the music reconstruction data ARI to the slave rhythm unit 220.

If it is determined in step S117 that the end of the music has been reached, a preparation is made for playback of next selected piece of music (step S118). The processing flow then returns to step S111 to repeat the process from step S111.

Note that, as described above, time code information which is described in the attribute information and which indicates boundaries of music constituent elements such as measures should exactly correspond to time code information indicating boundaries of measures of actual audio/video data, and the attribute information should exactly correspond to the audio/video data of the music content so as to ensure that the synchronization signal SYNC and the music reconstruction data ARI supplied from the master rhythm unit 210 to the slave rhythm unit 220 are in exact synchronization with the playback signal stream of the audio/video data input to the slave rhythm unit 220 via the audio/video data acquisition unit 204.

Figure 26:
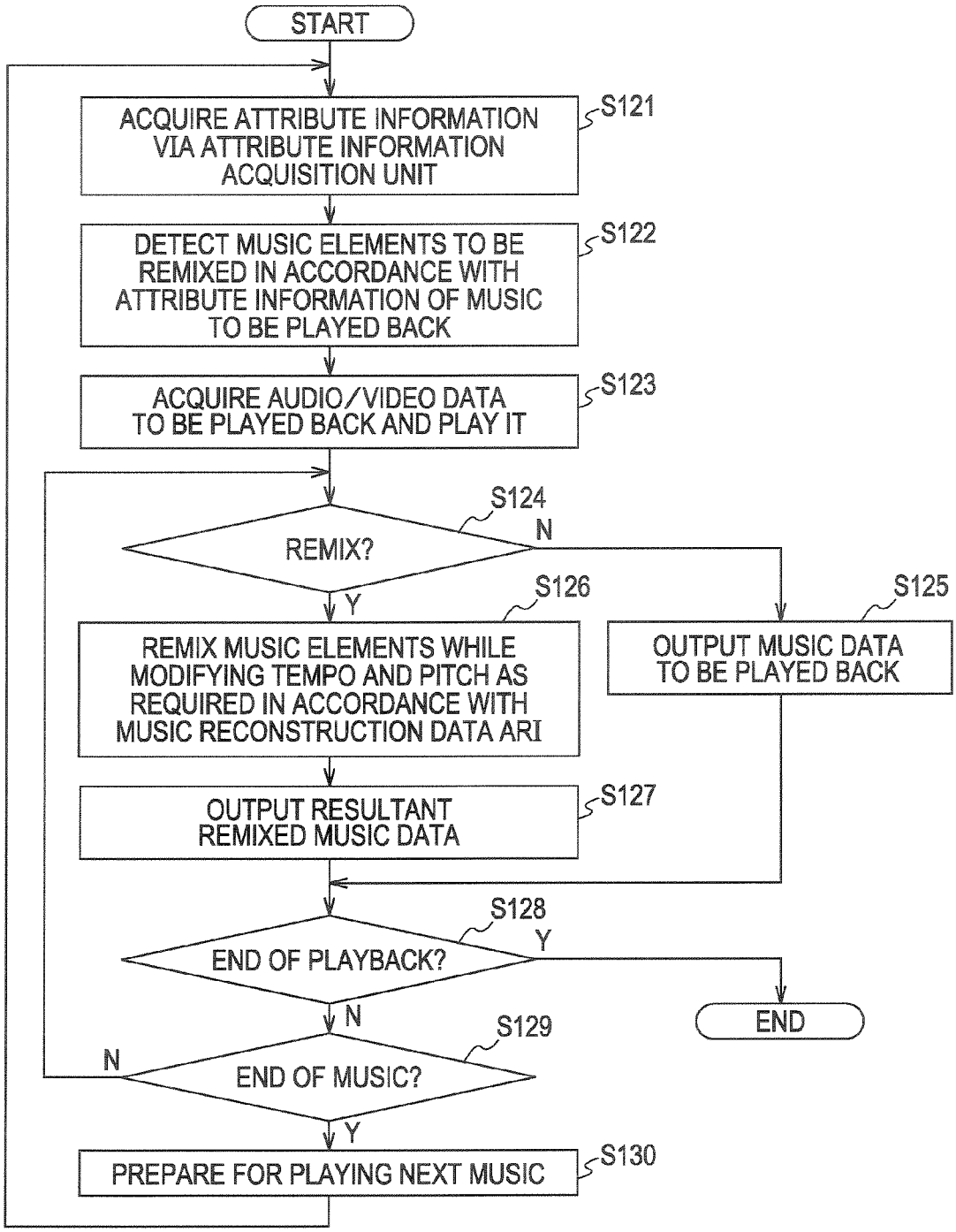
FIG. 26 is a flow chart illustrating a process performed by a slave rhythm unit included in the structure shown in FIG. 14.

FIG. 26 is a flow chart illustrating an example of the music reconstruction process performed by the slave rhythm unit 220. In the following explanation, by way of example, it is assumed that the music reconstruction process includes only remixing, although the music reconstruction may include other processes such as application of an effect as described above.

First, the audio/video data selection control RS unit 201S acquires attribute information associated with music to be played and also attribute information associated with some other music contents from the attribute information storage unit 22 of the music content storage unit 20 via the attribute information acquisition unit 203 (step S121), and, in accordance with the acquired attribute information, the audio/video data selection control RS unit 201S determines music material data to be mixed with the music to be played (step S122).

In the above process, reading of attribute information from the attribute information storage unit 22 of the music content storage unit 20 may be performed for all music contents. However, when a great number of music contents are stored in the music content storage unit 20, reading of attribute information for all music contents causes a great increase in a load on the process of detecting music to be mixed with the music to be played. To avoid the above problem, in the present embodiment, reading of attribute information from the attribute information storage unit 22 of the music content storage unit 20 is performed not for all music contents at a time, but reading is performed a plurality of times to acquire attribute information on a part-by-part basis, music materials to be mixed with the music of interest are detected each time the reading is performed.

In the case where attribute information is read from the attribute information storage unit 22 of the music content storage unit 20 on the part-by-part basis, some musical materials to be mixed with the music of interest are also detected after playing of the music of interest is started. However, in general, remixing is not started immediately when playing of music of interest is started. Therefore, in practice, reading on the part-by-part basis can provide attribute information necessary to detect a music material to be mixed with the music of interest before remixing is actually started.

Next, in accordance with a selection command issued by the audio/video data selection control RS unit 201S, audio/video data of music to be played is acquired via the decoding unit 202 and the audio/video data acquisition unit 204, and playing of the music is started (step S123). As described above, the playing is performed in synchronization with the synchronization signal SYNC and the music reconstruction data ARI output from the master rhythm unit 210.

The audio/video data selection control RS unit 201S then determines whether to mix some music data with the music of interest (step S124). If it is determined not to perform the remixing process, the audio/video data selection control RS unit 201S sends the music data of the music of interest to the audio output unit 53 and the video output unit 56 via the audio/video data decoder 205 and the audio/video arrangement processing unit 206 (step S125).

On the other hand, if it is determined in step S124 to perform remixing, the music material detected in step S122 is mixed with the music data of the music of interest while adjusting the tempo and the pitch of the music material in accordance with the music reconstruction data ARI supplied from the master rhythm unit 210 in the above-described manner (step S126). The resultant remixed music data is output (step S127).

A determination is then made as to whether to the playback operation has been stopped (step S128). If the determination is affirmative, the processing routine in FIG. 26 is ended. However, if the determination is negative, a further determination is made as to whether the end of the current piece of music has been reached (step S129). If it is determined that the end of the current piece of music has not been reached, the processing flow returns to step S124 to repeat the process from step S124.

If it is determined in step S129 that the end of the music has been reached, a preparation is made for playback of next selected piece of music (step S130). The processing flow then returns to step S121 to repeat the process from step S121.

Second Embodiment

In the first embodiment described above, the master rhythm unit 210 performs the music reconstruction process such that the BPM value, the key value, and the chord value are detected from the attribute information associated with the music content being played, and remixing is simply performed in accordance with the detected BPM value, the key value, and the chord value without changing the tempo or the key of the music of interest being played. However, the tempo and/or the key of the music of interest being played may be changed in the music reconstruction process, depending on a feeling of a listener, the environmental condition of a place where the listener is listening to the music, and/or the arrangement information.

In this case, a listener may want to specify the tempo and/or the key in which to play music. In some cases, a listener may want to play music of interest in synchronization with a drum or a piano played at a place where the recording/playback apparatus is located. There is also a need to play music on the recording/playback apparatus in synchronization with music input to the recording/playback apparatus from the outside.

In a second embodiment, in view of the above, the invention provides a recording/playback apparatus that meets the above-described requirements.

Figure 27:
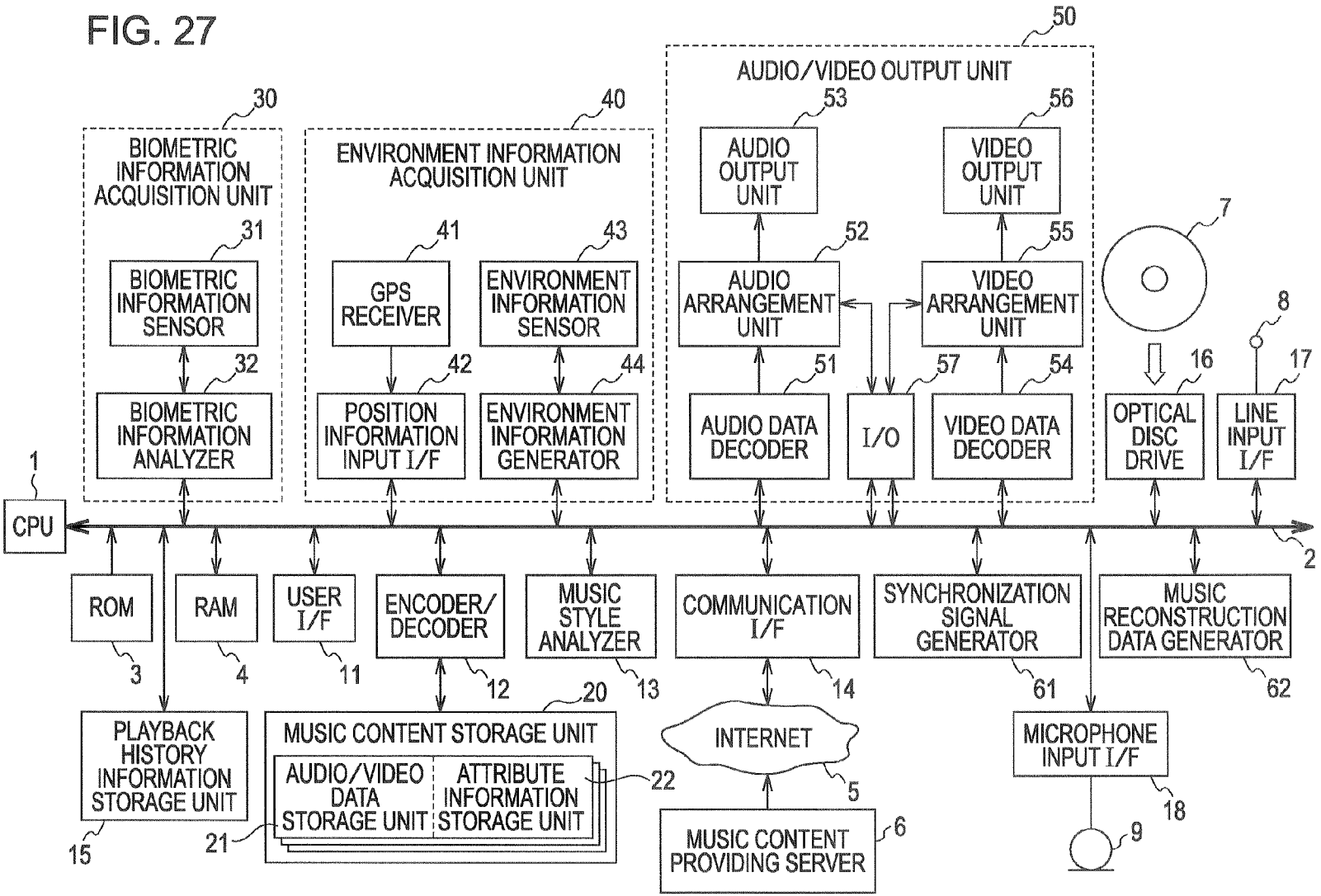
FIG. 27 is a block diagram illustrating a recording/playback apparatus which is a second embodiment of a music content playback apparatus according to the present invention.

FIG. 27 is a block diagram illustrating the recording/playback apparatus according to the second embodiment, which is similar in hardware structure to that according to the first embodiment shown in FIG. 1 except that the recording/playback apparatus additionally includes a line input interface 17 and a microphone input interface 18 both connected to the system bus 2.

The line input interface 17 is also connected to an external input terminal 8 so that when audio/video data is input to the recording/playback apparatus via the external input terminal (line input terminal) 8, the line input interface 17 transfers the input audio/video data over the system bus 2.

In this second embodiment, the audio/video data input via the external input terminal 8 is encoded by the encoder/decoder 12 in accordance with a command issued by a user via the user interface 11, and the resultant encoded data is stored in the audio/video data storage unit 21 of the music content storage unit 20.

The audio/video data input via the external input terminal 8 is analyzed by the music style/structure analyzer 13, and music construction information obtained as a result of the analysis is encoded by the encoder/decoder 12 and stored in the attribute information storage unit 22 of the music content storage unit 20. In the above process, the attribute information stored in the music content storage unit 20 is related to corresponding audio/video data via corresponding identification information, as described above.

In this second embodiment, as will be described in further detail later, it is allowed to play music of interest in synchronization with the tempo of the audio/video data input via the external input terminal 8. In this case, the audio/video data input via the external input terminal 8 is analyzed by the music style/structure analyzer 13, and, in accordance with a BPM value obtained via the analysis, the synchronization signal SYNC described above is produced.

The microphone input interface 18 is connected to a microphone 9 serving as sound sensing means. An audio signal detected by the microphone 9 is converted into a digital signal by the microphone input interface 18 and output over a system bus 2.

In this second embodiment, as described later, it is allowed to play back specified music data in synchronization with the tempo of audio data sensed by the microphone 9 and input via the microphone input interface 18.

For example, a sound of music played with a drum, a piano, etc. near the recording/playback apparatus is sensed by the microphone 9 and analyzed by the music style/structure analyzer 13 to detect a BPM value. On the basis of the detected BPM value, the synchronization signal SYNC is generated.

Figure 28:
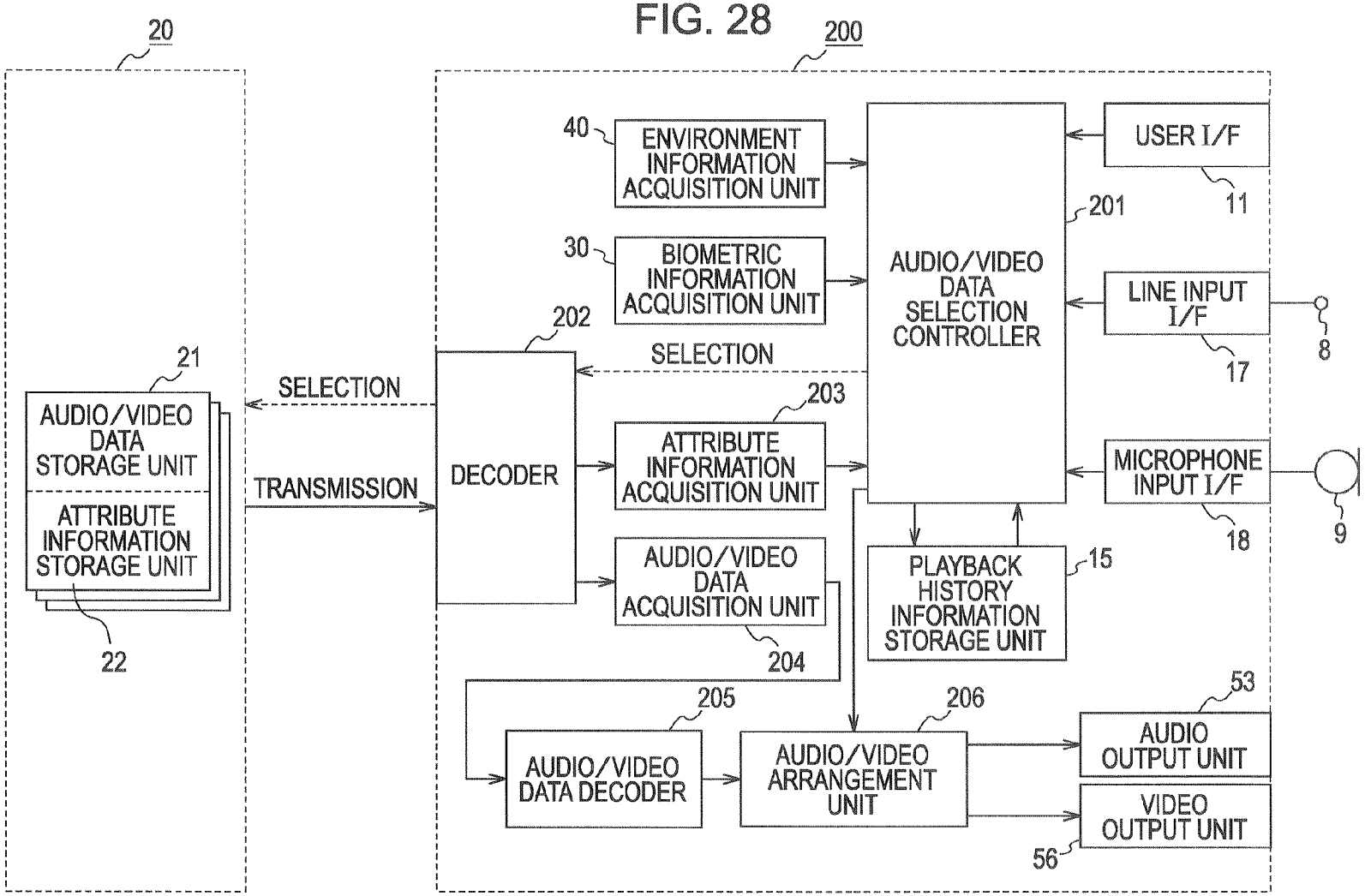
FIG. 28 is a functional block diagram illustrating a playback processing unit in the recording/playback apparatus according to the second embodiment shown in FIG. 27.

FIG. 28 illustrates a playback unit 200 according to the second embodiment, corresponding to the playback unit according to the first embodiment described above with reference to FIG. 13. This playback unit 200 is similar to that according to the first embodiment except that an audio/video data selection controller 201 is connected to a line input interface 17 and a microphone input interface 18, and the audio/video data selection controller 201 performs software processing in a different manner from that according to the first embodiment.

Figure 29:
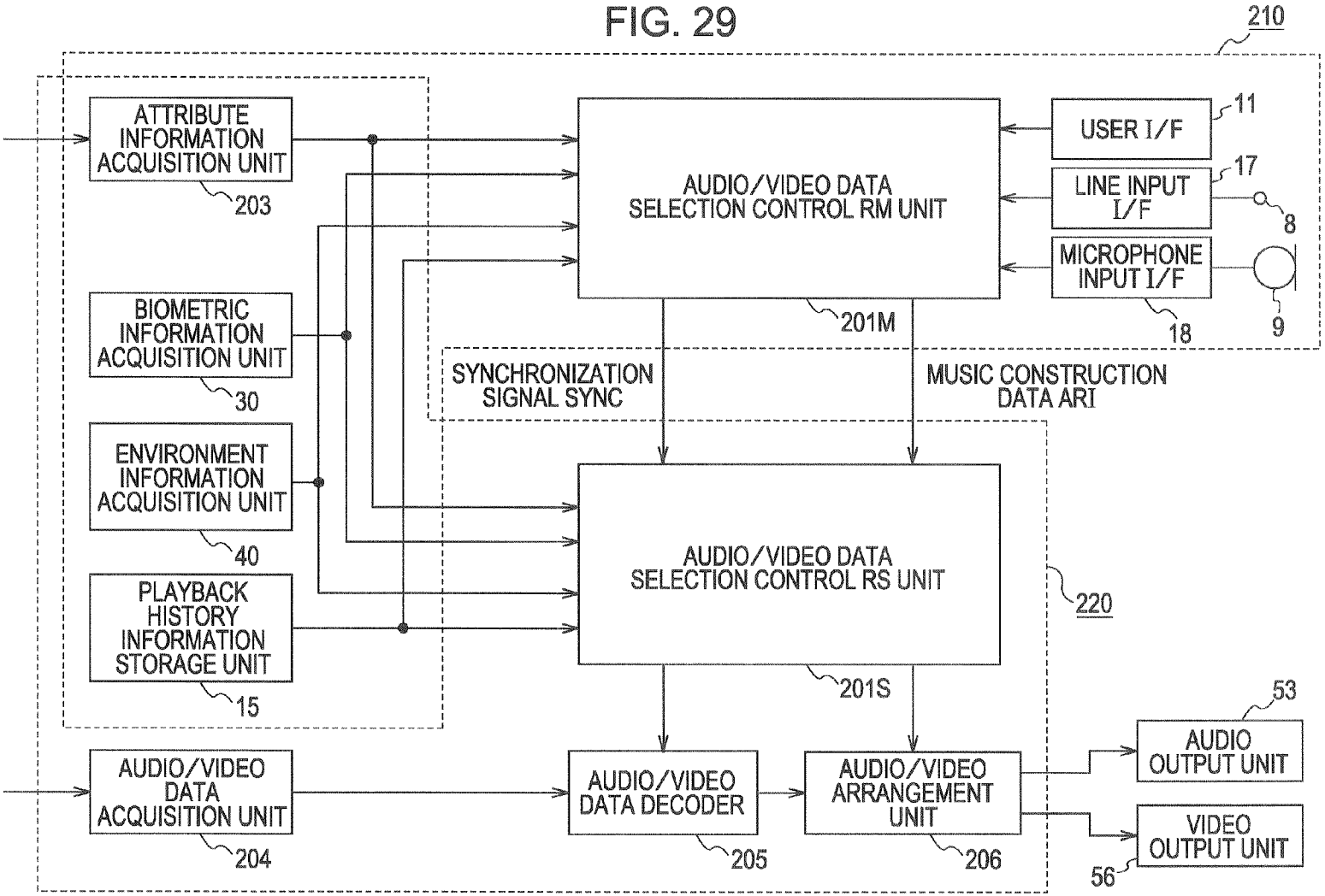
FIG. 29 is a functional block diagram illustrating main parts of a recording/playback apparatus according to the second embodiment shown in FIG. 27.

FIG. 29 illustrates functional blocks of the playback unit 200 shown in FIG. 28, expressed from the view point of the process of reconstructing music. Note that the structure shown in FIG. 29 is essentially the same as that shown in FIG. 28, although they are seen from different point of views.

As shown in FIG. 29, the playback unit 200 includes a master rhythm unit 210 and a slave rhythm unit 220. The master rhythm unit 210 is adapted to generate a synchronization signal and music reconstruction information according to which to reconstruct music data, and output them. The slave rhythm unit 220 is adapted to reconstruct music data in accordance with the synchronization signal and the music reconstruction information supplied from the master rhythm unit 210.

As with the first embodiment, the audio/video data selection controller 201 has two main parts. One is a RM unit 201M belonging to the master rhythm unit 210, and the other is a RS unit 201S belonging to the slave rhythm unit 220. In this second embodiment, not only an attribute information acquisition unit 203 but also a biological information acquisition unit 30, an environment information acquisition unit 40, and a playback history information storage unit 15 belong to both the master rhythm unit 210 and the slave rhythm unit 220.

That is, in the second embodiment, the master rhythm unit 210 includes a RM unit 201M, the attribute information acquisition unit 203, the biological information acquisition unit 30, the environment information acquisition unit 40, and the playback history information storage unit 15.

On the other hand, as with the first embodiment, the slave rhythm unit 220 according to the second embodiment includes a RS unit 201S, the attribute information acquisition unit 203, the biological information acquisition unit 30, the environment information acquisition unit 40, the playback history information storage unit 15, an audio/video data acquisition unit 204, and audio/video data decoder 205. That is, the slave rhythm unit is similar in structure to that according to the first embodiment.

Note that the RM unit 201M of the master rhythm unit 210 the synchronization signal SYNC used as the reference signal in the music reconstruction process not only in accordance with the attribute information supplied from the attribute information acquisition unit 203, but, in this second embodiment, the master rhythm unit 210 is allowed to produce the synchronization signal SYNC also in accordance with other data such as a command/data input by a user via the user interface 11, audio/video data input from the outside via the line input interface 17, externally detected audio data input via the microphone input interface 18, biological information of a listener acquired via the biological information acquisition unit 30, environment information acquired via the environment information acquisition unit 40, and playback history information read from the playback history information storage unit 15.

Furthermore, in this second embodiment, not only in the production of the synchronization signal SYNC but also in production of music construction data ARI, the master rhythm unit 210 is allowed to refer also to a command/data input by a user via the user interface 11, audio/video data input from the outside via the line input interface 17, externally detected audio data input via the microphone input interface 18, biological information of a listener acquired via the biological information acquisition unit 30, environment information acquired via the environment information acquisition unit 40, and/or playback history information read from the playback history information storage unit 15.

Figure 30:
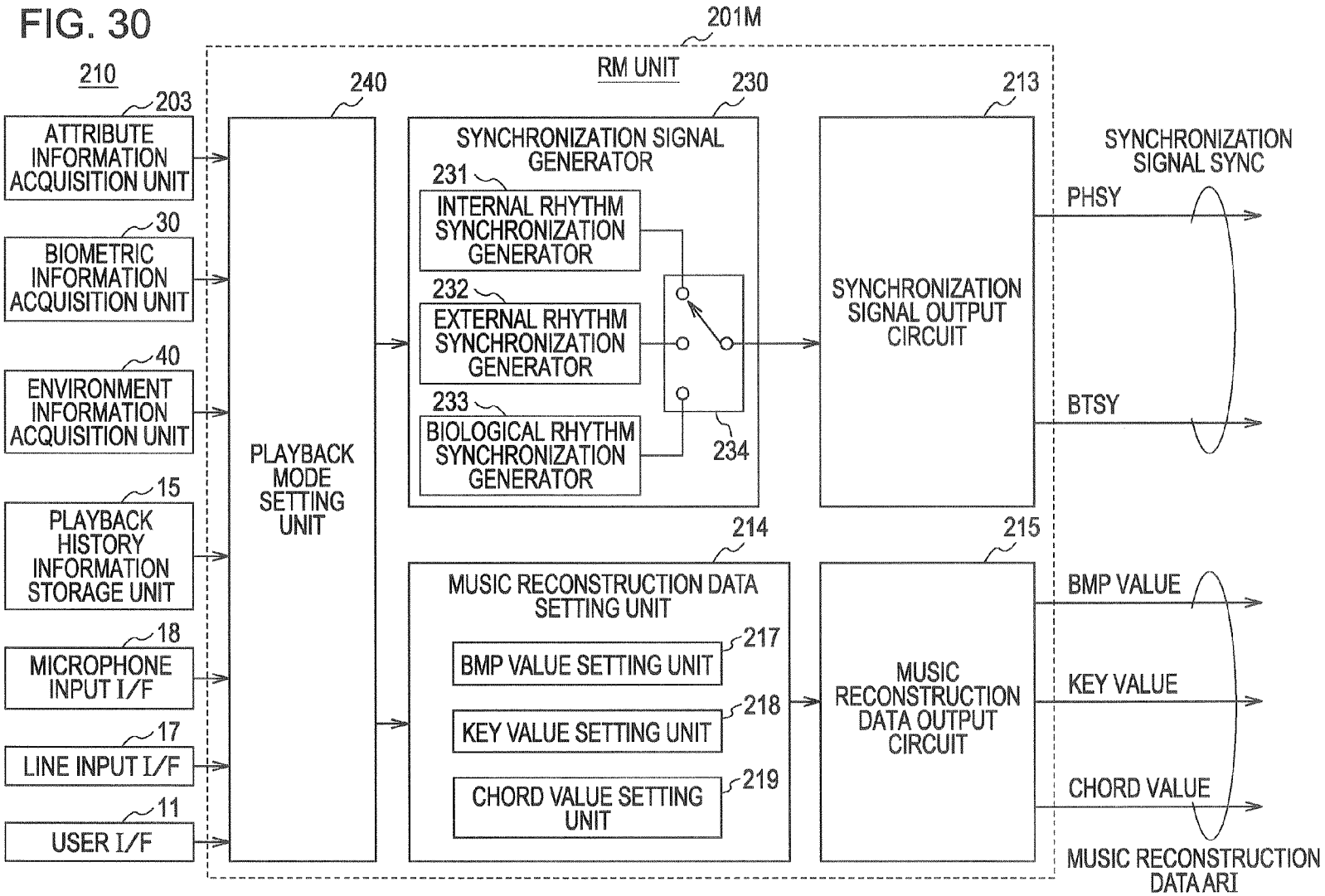
FIG. 30 is a functional block diagram illustrating details of a part of the functional block diagram shown in FIG. 27.
Figure 31:
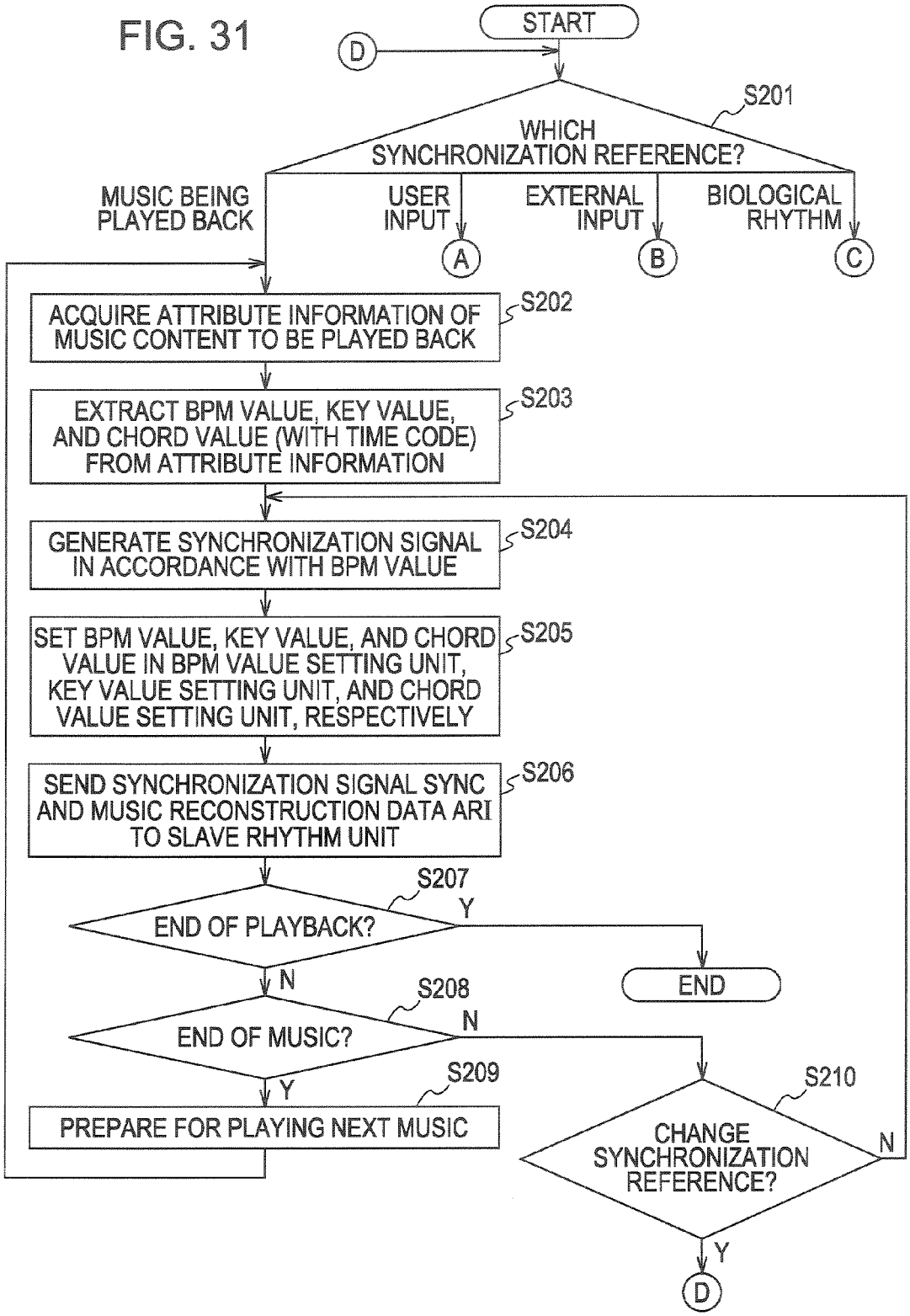
FIG. 31 is a part of a flow chart illustrating a process performed by a master rhythm unit included in the structure shown in FIG. 27.

FIG. 30 is a block diagram illustrating details of the master rhythm unit 210 according to the second embodiment. In this figure, in particular, details of functions of the RM unit 201M are shown. In the RM unit 201M according to the second embodiment, the synchronization signal generator 212 according to the first embodiment is replaced with a synchronization signal generator 230, and the attribute information analysis unit 211 is replaced with a playback mode setting unit 240.

The playback mode setting unit 240 is adapted to receive data not only from the attribute information acquisition unit 203, but also from the biological information acquisition unit 30, the environment information acquisition unit 40, the playback history information storage unit 15, the line input interface 17, the microphone input interface 18 and the user interface 11. Except for the above, the master rhythm unit 210 is similar to that according to the first embodiment.

The synchronization signal generator 230 includes an internal rhythm synchronization signal generator 231, an external rhythm synchronization signal generator 232, a biological rhythm synchronization signal generator 233, and a selection switching circuit 234 for selecting one of synchronization signals output from the three types of rhythm synchronization signal generators 231, 232, and 233.

The internal rhythm synchronization signal generator 231 includes, for example, a PLL circuit and is adapted to produce a synchronization signal SYNC in accordance with a BPM value extracted from attribute information associated with a music content of interest to be played, as with the first embodiment, or in accordance with a BPM value specified by a user via the user interface 11.

The external rhythm synchronization signal generator 232 includes, for example, a PLL circuit and is adapted to produce a synchronization signal SYNC in accordance with a BPM value extracted from the external input signal input via the line input interface 17 or in accordance with a BPM value extracted from the externally detected audio signal input via the microphone input interface 18 so that the synchronization signal SYNC is synchronous with a musical rhythm input from the outside.

The biological rhythm synchronization signal generator 233 includes, for example, a PLL circuit and is adapted to produce a synchronization signal SYNC synchronous with biological information indicating, for example, electrical brain waves of a user, a walking tempo or a walking speed, a tempo or a speed of motion of an arm or a hand, acquired with biological information acquisition unit 30. Note that a single PLL circuit may be shared by the three synchronization signal generators 231, 232, and 233.

In this second embodiment, in accordance with a synchronization signal selection command issued by a user via the user interface 11, the playback mode setting unit 240 selects a synchronization signal generation mode in which to generate the synchronization signal SYNC, from three modes: an internal rhythm synchronizing mode, an external rhythm synchronizing mode, and a biological rhythm synchronizing mode. According to the selected mode, the playback mode setting unit 240 generates a selection control signal thereby to control the selection switching circuit 234 in the synchronization signal generator 230.

Internal Rhythm Synchronization Mode

Synchronization with Music Content of Interest to be Played

When the internal rhythm synchronization mode is selected, a selection is further made as to whether the synchronization signal SYNC is generated in synchronization with attribute information associated with a music content of interest to be played or in synchronization with a BPM value specified by a user via the user interface 11. In the case of the external rhythm synchronization mode, a selection is further made as to whether the synchronization signal SYNC is generated in synchronization with an external signal input via the external input terminal 8 or in synchronization with an external audio signal detected by the microphone 9.

In the internal rhythm synchronization mode, if it is selected to synchronize with attribute information associated with a music content of interest, the playback mode setting unit 240 sets the selection switching circuit 234 to select the output from the internal rhythm synchronization signal generator 231, and the playback mode setting unit 240 acquires attribute information associated with the music content of interest via the attribute information acquisition unit 203 and supplies a BPM value extracted from the attribute information to the internal rhythm synchronization signal generator 231 in the synchronization signal generator 230. The internal rhythm synchronization signal generator 231 oscillates at a frequency corresponding to the received BPM value thereby generating a synchronization signal SYNC synchronous in phase with a musical rhythm of the music content of interest.

Thus, the synchronization signal SYNC produced on the basis of the BPM value specified in the attribute information associated with the music content to be played is output from the synchronization signal generator 230 to the slave rhythm unit 220 via the synchronization signal output circuit 213.

The playback mode setting unit 240 extracts the key value and the chord value from the attribute information, acquired via the attribute information acquisition unit 203, of the music content to be played, and supplies them together with the already extracted BPM value to the music reconstruction data setting unit 214. The music reconstruction data setting unit 214 sets the received BPM value, the key value, and the chord value in corresponding setting units 217, 218, and 219, respectively.

Thus, music reconstruction data ARI including the BPM value, the key value, and the chord value in the attribute information associated with the music content of interest is output in synchronization with the synchronization signal SYNC to the slave rhythm unit 220. The slave rhythm unit 220 performs a music reconstruction process in accordance with the attribute information associated with the music content of interest in a similar manner to the first embodiment described above.

Synchronization with User Input

In the internal rhythm synchronization mode, if it is selected to synchronize with a user input, the playback mode setting unit 240 sets the selection switching circuit 234 to select the output of the internal rhythm synchronization signal generator 231. The playback mode setting unit 240 accepts a BPM value input by a user via the user interface 11, and supplies the accepted BPM value to the biological rhythm synchronization signal generator 231 of the synchronization signal generator 230. The internal rhythm synchronization signal generator 231 generates a synchronization signal SYNC oscillating at a frequency corresponding to the supplied BPM value.

Thus, the synchronization signal SYNC produced on the basis of the BPM value specified by the user is output from the synchronization signal generator 230 to the slave rhythm unit 220 via the synchronization signal output circuit 213. Thus, the synchronization signal SYNC produced on the basis of the BPM value set by the user is output from the synchronization signal generator 230 to the slave rhythm unit 220 via the synchronization signal output circuit 213.

The playback mode setting unit 240 accepts, in addition to the BPM value, a key value and a chord value (a sequence of chords) input via the user interface 11, and supplies the accepted BPM value, the key value, and the chord value to the music reconstruction data setting unit 214. In this mode, to change the key value and/or the chord value with time, time-varying values are also specified by a user. The music reconstruction data setting unit 214 sets the received BPM value, the key value, and the chord value in corresponding setting units 217, 218, and 219, respectively.

Thus, the music reconstruction data ARI including the BPM value, the key value, and the chord value set by the user is output to the slave rhythm unit 220 in synchronization with the synchronization signal SYNC, whereby the slave rhythm unit 220 provides audio playback output of music in the music style/structure specified by the user and at the tempo specified by the user.

External Rhythm Synchronization Mode

When the external rhythm synchronization mode is selected, the playback mode setting unit 240 sets the selection switching circuit 234 to select the output of the external rhythm synchronization signal generator 232. Audio data is input via the line input interface 17 or the microphone input interface 18 selected by a user, and analyzed by the music style/structure analyzer 13. A BPM value obtained as a result of the analysis is supplied to the external rhythm synchronization signal generator 232. The external rhythm synchronization signal generator 232 produces a synchronization signal SYNC which oscillates at a frequency corresponding to the supplied BPM value and which is synchronous in phase with a musical rhythm input from the outside.

Thus, the synchronization signal SYNC produced on the basis of the BPM value detected from the external input signal or the microphone input signal is output from the synchronization signal generator 230 to the slave rhythm unit 220 via the synchronization signal output circuit 213.

The playback mode setting unit 240 also extracts the key value and the chord value from the attribute information, acquired via the attribute information acquisition unit 203, of the music content to be played, and supplies them together with the already extracted BPM value to the music reconstruction data setting unit 214. The music reconstruction data setting unit 214 sets the received BPM value, the key value, and the chord value in corresponding setting units 217, 218, and 219, respectively.

Thus, the music reconstruction data ARI including the BPM value, the key value, and the chord value detected from the external input signal or the microphone input signal is output to the slave rhythm unit 220 in synchronization with the synchronization signal SYNC.

Thus, in the external rhythm synchronization mode, the slave rhythm unit 220 provides audio playback output of music at the tempo set to be synchronous with the music input from the outside.

Biological Rhythm Synchronization Mode

When the biological rhythm synchronization mode is selected, the playback mode setting unit 240 sets the selection switching circuit 234 to select the output of the biological rhythm synchronization signal generator 233. The playback mode setting unit 240 extracts a component associated with the tempo or the rhythm from the biological information acquired via the biological information acquisition unit 30, and produces information indicating the BPM value in accordance with the extracted component. The produced BPM value is supplied to the biological rhythm synchronization signal generator 231 of the synchronization signal generator 230.

The synchronization signal generator 230 produces a synchronization signal SYNC which oscillates at a frequency corresponding to the biological rhythm of the user and which is synchronous in phase with the biological rhythm. The produced synchronization signal SYNC is supplied to the slave rhythm unit 220 via the synchronization signal output circuit 213. Thus, the slave rhythm unit 220 provides audio playback output of music at the tempo synchronous with the biological rhythm of the user.

In the biological rhythm synchronization mode, the synchronization signal SYNC may be produced not simply according to only the biological information acquired via the biological information acquisition unit 30 but also taking into account the environment information supplied from the environment information acquisition unit 40.

For example, when the environment information indicates that the recording/playback apparatus is located at a "beach", ambient temperature is high, and it is not rainy, the synchronization signal SYNC may be produced at an uptempo in synchronization with the biological information. Conversely, when the environment information indicates that the recording/playback apparatus is located on a "mountain", the synchronization signal SYNC may be produced at a slow temp in synchronization with the biological information.

The playback history information stored in the playback history information storage unit 15 may include biological information indicating a pulse rate or the like of a listener listening to a particular piece of music in association with the piece of music. A piece of music with biological information close to current biological information acquired via the biological information acquisition unit 30 may be searched for from the playback history information storage unit 15, and the synchronization signal SYNC may be producing in accordance with a BPM value determined from the attribute information associated with the piece of music detected in the search. In this case, the synchronization signal SYNC may or may not be synchronous with the current biological information acquired from the biological information acquisition unit 30.

In this case, in the present embodiment, the playback mode setting unit 240 searches the playback history information stored in the playback history information storage unit 15 by using, as a search key, biological information supplied from the biological information acquisition unit 30 and/or the environment information supplied from the environment information acquisition unit 40, produces a BPM value, a key vale, and a chord value on the basis of attribute information associated with a piece of music detected as a result of the search, and transfers the detected values to the music reconstruction data setting unit 214. The music reconstruction data setting unit 214 sets the received BPM value, the key value, and the chord value in corresponding setting units 217, 218, and 219, respectively.

For example, when the biological information indicates that a listener is in a spiritually uplifted state, a piece of music the listener often listens to in such a spiritual state is detected from the playback history. The synchronization signal SYNC is then produced in accordance with a BPM value of the detected piece of music, and music reconstruction data ARI including the BPM value, the key value, and the chord value of the music is produced and supplied to the slave rhythm unit 220 from the master rhythm unit 210. This makes it possible to play a piece of music at a tempo or a style similar to the tempo or the style of the music often listened to in the spiritually uplifted state.

In the case where the location such as a sea or a beach or weather such as rainy or fine weather is detected from the environment information, a piece of music often listened to at such a location or in such an environmental condition may be detected from the playback history by performing a search using environment information as a search key, and, in accordance with a BPM value of the detected piece of music, a synchronization signal SYNC and music reconstruction data ARI including the BPM value, the key value, and the sequence of chords of the detected music may be produced and supplied to the slave rhythm unit 220 from the master rhythm unit 210. This makes it possible to play a piece of music at a tempo or a style similar to the tempo or the style of the music often listened to in such an environmental condition.

Thus, the music reconstruction data ARI including the BPM value, the key value, and the chord value associated with music selected according to the biological information and/or the environment information and the playback history information is output to the slave rhythm unit 220 in synchronization with the synchronization signal SYNC. The slave rhythm unit 220 reconstructs the music so as to have a temp or a style determined depending on a feeling and/or an environmental situation, and outputs resultant audio playback data.

In a case where an arrangement request command is issued by a user via the user interface 11, music is reconstructed so as to have a tempo and/or a style according to the arrangement request command and resultant audio playback data is output in a similar manner to the first embodiment described above.

In this second embodiment, the method of generating the synchronization signal SYNC are not limited to the examples described above. For example, the synchronization signal SYNC may be generated in accordance with the environment information acquired via the environment information acquisition unit 40 and the playback history stored in the playback history information storage unit 15.

For example, playback history stored in the playback history information storage unit 15 may be searched using, as a search key, environment information acquired from environment information acquisition unit 40 to detect a piece of music having environment information in attribute information similar or close to the environment information acquired from environment information acquisition unit 40, and the synchronization signal SYNC may be produced in accordance with a BPM value included in the attribute information associated with the music detected as a result of the search.

In the first embodiment described above, music to be played first is selected by a user. In this second embodiment, music to be played first may be selected by a user or may be selected as follows. When the synchronization signal SYNC is generated according to a BPM value specified by a user in the internal rhythm synchronization mode, or when the external rhythm synchronization mode or the biological rhythm synchronization mode is selected, the slave rhythm unit 220 detects a piece of music absolutely or substantially matching music reconstruction data ARI from the attribute information stored in the attribute information storage unit 22 of the music content storage unit 20, and selects the detected piece of music as that to be played first.

Also in this second embodiment, a piece of music being currently played may be reconstructed according to the synchronization signal SYNC and music reconstruction data ARI output from the master rhythm unit 210 in a similar manner to the first embodiment described above.

Operation of Master Rhythm Unit 210

The operation of the master rhythm unit 210 according to the second embodiment is described below with reference to flow charts shown in FIGS. 31 to 34.

First, in the second embodiment, the playback mode setting unit 240 determines which synchronization reference signal is specified by a user via the user interface 11 (step S201).

In a case where it is determined in step S201 that the internal rhythm synchronization mode is selected, and it is specified to synchronize with a music content of interest to be played, the playback mode setting unit 240 of the audio/video data selection control RM unit 201M acquires attribute information associated with music being played from the attribute information storage unit 22 of the music content storage unit 20 via the attribute information acquisition unit 203 (step S202), and extracts the BPM value, the key value, and the chord value from the acquired attribute information (step S203).

On the basis of the extracted BPM value, a synchronization signal SYNC including a measure synchronization signal PHSY and a beat synchronization signal BTSY is produced (step S204). The extracted BPM value, the key value, and the chord value are respectively set in the BPM value setting unit, the key value setting unit, and the chord value setting unit (step S205).

The synchronization signal SYNC produced in step S204 and the music reconstruction data ARI including the BPM value, the key value, and the chord value set in step S205 are sent to the slave rhythm unit 220 (step S206).

A determination is then made as to whether to the playback operation has been stopped (step S207). If the determination is affirmative, the present processing routine is ended. However, if the determination is negative, a further determination is made as to whether the end of the current piece of music has been reached (step S208), then it is determined whether a user has issued a command via the user interface 11 to change the synchronization reference (step S210). If it is determined that the synchronization reference is changed, the processing flow returns to step S201 to repeat the process from step S201.

In the case where it is determined in step S210 that the synchronization reference has not been changed, the processing flow returns to step S204 to repeat the process from step S204.

If it is determined in step S208 that the end of the music has been reached, a preparation is made for playback of next selected piece of music (step S209). The processing flow then returns to step S202 to repeat the process from step S202.

Figure 32:
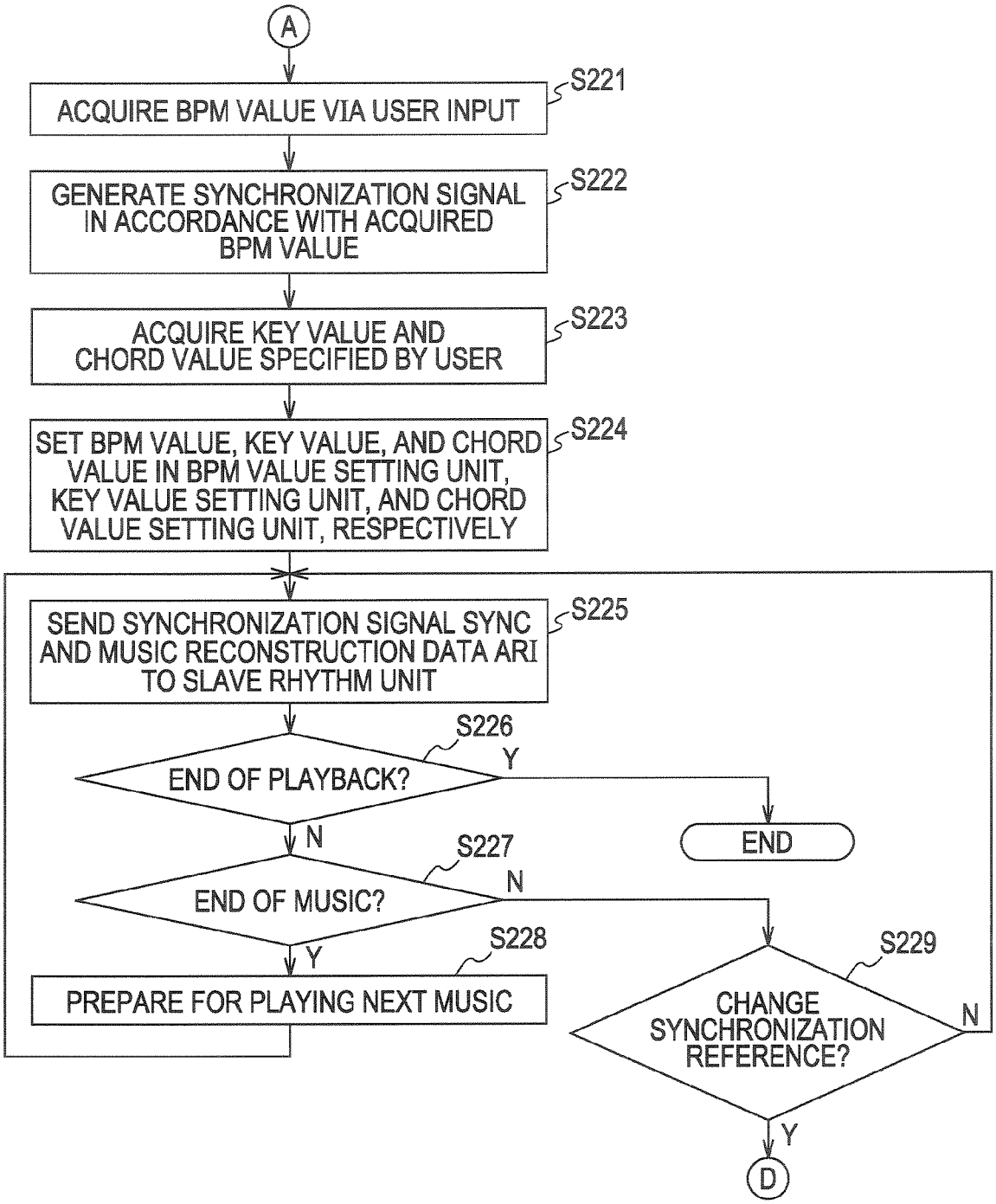
FIG. 32 is a part of the flow chart illustrating the process performed by the master rhythm unit included in the structure shown in FIG. 27.

On the other hand, in a case where it is determined in step S201 that the internal rhythm synchronization mode is selected, and it is specified that the synchronization reference signal should be generated according to a value specified by a user, the playback mode setting unit 240 acquires a BPM value specified by the user (step S221 in FIG. 32). On the basis of the acquired BPM value, a synchronization signal SYNC including a measure synchronization signal PHSY and a beat synchronization signal BTSY is produced (step S222). In addition to the BPM value, a key value and a chord value specified by the user are acquired (step S223). The acquired BPM value, key value, and chord value are sent to the music reconstruction data setting unit 214 and respectively set in the BPM value setting unit 217, the key value setting unit 218, and the chord value setting unit 219 (step S224).

The synchronization signal SYNC produced in step S222 and the music reconstruction data ARI including the BPM value, the key value, and the chord value set in step S223 are sent to the slave rhythm unit 220 (step S225).

A determination is then made as to whether to the playback operation has been stopped (step S226). If the determination is affirmative, the present processing routine is ended. However, if the determination is negative, a further determination is made as to whether the end of the current piece of music has been reached (step S227). If it is determined that the end of the current piece of music has not been reached, then it is determined whether a user has issued a command via the user interface 11 to change the synchronization reference (step S229). If it is determined that the synchronization reference is changed, the processing flow returns to step S201 to repeat the process from step S201.

In the case where it is determined in step S229 that the synchronization reference has not been changed, the processing flow returns to step S225 to repeat the process from step S225.

If it is determined in step S227 that the end of the music has been reached, a preparation is made for playback of next selected piece of music (step S228). The processing flow then returns to step S225 to repeat the process from step S225.

Figure 33:
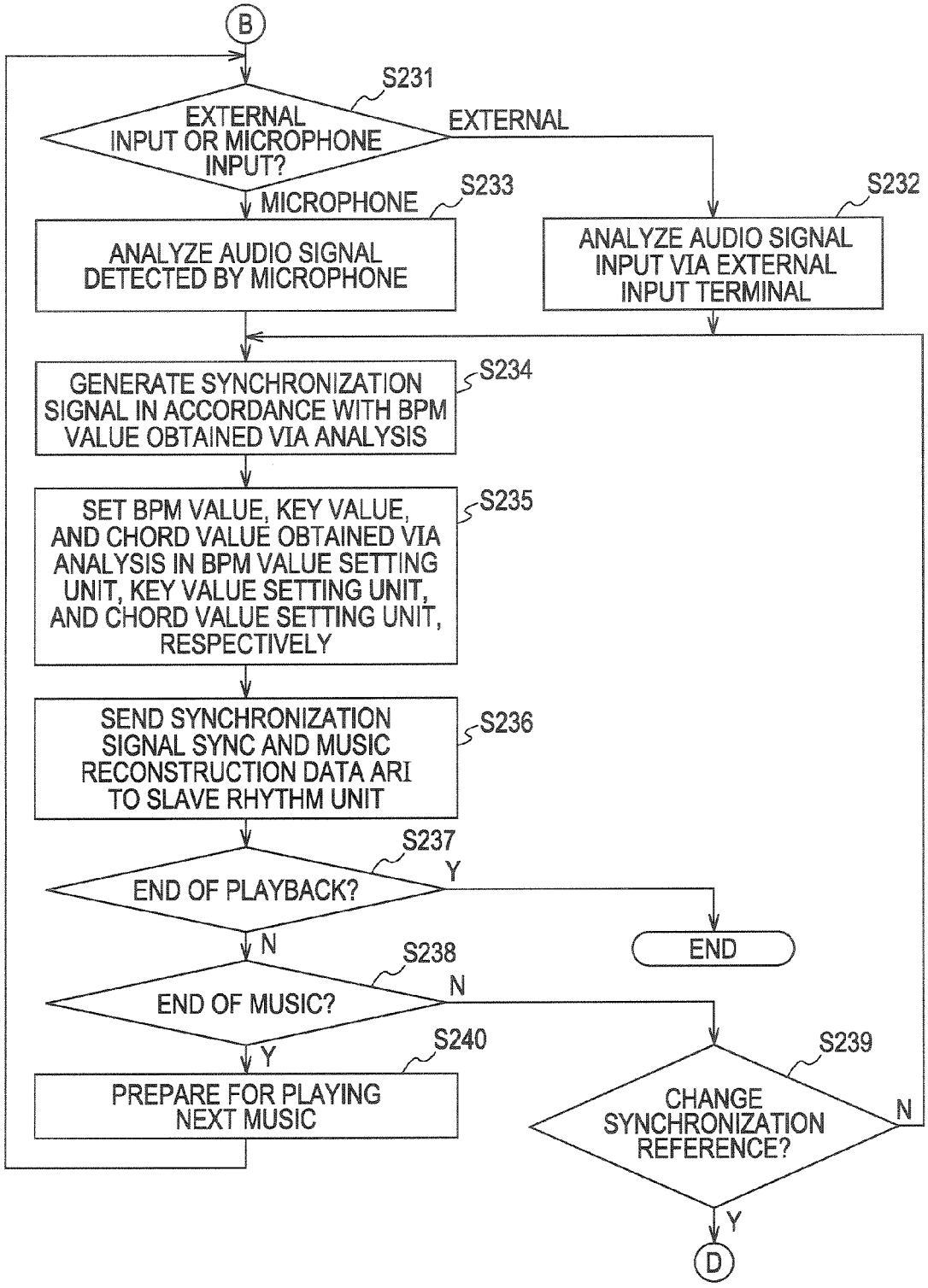
FIG. 33 is a part of the flow chart illustrating the process performed by the master rhythm unit included in the structure shown in FIG. 27.
Figure 34:
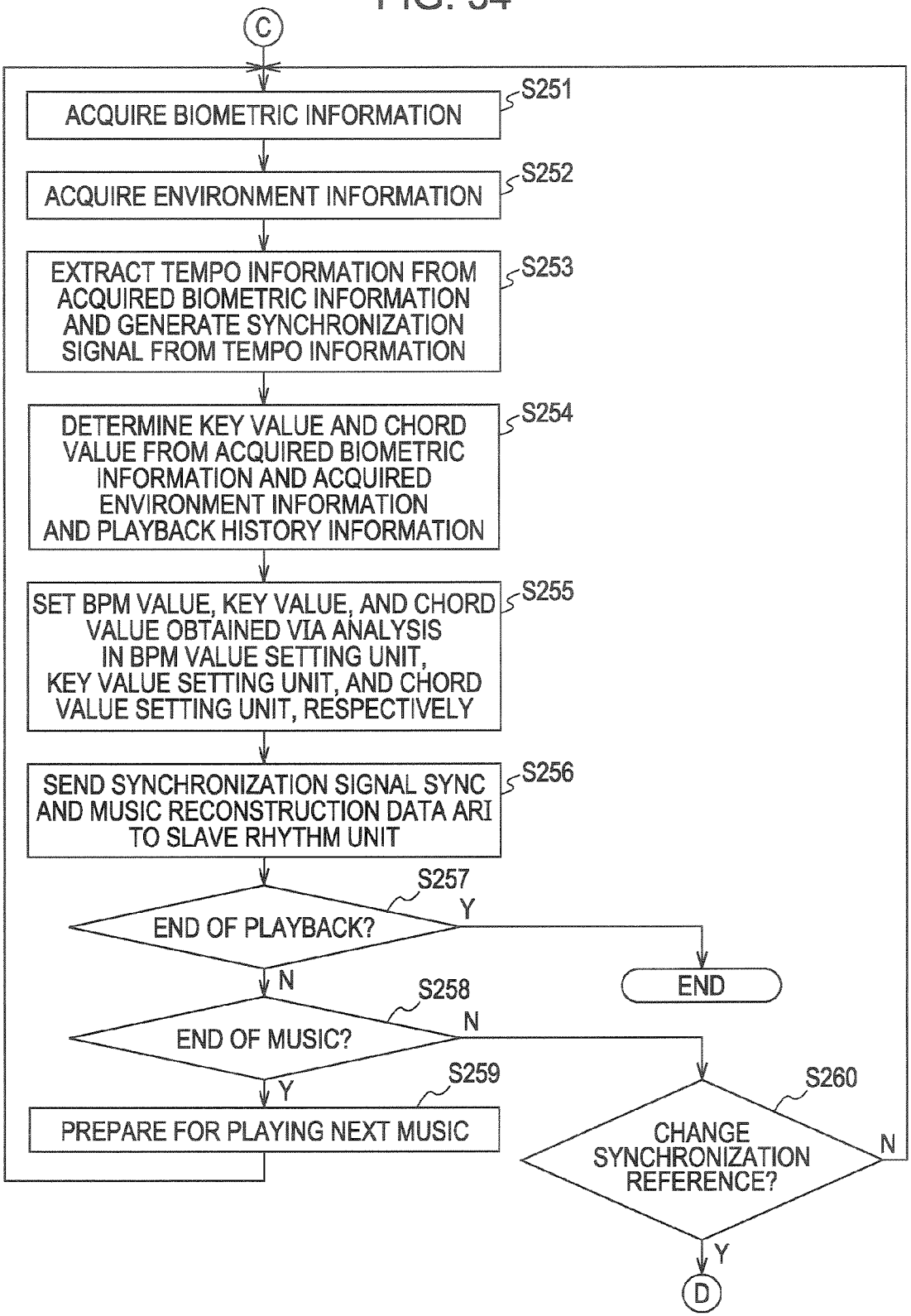
FIG. 34 is a part of the flow chart illustrating the process performed by the master rhythm unit included in the structure shown in FIG. 27.

In a case where it is determined in step S201 that it is specified that the synchronization reference signal should be generated in the external rhythm synchronization mode, a determination is made as to whether an input signal given via the external input terminal 8 or an audio signal detected via the microphone 9 is used as the synchronization reference signal (step S231 in FIG. 33).

If it is determined in step S231 that the input signal given via the external input terminal 8 is used as the synchronization reference signal, the playback mode determination unit 240 supplies the audio signal input via the external input terminal 8 to the music style/structure analyzer 13 to analyze the input audio signal (step S232). On the other hand, in a case where it is determined in step S231 that the audio signal detected via the microphone 9 is used as the synchronization reference signal, the playback mode determination unit 240 supplies the audio signal detected via the microphone 9 to the music style/structure analyzer 13 to analyze the input audio signal (step S233).

After step S232 or S233, the processing flow proceeds to step S234. In step S234, the BPM value is determined from the result of analysis made by the music style/structure analyzer 13, and the determined BPM value is supplied to the synchronization signal generator 230 to generate a synchronization signal SYNC. (step S234).

In addition to the BPM value, the key value and the chord value are determined from the result of analysis made by the music style/structure analyzer 13, and the determined BPM value, key value, and chord value are sent to the music reconstruction data generator 214 and respectively set in the BPM value setting unit 217, the key value setting unit 218, and the chord value setting unit 219 (step S235).

The synchronization signal SYNC produced in step S234 and the music reconstruction data ARI including the BPM value, the key value, and the chord value set in step S235 are sent to the slave rhythm unit 220 (step S236).

A determination is then made as to whether to the playback operation has been stopped (step S237). If the determination is affirmative, the present processing routine is ended. However, if the determination is negative, a further determination is made as to whether the end of the current piece of music has been reached (step S238). If it is determined that the end of the current piece of music has not been reached, then it is determined whether a user has issued a command via the user interface 11 to change the synchronization reference (step S239). If it is determined that the synchronization reference is changed, the processing flow returns to step S201 to repeat the process from step S201.

In the case where it is determined in step S239 that the synchronization reference has not been changed, the processing flow returns to step S234 to repeat the process from step S234.

If it is determined in step S238 that the end of the music has been reached, a preparation is made for playback of next selected piece of music (step S240). The processing flow then returns to step S231 to repeat the process from step S231.

In a case where it is determined in step S201 that the biological rhythm is used as the synchronization reference signal, the playback mode setting unit 240 acquires biological information of the listener via the biological information acquisition unit 30 (step S251 in FIG. 34), and acquires the environment information associated with the recording/playback apparatus (step S252).

The tempo information is produced on the basis of the acquired biological information, and the produced tempo information is supplied to the synchronization signal generator 230. The synchronization signal generator 230 produces a synchronization signal SYNC in accordance with the tempo information (step S253). The BPM value, the key value, and the chord value are determined in the above-described manner in accordance with the biological information, the environment information, and the playback history information stored in the playback history information storage unit 15 (step S254).

The determined BPM value, key value, and chord value are sent to the music reconstruction data setting unit 214 and respectively set in the BPM value setting unit 217, the key value setting unit 218, and the chord value setting unit 219 (step S255).

The synchronization signal SYNC produced in step S253 and the music reconstruction data ARI including the BPM value, the key value, and the chord value set in step S255 are sent to the slave rhythm unit 220 (step S256).

A determination is then made as to whether to the playback operation has been stopped (step S257). If the determination is affirmative, the present processing routine is ended. However, if the determination is negative, a further determination is made as to whether the end of the current piece of music has been reached (step S258). If it is determined that the end of the current piece of music has not been reached, then it is determined whether a user has issued a command via the user interface 11 to change the synchronization reference (step S260). If it is determined that the synchronization reference is changed, the processing flow returns to step S201 to repeat the process from step S201.

In the case where it is determined in step S260 that the synchronization reference has not been changed, the processing flow returns to step S251 to repeat the process from step S251.

If it is determined in step S258 that the end of the music has been reached, a preparation is made for playback of next selected piece of music (step S259). The processing flow then returns to step S251 to repeat the process from step S251.

In the second embodiment, as described above, the reconstruction is allowed to be performed in a such manner that the tempo and/or the key of music being played itself. If a listener specifies a tempo and/or a key at/in which to play music via the user interface, the music being currently played is reconstructed and is played at the specified tempo and/or in the specified key.

The music reconstruction is allowed to be performed such that a specified piece of music is played in synchronization with an audio signal input from the outside. It is also possible to play music in synchronization with a walking pace or a pulse rate of a listener. Furthermore, it is possible to increase or decrease the tempo and/or the key depending on the environmental situation.

Figure 35:
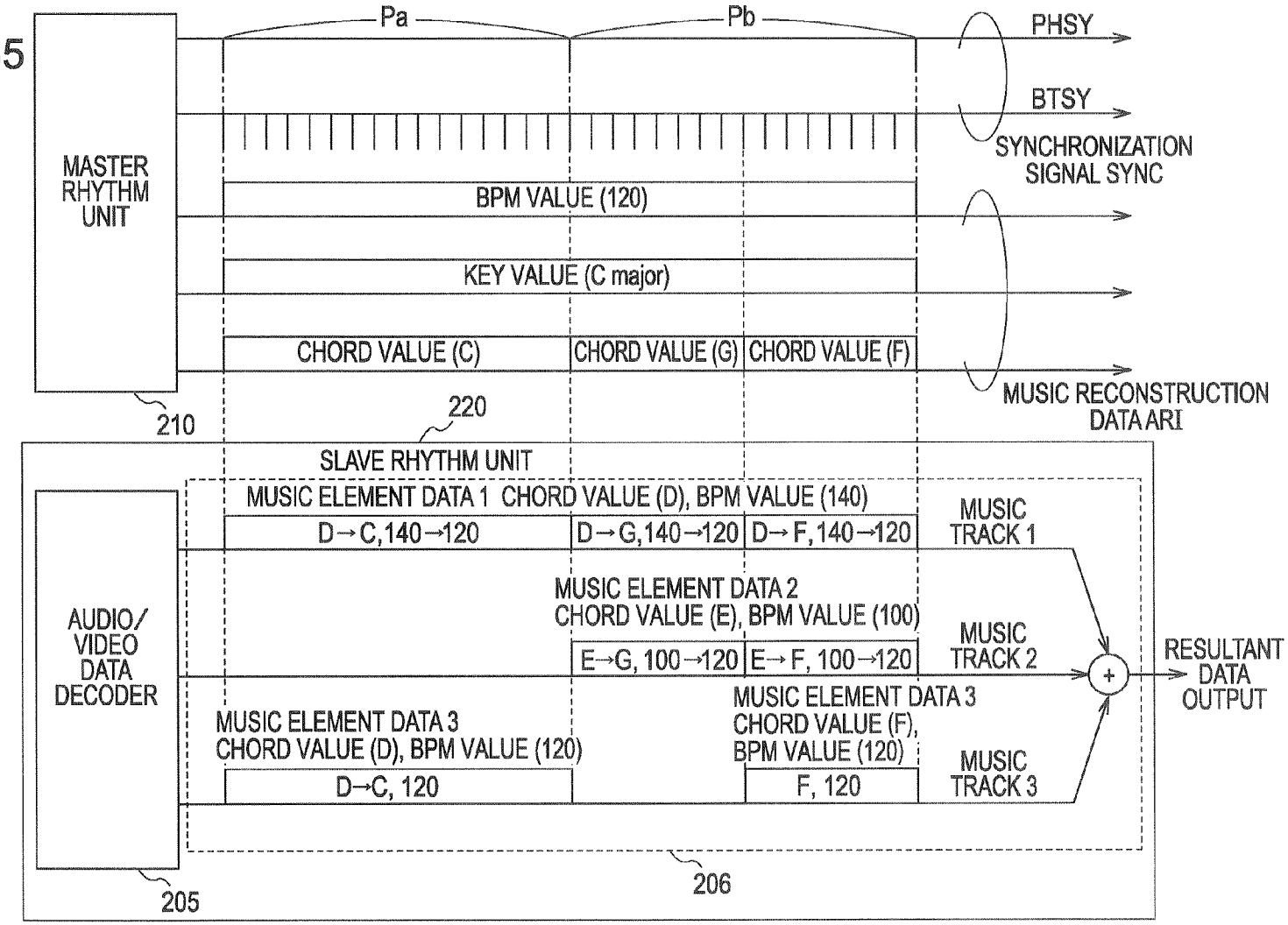
FIG. 35 is a timing chart associated with the functional block diagram shown in FIG. 27.

FIG. 35 illustrates flows of music signals and music reconstruction data ARI according to the second embodiment. More specifically, FIG. 35 illustrates music signals which are transmitted, in synchronization with a synchronization signal SYNC output from the master rhythm unit 210, in the audio/video data decoder 205 and the audio/video arrangement processing unit 206 in the slave rhythm unit 220 during a music data reconstruction process performed by the audio/video arrangement processing unit 206 in the slave rhythm unit 220 in accordance with music reconstruction data ARI output from the master rhythm unit 210.

In the example shown in FIG. 35, the music reconstruction data ARI is not necessarily that extracted from attribute information associated with a music content of interest being played, and thus the BPM value can be different from that of the music content of interest. Furthermore, the key value and the chord value included in the music reconstruction data ARI can be different from those of the music content of interest being played.

In the example shown in FIG. 35, the music content to be played is given in the form of a playback signal stream in a music track 1. In the example shown in FIG. 35, the music reconstruction data ARI indicating the target BPM value "120", the target key value "C major" and the sequence of target chord values "C"→"G"→"F" is input to the slave rhythm unit 220 from the master rhythm unit 210.

The slave rhythm unit 220 processes the playback signal stream of the music content in the music track 1 such that the tempo and/or the key of music data itself of the music content of interest acquired from the music content storage unit 20 are modified according to the selection command supplied from the arrangement control unit 221, while two pieces of musical material data are output in music tracks 2 and 3 from the audio/video data decoder 205, corrected so as to satisfy the target values described in the music reconstruction data ARI, and finally mixed with the music content in the music track 1.

More specifically, in the audio/video arrangement processing unit 206, the audio data in the music track 1 is corrected so as to be consistent with the target BPM value and the target chord value specified in the music reconstruction data ARI, and the audio data in the music tracks 2 and 3 are corrected so as to be consistent with the target BPM value and the target chord value specified in the music reconstruction data ARI, and the corrected audio data in the music tracks 2 and 3 are mixed with the music data in the music track 1.

In the above process, in the example shown in FIG. 35, in measure periods Pa and Pb, the BPM value of the musical material data 1 in the music track 1 acquired via the attribute information acquisition unit 203 is "140" which is different from the BPM value "120" specified in the music reconstruction data ARI. Therefore, the audio/video arrangement processing unit 206 corrects the tempo such that the BPM value of the music data in the track 1 is changed from "140" to "120" in the measure periods Pa and Pb.

In the measure period Pa, the chord value acquired via the attribute information acquisition unit 203 for the musical material data 1 is "D" which is different from the chord value "C" specified in the music reconstruction data ARI. Thus, the audio/video arrangement processing unit 206 corrects the pitch such that the chord value of the music data in the music track 1 is changed from "D" to "C".

In this measure period Pa, the musical material data 3 in the music track 3 is mixed with the audio data in the music track 1. The BPM value acquired via the attribute information acquisition unit 203 for the musical material data 3 in the measure period Pa is "120" which is equal to the BPM value specified in the music reconstruction data ARI, and thus the audio/video arrangement processing unit 206 does not correct the tempo of the musical material data 3 in this measure period Pa.

On the other hand, in the measure period Pa, the chord value acquired via the attribute information acquisition unit 203 for the musical material data 3 is "D" which is different from the chord value "C" specified in the music reconstruction data ARI, and thus the musical material data 3 is corrected in terms of the pitch by the pitch correction circuit 226 of the audio/video arrangement processing unit 206 such that the chord values is changed from "D" to the target chord value "C".

In the first half of the next measure period Pb, the chord value acquired via the attribute information acquisition unit 203 for the audio data of the musical material 1 in the music track 1 is "D" which is different from the chord value "G" specified in the music reconstruction data ARI. Therefore, the audio/video arrangement processing unit 206 corrects the pitch such that the chord value of the music data in the music track 1 is changed from "D" to "G".

In the second half of the measure period Pb, the chord value acquired via the attribute information acquisition unit 203 for the audio data of the musical material 1 is "D" which is different from the chord value "F" specified in the music reconstruction data ARI. Therefore, the audio/video arrangement processing unit 206 corrects the pitch such that the chord value of the music data in the music track 1 is changed from "D" to "F".

In the first half of the measure period Pb, the musical material data 2 in the music track 2 is mixed with the audio data in the music track 1. In the second half of the measure period Pb, the musical material data 2 in the music track 2 and the musical material data 3 in the music track 3 are mixed with the music data in the music track 1.

In the first half of the measure period Pb, the BPM value of the musical material data 2 acquired by the attribute information acquisition unit 203 is "100" and the chord value is "E" which are different from the target BPM value "120" and the target chord value "G" specified in the music reconstruction data ARI. Therefore, in the first half of the measure period Pb, the audio/video arrangement processing unit 206 corrects the BPM value of the musical material data 2 from "100" to the target value "120" thereby correcting the tempo, and the audio/video arrangement processing unit 206 corrects the pitch so that the chord is corrected from "E" to the target chord value "G". In the second half of the measure period Pb, the corrected musical material data 2 is added to the music data in the music track 1.

In the second half of the measure period Pb, the musical material data 2 is "100" in the BPM value and "E" in the chord value which are different from the target BPM value "120" and the target chord value "F" specified in the music reconstruction data ARI, while the musical material data 3 is "120" in the BPM value and "F" in the chord value which are the same as the target BPM value "120" and the target chord value "F" specified in the music reconstruction data ARI.

Thus, in the second half of the measure period Pb, the musical material data 2 in the music track 2 is corrected in terms of the tempo and the pitch by the audio/video arrangement processing unit 206 and the corrected data is added to the music data in the music track 1, while the musical material data 3 in the music track 3 is directly added, without being subjected to correction, to the music data in the music track 1.

In the second embodiment, as described above, depending on a feeling of a listener, it is allowed to reconstruct a music content being played in various manners depending on a feeling of a listener in accordance with the synchronization signal SYNC and the music reconstruction data ARI output from the master rhythm unit. One or more pieces of other music data can be mixed with original music data into a musically natural form. Furthermore, a user is allowed to specify a music style such as the classic style, the jazz style, the rock and roll style, etc. into which to arrange music, and the user can enjoy listening to the arranged music.

Also in this second embodiment, it is possible to easily detect boundaries of measures or beats on the basis of the synchronization signal SYNC, and thus it is possible to easily apply an effect to music data. Furthermore, also in this second embodiment, the loop playback mode can also be used in the remixing proceeds.

In the second embodiment, the synchronization signal can be changed depending on the biological information of a user listening to music being played, the environment information, and/or the playback history information of the user. This makes it possible to arrange music in a wide variety of manners depending on the preference of the user and/or the environmental situation.

Third Embodiment

In the embodiments described above, the arrangement information including recommended information is produced and included in attribute information in advance by a music content provider. Alternatively, arrangement information may be produced by a user.

In this case, information about the sequence of chords, the tempo, etc. of original music described in the music construction information included in attribute information associated with the music content may be presented to the user so the user is allowed to modify them as desired.

More specifically, if a user inputs a command to the music content recording/playback apparatus to produce user-provided arrangement information together with music identification information such as a music ID, the recording/playback apparatus (CPU 1) extracts music construction information in terms of the tempo, the sequence of chords, etc. for each music constituent element from the attribute information associated with specified music, and displays the extracted music construction information, for example, on the LCD display screen 111.

The user modifies respective items of the displayed music construction information as desired, by directly inputting modified values, or by copying or partially changing values, thereby inputting arrangement information. The user then requests the music content recording/playback apparatus to register the produced arrangement information together with identification information such as a name of the arrangement information.

In response, the produced arrangement information is incorporated as user-provided arrangement information in the attribute information associated with the music of interest and is stored together with the identification name such as the name in the attribute information storage unit 22. Instead of storing the user-provided arrangement information included in the attribute information in the attribute information storage unit 22, the user-provided arrangement information may be stored separately from the arrangement information in a storage area allocated for use of storing the user-provided arrangement information.

When the an arrangement request command issued by a user specifies that arrangement should be performed using user-provided arrangement information, the music content recording/playback apparatus reads a list of user-provided arrangement information and displays it. If the user selects desired user-provided arrangement information from the list, the music content recording/playback apparatus arranges music by reconstructing the music in accordance with the selected user-provided arrangement information in a similar manner as described above.

The arrangement information produced by a user may be uploaded to the server 6 together with the identification information thereof and the music ID, for use by other users. When the server 6 receives from a user a request to download user-provided arrangement information for a particular piece of music, the server 6 sends the requested user-provided arrangement information to the user.

Other Embodiments and Modifications

In the embodiments described above, an arrangement request is issued by using the LCD display screen 111 and the cursor button 112 as shown in FIG. 12. Alternatively, the LCD display screen 111 may be combined with a touch panel so that a user is allowed to issue an arrangement request via only the LCD display screen 111.

Instead of using the combination of the LCD display screen 111 and the operation button such as that shown in FIG. 12, operation buttons for directly specifying a music style into which to arrange music may be provided on the music content recording/playback apparatus.

Figure 36:
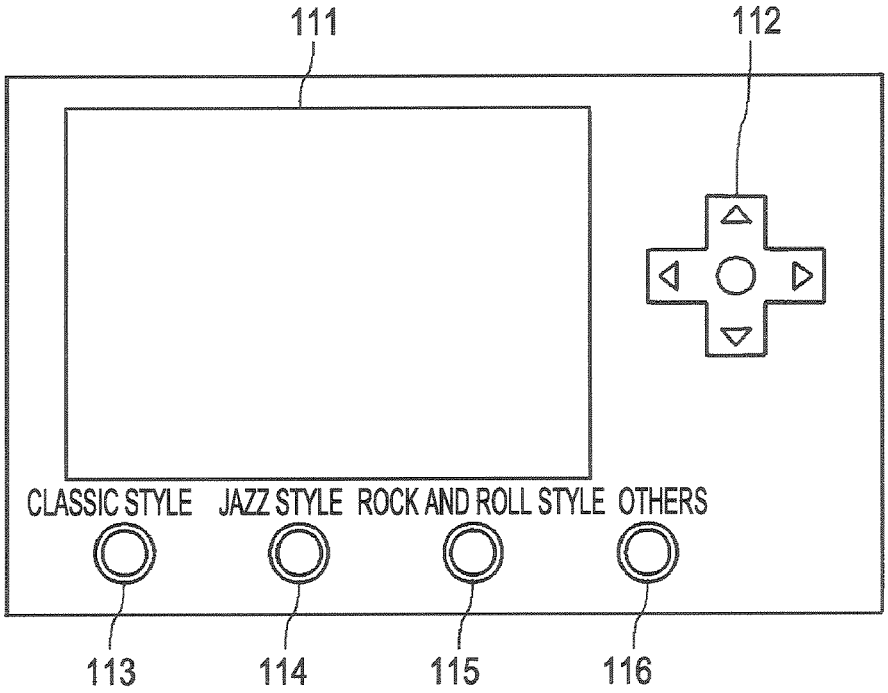
FIG. 36 is a diagram illustrating another example of an operation of inputting an arrangement request command to a recording/playback apparatus according to an embodiment.

In an example shown in FIG. 36, a user is allowed to specify a style into which to arrange music simply by pressing a button corresponding to the desired style.

More specifically, in the example shown in FIG. 36, there are provided style specifying buttons including a classis style button 113, a jazz style button 114, a rock and roll style button 115, and an other style button 116. If a user presses, for example, the classic style button 113 when a piece of music is being played, attribute information associated with the piece of music being played is analyzed, and arrangement information for use in arrangement into the classic style is read. In accordance with this arrangement information, the piece of music is reconstructed in the above-described manner and the resultant reconstructed music is played.

When the classic-style arrangement information in the attribute information includes a plurality of sub classic styles, if the user presses the classic style button 113, a list of sub classic styles is displayed on the LCD display screen 111 in a similar manner as shown in FIG. 12(B). In this situation, if one of arrangement style is selected by operating the cross cursor button 112 and finally determined, the piece of music being played is reconstructed into the specified arrangement style and played.

Figure 37:
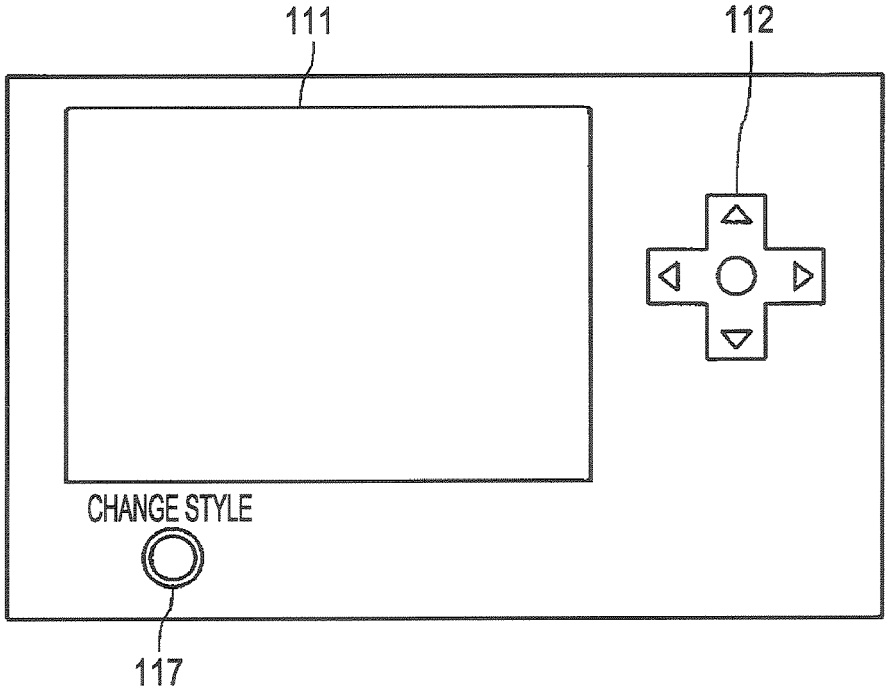
FIG. 37 is a diagram illustrating another example of an operation of inputting an arrangement request command to a recording/playback apparatus according to an embodiment.

Instead of disposing a plurality of buttons as shown in FIG. 36, a single style selection button 117 is disposed as shown in FIG. 37. Each time this style selection button 117 is pressed, the style is changed cyclically, for example, in order classic style→jazz style→rock and roll style→hip-hop style. When the style selection button 117 is pressed, the currently selected style is displayed on the LCD display screen 111 so that the user can recognize which style is currently selected.

A touch panel may be attached to the LCD display screen 111 and the operation buttons 113 to 117 shown in FIG. 36 or 37 may be displayed on the LCD display screen 111 so that a user is allowed to operate these operation button via the touch panel.

In the example shown in FIG. 36, one "style" is assigned to each button. Alternatively, a variable operation means may be provided and two "types" may be assigned to the single operation means.

Figure 38:
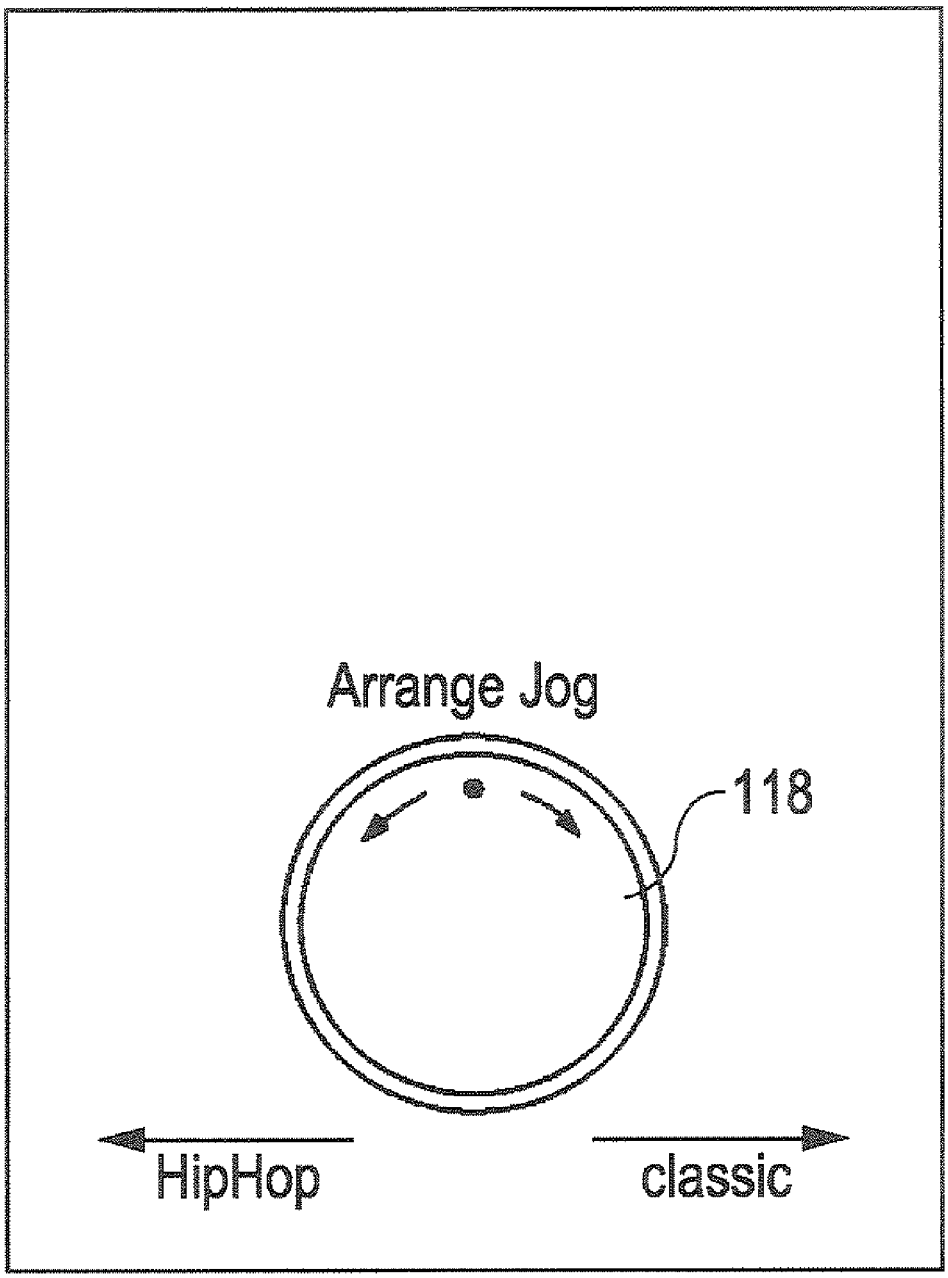
FIG. 38 is a diagram illustrating another example of an operation of inputting an arrangement request command to a recording/playback apparatus according to an embodiment.

In an example shown in FIG. 38, a rotatable dial-shaped knob 118 is provided as the variable operation means. When the knob 118 is set in a center position, a music content is played in its original style. In the example shown in FIG. 38, the playback apparatus is configured such that as the dial-shaped knob 118 is rotated in a clockwise direction from the center position, the style gradually changes toward the "classic style" depending on the rotation angle of the knob 118. Conversely, if the dial-shaped knob 118 is rotated in a counterclockwise direction, the style gradually changes toward the "hip-hop style" depending on the rotation angle.

In the example shown in FIG. 38, the variable operation means is implemented in the form of a dial-shaped knob. Alternatively, the variable operation means may be implemented in the form of a slidable knob.

Each of the operation buttons 113 to 116 for selecting styles shown in FIG. 36 may be implemented in the form of a dial-shaped push button so that when a particular dial-shaped push button is pressed, a corresponding style is selected, and the degree to which music is arranged into the selected style gradually varies depending on the rotation position. When the dial is fully rotated in a counterclockwise direction, music is played in the original style. As the dial is rotated from this position in a clockwise direction, the degree to which music arranged into the selected style gradually increases.

The operation button 117 shown in FIG. 37 may be implemented in a similar manner. More specifically, each time the operation button 117 is pressed, the style changes. If the dial 117 is rotated in a clockwise direction, the style gradually changes toward the selected style depending on the rotation angle.

Any dial-shaped knob may be displayed on the LCD display screen 111 so that it can be operated via the touch panel.

A dial-shaped variable knob, which is allowed to be operated by a user, may be adapted such that it is variably controlled in response to, for example, biological information supplied from the biological information acquisition unit 30. For example, a walking pace of a user is acquired from the biological information acquisition unit 30, and, as the walking pace increases, the music playback tempo is increased and the degree to which music is arranged into the hip-hop style is increased.

In the embodiments described above, the arrange mode includes the automatic mode and the manual mode. Alternatively, the arrange mode may include only the manual mode.

When only the manual mode is available, unlike the embodiments described above, it is not necessary to configure the apparatus such that an arrangement is performed when a user shows some preference for current music, but the apparatus is configured such that an arrangement is performed at any time when an arrangement request command is issued.

When the arrangement mode is configured to be operable only in the manual mode, the biological information acquisition unit 30 and the environment information acquisition unit 40 are not necessary. This allows the apparatus to be configured in a simpler structure.

In the embodiments described above, the arrangement information is stored as a part of the attribute information in the attribute information storage unit in association with corresponding music data. However, the arrangement information does not necessarily need to be included in the attribute information, but the arrangement information may be stored separately from the attribute information in association with a corresponding music ID.

In the embodiments described above, when a user issues an arrangement request command, arrangement information is read from the storage unit of the music content recording/playback apparatus and music data is reconstructed in accordance with the arrangement information. Alternatively, when a user issues an arrangement request command, arrangement information may be acquired from a server, and a reconstruction process (an arrangement process) may be performed in accordance with the acquired arrangement information. In this case, it is not necessary to store arrangement information in the music content recording/playback apparatus.

In this case, the music content recording/playback apparatus does not need to include an operation unit for directly controlling arrangement request commands, but the music content recording/playback apparatus simply needs to operate such that a list of available arrangement styles is acquired from the server 6 and displayed so that a user is allowed to select a desired arrangement style by operating a cross cursor button or the like.

In this case, it is not necessarily needed to acquire arrangement information from the server before playing of music is started, but arrangement information may be acquired in the middle of playback of music. The music content recording/playback apparatus may perform the reconstruction process (the arrangement process) while acquiring arrangement information in real time.

In the embodiments described above, the music content storage unit is implemented by a hard disk drive, and audio/video data of music contents and associated attribute information are stored therein in association with corresponding music content identification information (music contents IDs). Alternatively, as described above, the music content storage unit may be implemented by a removable storage medium such as a DVD disk or an optical disk.

In the embodiments described above, each content is stored together with attached corresponding attribute information in the music content storage unit. Alternatively, attribute information may be acquired as required via the Internet by performing a search using an music content ID as a search key. In this case, a server connected to the Internet functions as an attribute information storage unit.

The audio/video data of music contents and corresponding attribute information do not necessarily need to be stored in the same storage unit, but they may be stored separately in different storage units as longs as they can be correctly related to each other via identification information such as music content IDs.

In the above-described examples, the invention is embodied in the form of a recording/playback apparatus. The invention may be embodied in the form of a playback apparatus having no recording capability.

The playback process shown in FIGS. 22 to 24 is merely an example, and the playback process may be performed in various manners.

For example, in the embodiments described above, only when the preference level for music being played is high, the music is subjected to the reconstruction process including, for example, changing of the tempo and/or the key, remixing, application of an effect, etc. Alternatively, music being played may be reconstructed regardless of the preference level.

In the embodiments described above, music contents are accompanied with video data. As a matter of course, music contents do not necessarily need to be accompanied with video data.

In the first embodiment described above, a piece of music to be played first is specified by a user. Alternatively, a piece of music to be played first may be automatically selected by the apparatus in accordance with biological information of a listener, environment information, and/or playback history information.

For example, on the basis of biological information of a listener, a determination may be made as to whether the listener is in an excited state or a calm state, and a piece of music having a style matching the detected state or a piece of music having an opposite style may be selected as the piece of music to be played first. On the basis of environment information, the current place such as a mountain or a beach may be detected, and a piece of music matching the detected current place may be detected in accordance with environment information included in attribute information and selected as the piece of music to be played first. Alternatively, a piece of music frequently listened to by a user may be detected from playback history information and selected as the piece of music to be played first.

The invention claimed is:

1. A music content playback apparatus comprising:

a first acquisition unit configured to acquire data of a music content to be played back from a music content data storage unit storing data of a plurality of music contents;

a second acquisition unit configured to acquire, from an attribute information storage unit, attribute information associated with the music content, the attribute information including at least music construction information associated with each music constituent element of the music content;

a third acquisition unit configured to acquire arrangement information associated with the music content and the music construction information, the arrangement information including a plurality of musical styles;

a playback unit configured to provide an audio playback output of the music content acquired by the first acquisition unit;

an arrangement request command accepting unit configured to accept an arrangement request command issued by a listener to select a musical style from the arrangement information; and a reconstructing unit configured to reconstruct, via a processor, the data of the music content to be output as audio playback output data, based on the music construction information acquired by the second acquisition unit and the arrangement information acquired by the third acquisition unit in accordance with the arrangement request command accepted by the arrangement request command accepting unit.

2. The music content playback apparatus according to claim 1, further comprising:

a master rhythm unit configured to generate a synchronization signal including a signal with a period corresponding to a measure of music and a signal with a period corresponding to a beat of the music, and generate music reconstruction information in synchronization with the synchronization signal; and a slave rhythm unit configured to output music data by reconstructing the music content data acquired, for playback, by the first acquisition unit in accordance with the synchronization signal and the music reconstruction information supplied from the master rhythm unit and in accordance with the arrangement information acquired by the third acquisition unit, and provide an audio playback output of the resultant reconstructed music data.

3. The music content playback apparatus according to claim 1, wherein the arrangement information is stored in a storage unit of the music content playback apparatus, and the third acquisition unit reads the arrangement information from the storage unit of the music content playback apparatus in accordance with the arrangement request command accepted by the arrangement request command accepting means.

4. The music content playback apparatus according to claim 1, wherein the third acquisition unit acquires the arrangement information via a communication network from a server in which the arrangement information is stored in accordance with the arrangement request command accepted by the arrangement request command accepting means.

5. The music content playback apparatus according to claim 1, wherein the arrangement information is produced by the listener.

6. The music content playback apparatus according to claim 1, wherein the arrangement request command accepting unit includes an operation unit configured to specify a musical style.

7. The music content playback apparatus according to claim 1, wherein the arrangement request command accepting unit includes a dial-shaped variable control unit, and when the dial-shaped variable control unit is displaced into one direction, the degree to which music is arranged into a first arrangement type is gradually increased with increasing displacement, while when the dial-shaped variable control unit is displaced into an opposite direction, the degree to which music is arranged into a second arrangement type is gradually increased with increasing displacement.

8. A music content playback method comprising:

acquiring data of a music content to be played back from a music content data storage unit storing data of a plurality of music contents;

acquiring attribute information associated with the music content from an attribute information storage unit, the attribute information including at least music construction information associated with each music constituent element of the music content;

acquiring arrangement information associated with the music content and the music construction information, the arrangement information including a plurality of musical styles;

providing an audio playback output of the acquired music content;

accepting an arrangement request command issued by a listener to select a musical style from the arrangement information; and reconstructing, via a processor, the data of the music content to be output as audio playback output data, based on the music construction information and the arrangement information in accordance with the arrangement request command.

9. A music content playback apparatus comprising:

first acquisition means for acquiring data of a music content to be played back from a music content data storage unit storing data of a plurality of music contents;

second acquisition means for acquiring, from an attribute information storage unit, attribute information associated with the music content, the attribute information including at least music construction information associated with each music constituent element of the music content;

a third acquisition means for acquiring arrangement information associated with the music content and the music construction information, the arrangement information including a plurality of musical styles;

means for providing an audio playback output of the music content acquired by the first acquisition means;

arrangement request command accepting means for accepting an arrangement request command issued by a listener to select a musical style from the arrangement information; and reconstructing means for reconstructing the data of the music content to be output as audio playback output data, based on the music construction information acquired by the second acquisition means and the arrangement information acquired by the third acquisition means in accordance with the arrangement request command accepted by the arrangement request command accepting means.

10. The music content playback apparatus according to claim 1, wherein each musical style includes a plurality of sub-musical styles each based on a musical artist.

11. The music content playback apparatus according to claim 1, wherein the reconstructing unit reconstructs the data of the music content by changing the data of the music content from a first musical style to a second musical style.

12. The music content playback apparatus according to claim 11, wherein the second musical style is the musical style selected by the listener via the arrangement request command accepting means.

* * * * *